United States Patent [19]

Aoike et al.

[11] Patent Number: 4,886,723

[45] Date of Patent: Dec. 12, 1989

[54] LIGHT RECEIVING MEMBER HAVING A MULTILAYERED LIGHT RECEIVING LAYER COMPOSED OF A LOWER LAYER MADE OF ALUMINUM-CONTAINING INORGANIC MATERIAL AND AN UPPER LAYER MADE OF NON-SINGLE-CRYSTAL SILICON MATERIAL

[75] Inventors: Tatsuyuki Aoike; Masafumi Sano; Takehito Yoshino; Toshimitsu Kariya; Hiroaki Niino, all of Nagahama, Japan

[73] Assignee: Canon Kabushiki Kaisha, Tokyo, Japan

[21] Appl. No.: 182,156

[22] Filed: Apr. 15, 1988

[30] Foreign Application Priority Data

| | | | |
|---|---|---|---|
| Apr. 21, 1987 | [JP] | Japan | 62-98272 |
| Apr. 25, 1987 | [JP] | Japan | 62-102451 |
| May 6, 1987 | [JP] | Japan | 62-111621 |
| May 7, 1987 | [JP] | Japan | 112162 |
| Jun. 29, 1987 | [JP] | Japan | 62-161537 |
| Aug. 5, 1987 | [JP] | Japan | 62-196565 |
| Aug. 6, 1987 | [JP] | Japan | 62-197828 |
| Dec. 15, 1987 | [JP] | Japan | 62-315095 |

[51] Int. Cl.[4] ..... G03G 5/082; G03G 5/14

[52] U.S. Cl. ..... 430/65; 430/57; 430/60

[58] Field of Search ..... 430/57, 60, 65

[56] References Cited

U.S. PATENT DOCUMENTS 4,460,670 7/1984 Ogawa et al. ..... 430/57

FOREIGN PATENT DOCUMENTS 59-28162 2/1984 Japan ..... 430/60

*Primary Examiner*—Roland E. Martin

*Attorney, Agent, or Firm*—Fitzpatrick, Cella, Harper & Scinto

[57] ABSTRACT

There is provided an improved light receiving member for electrophotography which is made up of an aluminum support and a multilayered light receiving layer exhibiting photoconductivity formed on said aluminum support, wherein said multilayered light receiving layer consists of a lower layer in contact with said support and an upper layer, said lower layer being made of an inorganic material containing at least aluminum atoms (Al), silicon atoms (Si), and hydrogen atoms (H), and having a part in which said aluminum atoms (Al), silicon atoms (Si), and hydrogen atoms (H) are unevenly distributed across the layer thickness, said upper layer being made of a non-single material composed of silicon atoms (Si) as the matrix and at least either of hydrogen atoms (H) or halogen atoms (X). The light receiving member for electrophotography exhibits outstanding electric characteristics, optical characteristics, photoconductive characteristics, durability, image characteristics, and adaptability to use environments.

26 Claims, 16 Drawing Sheets

LIGHT RECEIVING MEMBER HAVING A MULTILAYERED LIGHT RECEIVING LAYER COMPOSED OF A LOWER LAYER MADE OF ALUMINUM-CONTAINING INORGANIC MATERIAL AND AN UPPER LAYER MADE OF NON-SINGLE-CRYSTAL SILICON MATERIAL

FIELD OF THE INVENTION

This invention concerns a light receiving member sensitive to electromagnetic waves such as light (which herein means in a broader sense those lights such as ultraviolet rays, visible rays, infrared rays, X-rays, and γ-rays).

More particularly, it relates to an improved light receiving member having a multilayered light receiving layer composed of a lower layer made of an inorganic material containing at least aluminum atoms, silicon atoms, and hydrogen atoms, and an upper layer made of non-single-crystal silicon material, which is suitable particularly for use in which coherent light such as laser beams are applied.

BACKGROUND OF THE INVENTION

The light receiving member used for image formation has a light receiving layer made of a photoconductive material. This material is required to have characteristic properties such as high sensitivity, high S/N ratio [ratio of light current (Ip) to dark current (Id)], absorption spectral characteristic matching the spectral characteristic of electromagnetic wave for irradiation, rapid optical response, appropriate dark resistance, and non-toxicity to the human body at the time of use. The non-toxicity at the time of use is an important requirement in the case of a light receiving member for electronic photography which is built into an electronic photographic apparatus used as an office machine.

A photoconductive material attracting attention at present from the standpoint mentioned above is amorphous silicon (A-Si for short hereinafter). The application of A-Si to the light receiving member for electrophotography is disclosed in, for example, German Laid-open Patent Nos. 2746967 and 2855718.

FIG. 2 is a schematic sectional view showing the layer structure of the conventional light receiving member for electrophotography. There are shown an aluminum support (201) and a photosensitive layer of A-Si (202). This type of light receiving member for electrophotography is usually produced by forming the photosensitive layer 202 of A-Si on the aluminum support 201 heated to 50~350° C., by deposition, hot CVD process, plasma CVD process, or sputtering.

Unfortunately, this light receiving member for electrophotography has a disadvantage that the sensitive layer 202 of A-Si is liable to crack or peel off during cooling subsequent to the film forming step, because the coefficient of thermal expansion of aluminum is nearly ten times as high as that of A-Si. To solve this problem, there was proposed a photosensitive body for electrophotography which is composed of an aluminum support, an intermediate layer containing at least aluminum, and a sensitive layer of A-Si. (Japanese Patent Laid-open No. 28162/1984) The intermediate layer containing at least aluminum relieves the stress arising from the difference in the coefficient of thermal expansion between the aluminum support and the A-Si sensitive layer, thereby reducing the cracking and peeling of the A-Si sensitive layer.

The conventional light receiving member for electrophotography which has the light receiving layer made of A-Si has been improved in electrical, optical, and photoconductive characteristics (such as dark resistance, photosensitivity, and light responsivity), adaptability of use environment, stability with time, and durability. Nevertheless, it still has room for further improvement in its overall performance.

For the improvement of image characteristics, several improvements have recently been made on the optical exposure unit, development unit, and transfer unit in the electrophotographic apparatus. This, in turn, has required the light receiving member for electrophotography to be improved further in image characteristics. With the improvement of images in resolving power, the users have begun to require further improvements such as the reduction of unevenness (so-called "coarse image") in the region where the image density delicately changes, and the reduction of image defects (so-called "dots") which appear in black or white spots, especially the reduction of very small "dots" which attracted no attention in the past.

Another disadvantage of the conventional light receiving member for electrophotography is its low mechanical strength. When it comes into contact with foreign matters which have entered the electrophotographic apparatus, or when it comes into contact with the main body or tools while the electrophotographic apparatus is being serviced for maintenance, image defects occur or the A-Si film peels off on account of the mechanical shocks and pressure. These aggravate the durability of the light receiving member for electrophotography.

An additional disadvantage of the conventional light receiving member for electrophotography is that the A-Si film is susceptible to cracking and peeling on account of the stress which occurs because the A-Si film differs from the aluminum support in the coefficient of thermal expansion. This leads to low yields in production.

Under the circumstances mentioned above, it is necessary to solve the above-mentioned problems and to improve the light receiving member for electrophotography from the standpoint of its structure as well as the characteristic properties of the A-Si material per se.

SUMMARY OF THE INVENTION

It is an object of the present invention to provide a light receiving member for electrophotography which meets the above-mentioned requirements and eliminates the above-mentioned disadvantages involved in the conventional light receiving member.

According to the present invention, the improved light receiving member for electrophotography is made up of an aluminum support and a multilayered light receiving layer exhibiting photoconductivity formed on said aluminum support, wherein said multilayered light receiving layer consists of a lower layer in contact with said support and an upper layer, said lower layer being made of an inorganic material containing at least aluminum atoms (Al), silicon atoms (Si), and hydrogen atoms (H) ("AlSiH" for short hereinafter), and having a part in which said aluminum atoms (Al), silicon atoms (Si), and hydrogen atoms (H) are unevenly distributed across the layer thickness, said upper layer being made of a non-single-crystal material composed of silicon atoms (Si) as the matrix and at least either of hydrogen atoms (H) or halogen atoms (X) ("Non-Si (H,X)" for short hereinafter).

The light receiving member for electrophotography in the present invention has the multilayered structure as mentioned above. Therefore, it is free from the above-mentioned disadvantages, and it exhibits outstanding electric characteristics, optical characteristics, photoconductive characteristics, durability, image characteristics, and adaptability to ambient environments.

As mentioned above, the lower layer is made such that the aluminum atoms and silicon atoms, and especially the hydrogen atoms, are unevenly distributed across the layer thickness. This structure improves the injection of electric charge (photocarrier) across the aluminum support and the upper layer. In addition, this structure joins the constituent elements of the aluminum support to the constituent elements of the upper layer gradually in terms of composition and constitution. This leads to the improvement of image characteristics relating to coarse image and dots. Therefore, the light receiving member permits the stable reproduction of images of high quality with a sharp half tone and a high resolving power.

The above-mentioned multilayered structure prevents the image defects and the peeling of the non-Si(H,X) film which occurs as the result of impactive mechanical pressure applied to the light receiving member for electrophotography. In addition, the multilayered structure relieves the stress arising from the difference between the aluminum support and the non-Si(H,X) film in the coefficient of thermal expansion and also prevents the occurrence of cracks and peeling in the non-Si(H,X) film. All this contributes to improved durability and increased yields in production.

According to the present invention, the lower layer of the light receiving member may further contain atoms to control the image ("atoms (Mc)" for short hereinafter). The incorporation of atoms (Mc) to control the image quality improves the injection of electric charge (photocarrier) across the aluminum support and the upper layer and also improves the transferability of electric charge (photocarrier) in the lower layer. Thus the light receiving member permits the stable reproduction of images of high quality with a sharp half tone and a high resolving power.

According to the present invention, the lower layer of the light receiving member may further contain atoms to control the durability ("atoms (CNOc)" for short hereinafter). The incorporation of atoms (CNOc) greatly improves the resistance to impactive mechanical pressure applied to the light receiving member for electrophotography. In addition, it prevents the image defects and the peeling of the non-Si(H,X) film, relieves the stress arising from the difference between the aluminum support and the non-Si(H,X) film in the coefficient of thermal expansion, and prevents the occurrence of cracks and peeling in the non-Si(H,X) film. All this contributes to improved durability and increased yields in production.

According to the present invention, the lower layer of the light receiving member may further contain halogen atoms (X). The incorporation of halogen atoms (X) compensates for the dangling bonds of silicon atoms (Si) and aluminum atoms (Al), thereby creating a stable state in terms of constitution and structure. This, coupled with the effect produced by the distribution of silicon atoms (Si), aluminum atoms (Al), and hydrogen atoms (H) mentioned above, greatly improves the image characteristics relating to coarse image and dots.

According to the present invention, the lower layer of the light receiving member may further contain at least either of germanium atoms (Ge) or tin atoms (Sn). The incorporation of at least either of germanium atoms (Ge) or tin atoms (Sn) improves the injection of electric charge (photocarrier) across the aluminum support and the upper layer, the adhesion of the lower layer to the aluminum support, and the transferability of electric charge (photocarrier) in the lower layer. This leads to a distinct improvement in image characteristics and durability.

According to the present invention, the lower layer of the light receiving member may further contain at least one kind of atoms selected from alkali metal atoms, alkaline earth metal atoms, and transition metal atoms ("atoms (Me)" for short hereinafter). The incorporation of at least one kind of atoms selected from alkali metal atoms, alkaline earth metal atoms, and transition metal atoms permits more dispersion of the hydrogen atoms or halogen atoms contained in the lower layer (the reason for this is not yet fully elucidated) and also reduces the structure relaxation of the lower layer which occurs with lapse of time. This leads to reduced liability of cracking and peeling even after use for a long period of time. The incorporation of at least one kind of the above-mentioned metal atoms improves the injection of electric charge (photocarrier) across the aluminum support and the upper layer, the adhesion of the lower layer to the aluminum support, and the transferability of electric charge (photocarrier) in the lower layer. This leads to a distinct improvement in image characteristics and durability, which in turn leads to the stable production and quality.

In the meantime, the above-mentioned Japanese Patent Laid-open No. 28162/1984 mentions the layer containing aluminum atoms and silicon atoms unevenly across the layer thickness and also mentions the layer containing hydrogen atoms. However, it does not mention how the layer contains hydrogen atoms. Therefore, it is distinctly different from the present invention.

DETAILED DESCRIPTION OF THE INVENTION

The light receiving member for electrophotography pertaining to the present invention will be described in more detail with reference to the drawings.

Figure 2:
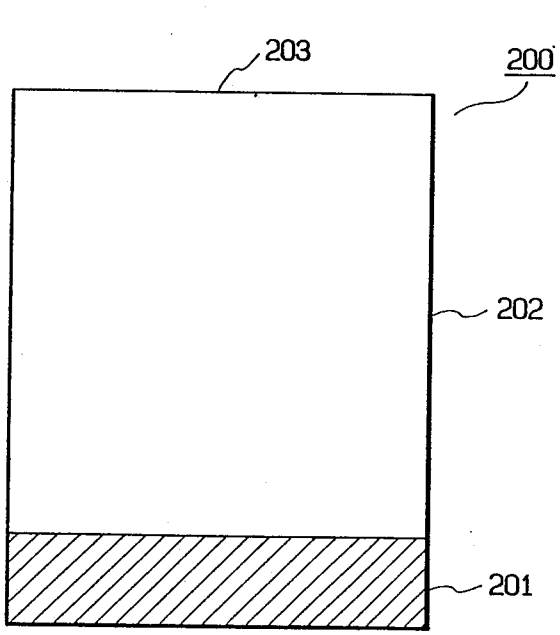
FIG. 2 is a schematic diagram illustrating the layer structure of the conventional light receiving member for electrophotography.
Figure 1:
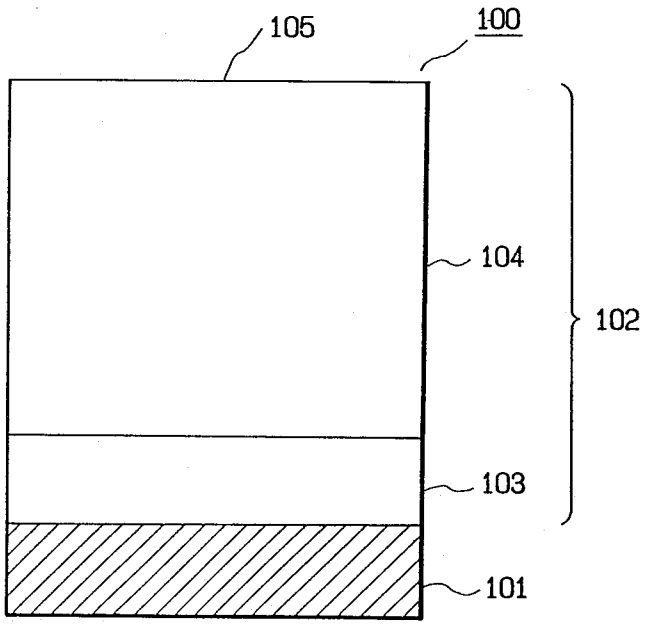
FIG. 1 is a schematic diagram illustrating the layer structure of the light receiving member for electrophotography.

FIG. 1 is a schematic diagram showing a typical example of the layer structure suitable for the light receiving member for electrophotography pertaining to the present invention.

The light receiving member 100 for electrophotography as shown in FIG. 1 is made up the aluminum support 101 and the light receiving layer 102 of layered structure. The light receiving layer 102 is made up of the lower layer 103 of AlSiH and the upper layer 104 of non-Si(H,X). The lower layer 103 has a part in which the above-mentioned aluminum atoms and silicon atoms are unevenly distributed across the layer thickness.

Support

The aluminum support 101 used in the present invention is made of an aluminum alloy. The aluminum alloy is not specifically limited in base metal and alloy components. The kind and composition of the components may be selected as desired. Therefore, the aluminum alloy used in the present invention may be selected from pure aluminum, Al-Cu alloy, Al-Mn alloy, Al-Si ally, Al-Mg alloy, Al-Mg-Si alloy, Al-Zn-Mg alloy, Al-Cu-Mg alloy (duralumin and super duralumin), Al-Cu-Si alloy (lautal), Al-Cu-Ni-Mg alloy (Y-alloy and RR alloy), and aluminum powder sintered body (SAP) which are standardized or registered as a malleable material, castable material, or die casting material in the Japanese Industrial Standards (JIS), AA Standards, BS Standards, DIN Standards, and International Alloy Registration.

The composition of the aluminum alloy used in the invention is exemplified in the following. The scope of the invention is not restricted to the examples.

Pure aluminum conforming to JIS-1100 which is composed of less than 1.0 wt% of Si and Fe, 0.05~0.20 wt% of Cu, less than 0.05 wt% of Mn, less than 0.10 wt% of Zn, and more than 99.00 wt% of Al.

Al-Cu-Mg alloy conforming to JIS-2017 which is composed of 0.05~0.20 wt% of Si, less than 0.7 wt% of Fe, 3.5~4.5 wt% of Cu, 0.40~1.0 wt% of Mn, 0.40~0.8 wt% of Mg, less than 0.25 wt% of Zn, and less than 0.10 wt% of Cr, with the remainder being Al.

Al-Mn alloy conforming to JIS-3003 which is composed of less than 0.6 wt% of Si, less than 0.7 wt% of Fe, 0.05~0.20 wt% of Cu, 1.0~1.5 wt% of Mn, and less than 0.10 wt% of Zn, with the remainder being Al.

Al-Si alloy conforming to JIS-4032 which is composed of 11.0~13.5 wt% of Si, less than 1.0 wt% of Fe, 0.50~1.3 wt% of Cu, 0.8~1.3 wt% of Mg, less than 0.25 wt% of Zn, less than 0.10 wt% of Cr, and 0.5~1.3 wt% of Ni, with the remainder being Al.

Al-Mg alloy conforming to JIS-5086 which is composed of less than 0.40 wt% of Si, less than 0.50 wt% of Fe, less than 0.10 wt% of Cu, 0.20~0.7 wt% of Mn, 3.5~4.5 wt% of Mg, less than 0.25 wt% of Zn, 0.05~0.25 wt% of Cr, and less than 0.15 wt% of Ti, with the remainder being Al.

An alloy composed of less than 0.50 wt% of Si, less than 0.25 wt% of Fe, 0.04~0.20 wt% of Cu, 0.01~1.0 wt% of Mn, 0.5~10 wt% of Mg, 0.03~0.25 wt% of Zn, 0.05~0.50 wt% of Cr, 0.05~0.20 wt% of Ti or Tr, and less than 1.0 cc of $H_2$ per 100 g of Al, with the remainder being Al.

An alloy composed of less than 0.12 wt% of Si, less than 0.15 wt% of Fe, less than 0.30 wt% of Mn, 0.5~5.5 wt% of Mg, 0.01~1.0 wt% of Zn, less than 0.20 wt% of Cr, and 0.01~0.25 wt% of Zr, with the remainder being Al.

Al-Mg-Si alloy conforming to JIS-6063 which is composed of 0.20~0.6 wt% of Si, less than 0.35 wt% of Fe, less than 0.10 wt% of Cu, less than 0.10 wt% of Mn, 0.45~0.9 wt% of MgO, less than 0.10 wt% of Zn, less than 0.10 wt% of Cr, and less than 0.10 wt% of Ti, with the remainder being Al.

Al-Zn-Mg alloy conforming to JIS-7N01 which is composed of less than 0.30 wt% of Si, less than 0.35 wt% of Fe, less than 0.20 wt% of Cu, 0.20~0.7 wt% of Mn, 1.0~2.0 wt% of Mg, 4.0~5.0 wt% of Zn, less than 0.30 wt% of Cr, less than 0.20 wt% of Ti, less than 0.25 wt% of Zr, and less than 0.10 wt% of V, with the remainder being Al.

In this invention, an aluminum alloy of proper composition should be selected in consideration of mechanical strength, corrosion resistance, workability, heat resistance, and dimensional accuracy which are required according to specific uses. For example, where precision working with mirror finish is required, an aluminum alloy containing magnesium and/or copper is desirable because of its free-cutting performance.

According to the present invention, the aluminum support 101 can be in the form of cylinder or flat endless belt with a smooth or irregular surface. The thickness of the support should be properly determined so that the light receiving member for electrophotography can be formed as desired. In the case where the light receiving member for electrophotography is required to be flexible, it can be made as thin as possible within limits not harmful to the performance of the support. Usually the thickness should be greater than 10 μm for the convenience of production and handling and for the reason of mechanical strength.

In the case where the image recording is accomplished by the aid of coherent light such as laser light, the aluminum support may be provided with an irregular surface to eliminate defective images caused by interference fringes.

The irregular surface on the support may be produced by any known method disclosed in Japanese Patent Laid-open Nos. 168156/1985, 178457/1985, and 225854/1985.

The support may also be provided with an irregular surface composed of a plurality of spherical dents in order to eliminate defective images caused by interference fringes which occur when coherent light such as laser light is used.

In this case, the surface of the support has irregularities smaller than the resolving power required for the light receiving member for electrophotography, and the irregularities are composed of a plurality of dents.

The irregularities composed of a plurality of spherical dents can be formed on the surface of the support according to the known method disclosed in Japanese Patent Laid-open No. 231561/1986.

Lower layer

According to the present invention, the lower layer is made of an inorganic material which is composed of at least aluminum atoms (Al), silicon atoms (Si), and hydrogen atoms (H). It may further contain atoms (Mc) to control image quality, atoms (CNOc) to control durability, halogen atoms (X), germanium atoms (Ge), and/or tin atoms (Sn), and at least one kind of atoms (Me) selected from the group consisting of alkali metal atoms, alkaline earth metal atoms, and transition metal atoms.

The lower layer contains aluminum atoms (Al), silicon atoms (Si), and hydrogen atoms (H) which are distributed evenly throughout the layer; but it has a part in which their distribution is uneven across the layer thickness. Their distribution should be uniform in a plane parallel to the surface of the support so that uniform characteristics are ensured in the same plane.

According to a preferred embodiment, the lower layer contains aluminum atoms (Al), silicon atoms (Si), and hydrogen atoms (H) which are distributed evenly and continuously throughout the layer, with the aluminum atoms (Al) being distributed such that their concentration gradually decreases across the layer thickness toward the upper layer from the support, with the silicon atoms (Si) and hydrogen atoms (H) being distributed such that their concentration gradually increases across the layer thickness toward the upper layer from the support. This distribution of atoms makes the aluminum support and the lower layer compatible with each other and also makes the lower layer and the upper layer compatible with each other.

According to the present invention, the light receiving member for electrophotography is characterized in that the lower layer contains aluminum atoms (Al), silicon atoms (Si), and hydrogen atoms (H) which are specifically distributed across the layer thickness as mentioned above but are evenly distributed in the plane parallel to the surface of the support.

The lower layer may further contain atoms (Mc) to control image quality, atoms (CNOc) to control durability, halogen atoms (X), germanium atoms (Ge), and/or tin atoms (Sn), and at least one kind of atoms (Me) selected from the group consisting of alkali metal atoms, alkaline earth metal atoms, and transition metal atoms, which are evenly distributed throughout the entire layer or unevenly distributed across the layer thickness in a specific part. In either cases, their distribution should be uniform in a plane parallel to the surface of the support so that uniform characteristics are ensured in the same plane.

FIGS. 3 to 8 show the typical examples of the distribution of aluminum atoms (Al) and optionally added atoms in the lower layer of the light receiving member for electrophotography in the present invention. (The aluminum atoms (Al) and the optionally added atoms are collectively referred to as "atoms (AM)" hereinafter.)

In FIGS. 3 to 8, the abscissa represents the concentration (C) of atoms (AM) and the ordinate represents the thickness of the lower layer. (The aluminum atoms (Al) and the optionally added atoms may be the same or different in their distribution across the layer thickness.)

The ordinate represents the thickness of the lower layer, with $t_B$ representing the position of the end (adjacent to the support) of the lower layer, with $t_T$ representing the position of the end (adjacent to the upper layer) of the lower layer. In other words, the lower layer containing atoms (AM) is formed from the $t_B$ side toward the $t_T$ side.

Figure 3:
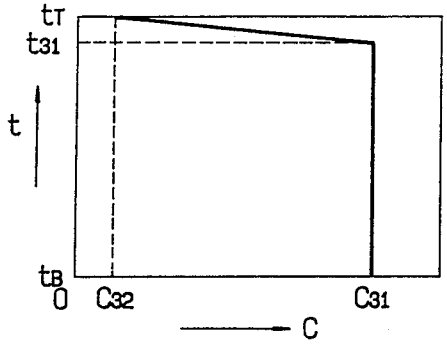
FIGS. 3 to 8 are diagrams illustrating the distribution of aluminum atoms (Al) contained in the lower layer, and also illustrating the distribution of atoms (Mc) to control image quality, and/or atoms (CNOc) to control durability, and/or halogen atoms (X), and/or germanium atoms (Ge), and/or tin atoms (Sn), and/or at least one kind of atoms selected from alkali metal atoms, alkaline earth metal atoms, and transition metal atoms, which are optionally contained in the lower layer.

FIG. 3 shows a first typical example of the distribution of atoms (AM) across layer thickness in the lower layer. The distribution shown in FIG. 3 is such that the concentration (C) of atoms (AM) remains constant at $C_{31}$ between position $t_B$ and position $t_{31}$ and linearly decreases from $C_{31}$ to $C_{32}$ between position $t_{31}$ and position $t_T$.

Figure 4:
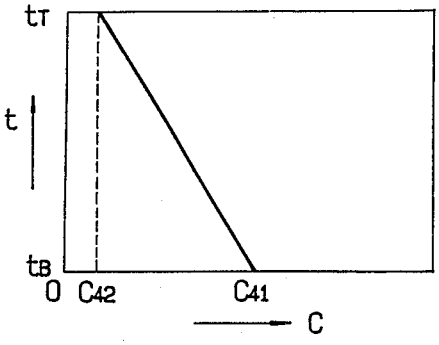

The distribution shown in FIG. 4 is such that the concentration (C) of atoms (AM) linearly decreases from $C_{41}$ to $C_{42}$ between position $t_B$ and position $t_T$.

Figure 5:
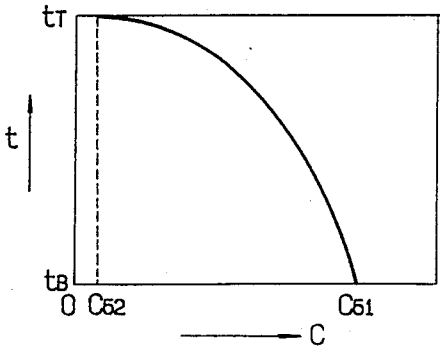

The distribution shown in FIG. 5 is such that the concentration (C) of atoms (AM) gradually and continuously decreases from $C_{51}$ to $C_{52}$ between position $t_B$ and position $t_T$.

Figure 6:
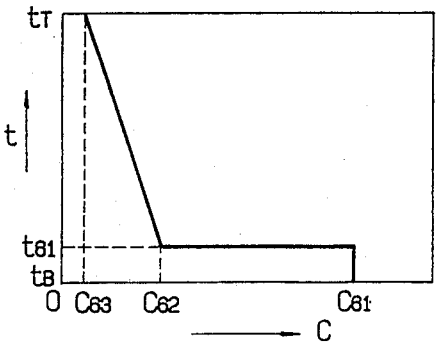

The distribution shown in FIG. 6 is such that the concentration (C) of atoms (AM) remains constant at $C_{61}$ between position $t_B$ and position $t_{61}$ and linearly decreases from $C_{62}$ to $C_{63}$ between position $t_{61}$ and position $t_T$.

Figure 7:
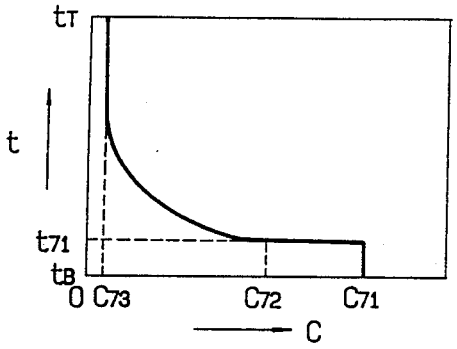

The distribution shown in FIG. 7 is such that the concentration (C) of atoms (AM) remains constant at $C_{71}$ between position $t_B$ and position $t_{71}$ and decreases gradually and continuously from $C_{72}$ to $C_{73}$ between position $t_{71}$ and position $t_T$.

Figure 8:
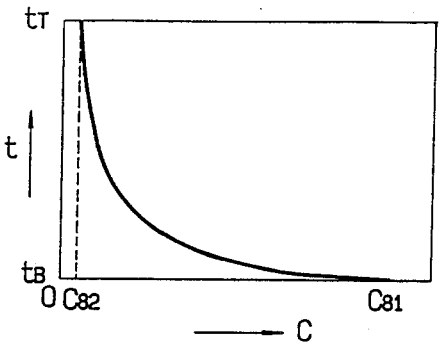

The distribution shown in FIG. 8 is such that the concentration (C) of atoms (AM) decreases gradually and continuously from $C_{81}$ to $C_{82}$ between position $t_B$ and position $t_T$.

The atoms (AM) in the lower layer are distributed across the layer thickness as shown in FIGS. 3 to 8 with reference to several typical examples. In a preferred embodiment, the lower layer contains silicon atoms (Si) and hydrogen atoms (H) and atoms (AM) in a concentration of C in the part adjacent to the support, and also contains atoms (AM) in a much lower concentration at the interface $t_T$. In such a case, the distribution across the layer thickness should be made such that the maximum concentration $C_{max}$ is 10 atom% or above, preferably 30 atom% or above, and most desirably 50 atom% or above.

According to the present invention, the amount of atoms (AM) in the lower layer should be properly established so that the object of the invention is effectively achieved. It is 5~95 atom%, preferably 10~90 atom%, and most desirably 20~80 atom%.

FIGS. 9 to 16 show the typical examples of the across-the-layer-thickness distribution of silicon atoms (Si), hydrogen atoms (H), and the above-mentioned optional atoms contained in the lower layer of the light receiving member for electrophotography in the present invention.

In FIGS. 9 to 16, the abscissa represents the concentration (C) of silicon atoms (Si), hydrogen atoms (H), and optionally contained atoms and the ordinate represents the thickness of the lower layer. (The silicon atoms (Si), hydrogen atoms (H), and optionally contained atoms will be collectively referred to as "atoms (SHM)" hereinafter.) The silicon atoms (Si), hydrogen atoms (H), and optionally contained atoms may be the same or different in their distribution across the layer thickness. $t_B$ on the ordinate represents the end of the lower layer adjacent to the support and $t_T$ on the ordinate represents the end of the lower layer adjacent to the upper layer. In other words, the lower layer containing atoms (SHM) is formed from the $t_B$ side toward the $t_T$ side.

Figure 9:
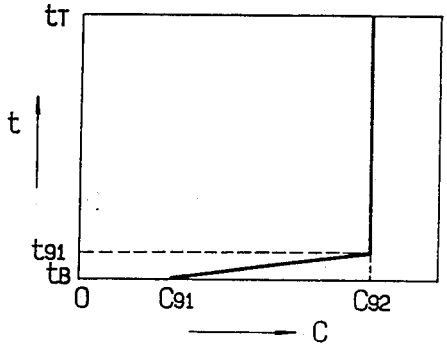
FIGS. 9 to 16 are diagrams illustrating the distribution of silicon atoms (Si) and hydrogen atoms (H) contained in the lower layer, and also illustrating the distribution of atoms (Mc) to control image quality, and/or atoms (CNOc) to control durability, and/or halogen atoms (X), and/or germanium atoms (Ge), and/or tin atoms (Sn), and/or at least one kind of atoms selected from alkali metal atoms, alkaline earth metal atoms, and transition metal atoms, which are optionally contained in the lower layer.

FIG. 9 shows a first typical example of the distribution of atoms (SHM) across the layer thickness in the lower layer. The distribution shown in FIG. 9 is such that the concentration (C) of atoms (SHM) linearly increases from $C_{91}$ to $C_{92}$ between position $t_B$ and position $t_{91}$ and remains constant at $C_{92}$ between position $t_{91}$ and position $t_T$.

Figure 10:
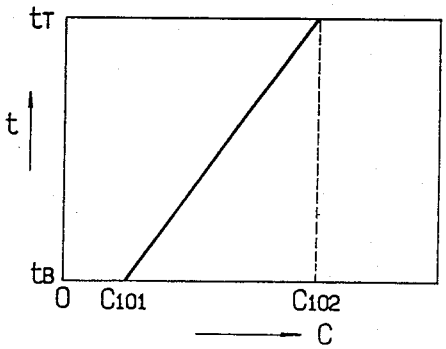

The distribution shown in FIG. 10 is such that the concentration (C) of atoms (SHM) linearly increases from $C_{101}$ to $C_{102}$ between position $t_B$ and position $t_B$.

Figure 11:
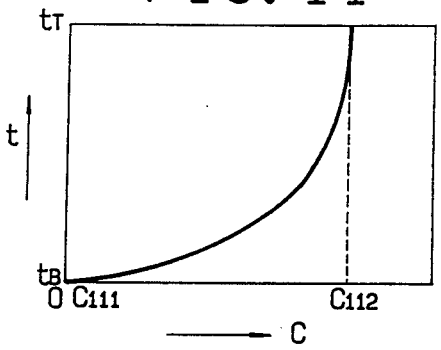

The distribution shown in FIG. 11 is such that the concentration (C) of atoms (SHM) gradually and continuously increases from $C_{111}$ to $C_{112}$ between position $t_B$ and position $t_T$.

Figure 12:
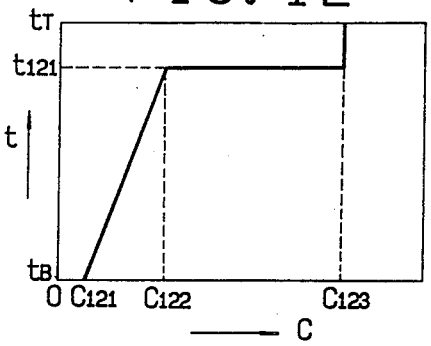

The distribution shown in FIG. 12 is such that the concentration (C) of atoms (SHM) linearly increases from $C_{121}$ to $C_{122}$ between position $t_B$ and position $t_{121}$ and remains constant at $C_{123}$ between position $t_{121}$ and position $t_T$.

Figure 13:
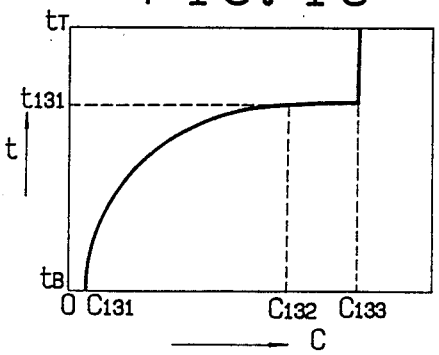

The distribution shown in FIG. 13 is such that the concentration (C) of atoms (SHM) gradually and continuously increases from $C_{131}$ to $C_{132}$ between position $t_B$ and position $t_{131}$ and remains constant at $C_{133}$ between position $t_{131}$ and position $t_T$.

Figure 14:
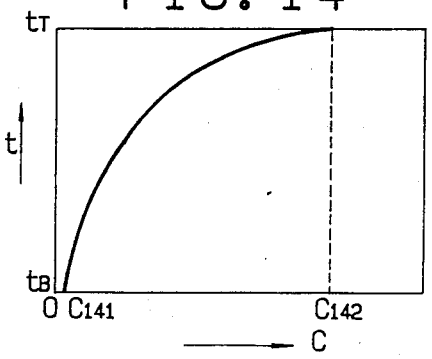

The distribution shown in FIG. 14 is such that the concentration (C) of atoms (SHM) gradually and continuously increases from $C_{141}$ to $C_{142}$ between position $t_B$ and position $t_T$.

Figure 15:
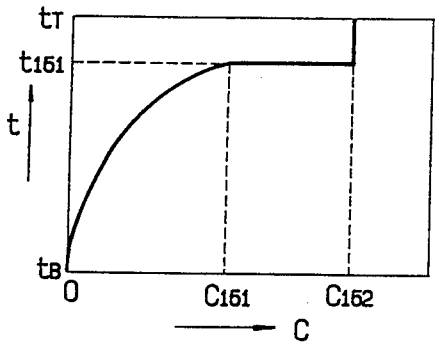

The distribution shown in FIG. 15 is such that the concentration (C) of atoms (SHM) gradually increases from substantially zero to $C_{151}$ between position $t_B$ and position $t_{151}$ and remains constant at $C_{152}$ between position $t_{151}$ and position $t_T$. ("Substantially zero" means that the amount is lower than the detection limit. The same shall apply hereinafter.)

Figure 16:
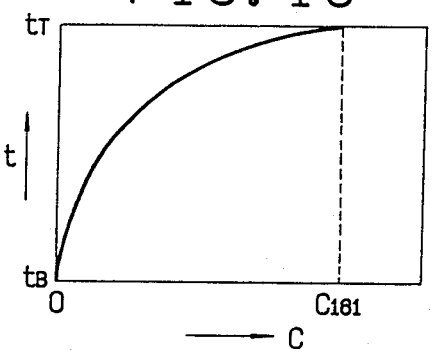

The distribution shown in FIG. 16 is such that the concentration (C) of atoms (SHM) gradually increases from substantially zero to $C_{161}$ between position $t_B$ and position $t_T$.

The silicon atoms (Si) and hydrogen atoms (H) in the lower layer are distributed across the layer thickness as shown in FIGS. 9 to 16 with reference to several typical examples. In a preferred embodiment, the lower layer contains aluminum atoms (Al) and silicon atoms (Si) and hydrogen atoms (H) in a low concentration of C in the part adjacent to the support, and also contains silicon atoms (Si) and hydrogen atoms (H) in a much higher concentration at the interface $t_T$. In such a case, the distribution across the layer thickness should be made such that the maximum concentration $C_{max}$ of the total of silicon atoms (Si) and hydrogen atoms (H) is 10 atom% or above, preferably 30 atom% or above, and most desirably 50 atom% or above.

According to the present invention, the amount of silicon atoms (Si) in the lower layer should be properly established so that the object of the invention is effectively achieved. It is 5~95 atom%, preferably 10~90 atom%, and most desirably 20~80 atom%.

According to the present invention, the amount of hydrogen atoms (H) in the lower layer should be properly established so that the object of the invention is effectively achieved. It is 0.01~70 atom%, preferably 0.1~50 atom%, and most desirably 1~40 atom%.

The above-mentioned atoms (Mc) optionally contained to control image quality are selected from atoms belonging to Group III of the periodic table, except aluminum atoms (Al) ("Group III atoms" for short hereinafter), atoms belonging to Group V of the periodic table, except nitrogen atoms (N) ("Group V atoms" for short hereinafter), and atoms belonging to Group VI of the periodic table, except oxygen atoms (O) ("Group VI atoms" for short hereinafter).

Examples of Group III atoms include B (boron), Ga (gallium), In (indium), and Tl (thallium), with B and Ga being preferable. Examples of Group V atoms include P (phosphorus), As (arsenic), Sb (antimony), and Bi (bismuth), with P and As being preferable. Examples of Group VI atoms include S (sulfur), Se (selenium), Te (tellurium), and Po (polonium), with S and Se being preferable.

According to the present invention, the lower layer may contain atoms (Mc) to control image quality, which are Group III atoms, Group V atoms, or Group VI atoms. The atoms (Mc) improve the injection of electric charge across the aluminum support and the upper layer and/or improve the transferability of electric charge in the lower layer. They also control the conduction type and/or conductivity in the region of the lower layer which contains a less amount of aluminum atoms (Al).

In the lower layer, the content of atoms (Mc) to control image quality should be $1\times10^{-3}\sim5\times10^{4}$ atom-ppm, preferably $1\times10^{-2}\sim5\times10^{4}$ atom-ppm, and most desirably $1\times10^{-2}\sim5\times10^{3}$ atom-ppm.

The above-mentioned atoms (NCOc) optionally contained to control durability are selected from carbon atoms (C), nitrogen atoms (N), and oxygen atoms (0). When contained in the lower layer, carbon atoms (C), and/or nitrogen atoms (N), and/or oxygen atoms (0) as the atoms (CNOc) to control durability improve the injection of electric charge across the aluminum support and the upper layer and/or improve the transferability of electric charge in the lower layer and/or improve the adhesion of the lower layer to the aluminum support. They also control the width of the forbidden band in the region of the lower layer which contains a less amount of aluminum atoms (Al).

In the lower layer, the content of atoms (NCOc) to control durability should be $1\times10^3\sim5\times10^5$ atom-ppm, preferably $5\times10^1\sim4\times10^5$ atom-ppm, and most desirably $1\times10^2\sim3\times10^3$ atom-ppm.

The above-mentioned halogen atoms (X) optionally contained in the lower layer are selected from fluorine atoms (F), chlorine atoms (Cl), bromine atoms (Br), and iodine atoms (I). When contained in the lower layer, fluorine atoms (F), and/or chlorine atoms (Cl), and/or bromine atoms (Br), and/or iodine atoms (I) as the halogen atoms (V) compensate for the unbonded hands of silicon atoms (Si) and aluminum atoms (Al) contained mainly in the lower layer and make the lower layer stable in terms of composition and structure, thereby improving the quality of the layer.

The content of halogen atoms (X) in the lower layer should be properly established so that the object of the invention is effectively achieved. It is $1\sim4\times10^5$ atom-ppm, preferably $10\sim3\times10^5$ atom-ppm, and most desirably $1\times10^2\sim2\times10^5$ atom-ppm.

According to the present invention, the lower layer may optionally contain germanium atoms (Ge) and/or tin atoms (Sn). They improve the injection of electric charge across the aluminum support and the upper layer and/or improve the transferability of electric charge in the lower layer and/or improve the adhesion of the lower layer to the aluminum support. They also narrow the width of the forbidden band in the region of the lower layer which contains a less amount of aluminum atoms (Al). These effects suppress interference which occurs when a light of long wavelength such as semiconductor laser is used as the light source for image exposure in the electrophotographic apparatus.

The content of germanium atoms (Ge) and/or tin atoms (Sn) in the lower layer should be properly established so that the object of the invention is effectively achieved. It is $1\sim9\times10^5$ atom-ppm, preferably $1\times10^2\sim8\times10^5$ atom-ppm, and most desirably $5\times10^2\sim7\times10^5$ atom-ppm.

According to the present invention, the lower layer may optionally contain, as the alkali metal atoms and/or alkaline earth metal atoms and/or transition metal atoms, magnesium atoms (Mg) and/or copper atoms (Cu) and/or sodium atoms (Na) and/or yttrium atoms (Y) and/or manganese atoms (Mn) and/or zinc atoms (Zn). They disperse hydrogen atoms (H) and halogen atoms (X) uniformly in the lower layer and prevent the cohesion of hydrogen which is considered to cause cracking and peeling. They also improve the injection of electric charge across the aluminum support and the upper layer and/or improve the transferability of electric charge in the lower layer and/or improve the adhesion of the lower layer to the aluminum support.

The content of the above-mentioned metals in the lower layer should be properly established so that the object of the invention is effectively achieved. It is $1\sim2\times10^5$ atom-ppm, preferably $1\times10^2\sim1\times10^5$ atom-ppm, and most desirably $5\times10^2\sim5\times10^4$ atom-ppm.

According to the present invention, the lower layer composed of AlSiH is formed by the vacuum deposition film forming method, as in the upper layer which will be mentioned later, under proper conditions for the desired characteristic properties. The thin film is formed by one of the following various methods. Glow discharge method (including ac current discharge CVD, e.g., low-frequency CVD, high-frequency CVD, and microwave CVD, and dc current CVD), ECR-CVD method, sputtering method, vacuum metallizing method, ion plating method, light CVD method, "HRCVD" method (explained below), "FOCVD" method (explained below). (According to HRCVD method, an active substance (A) formed by the decomposition of a raw material gas and the other active substance (B) formed from a substance reactive to the first active substance are caused to react with each other in a space where the film formation is accomplished. According to FOCVD method, a raw material gas and a halogen-derived gas capable of oxidizing said raw material gas are caused to react in a space where the film formation is accomplished.) A proper method should be selected according to the manufacturing conditions, the capital available, the production scale, and the characteristic properties required for the light receiving member for electrophotography. Preferable among these methods are ion plating method, HRCVD method, and FOCVD method on account of their ability to control the production conditions and to introduce aluminum atoms (Al), silicon atoms (Si), and hydrogen atoms (H) with ease. These methods may be used in combination with one another in the same apparatus.

The glow discharge method may be performed in the following manner to form the lower layer of AlSiH. The raw material gases are introduced into an evacuatable deposition chamber, and glow discharge is performed, with the gases kept at a desired pressure, so that a layer of AlSiH is formed as required on the surface of the support placed in the chamber. The raw material gases may contain a gas to supply aluminum atoms (Al), a gas to supply silicon atoms (Si), a gas to supply hydrogen atoms (H), an optional gas to supply atoms (Mc) to control image quality, an optional gas to supply atoms (CNOc) to control durability, an optional gas to supply halogen atoms (X), an optional gas to supply atoms (GSc) (germanium atoms (Ge) and tin atoms (Sn)), and an optional gas to supply atoms (Me) (at least one kind of alkali metal atoms, alkaline earth metal atoms, and transition metal atoms).

The HRCVD method may be performed in the following manner to form the lower layer of AlSiH. The raw material gases are introduced all together or individually into an evacuatable deposition chamber, and glow discharge is performed or the gases are heated, with the gases kept at a desired pressure, during which a first active substance (A) is formed and a second active substance (B) is introduced into the deposition chamber, so that a layer of AlSiH is formed as required on the surface of the support placed in the chamber. The raw material gases may contain a gas to supply aluminum atoms (Al), a gas to supply silicon atoms (Si), an optional gas to supply atoms (Mc) to control image quality, an optional gas to supply atoms (CNOc) to control durability, an optional gas to supply halogen atoms (X), an optional gas to supply atoms (GSc) (germanium atoms (Ge) and tin atoms (Sn)), and an optional gas to supply atoms (Me) (at least one kind of alkali metal atoms, alkaline earth metal atoms, and transition metal atoms). A second active substance (B) is formed by introducing a gas to supply hydrogen into the activation chamber. Said first active substance (A) and said second active substance are individually introduced into the deposition chamber.

The FOCVD method may be performed in the following manner to form the lower layer of AlSiH. The raw material gases are introduced into an evacuatable deposition chamber, and chemical reactions are performed, with the gases kept at a desired pressure, so that a layer of AlSiH is formed as required on the surface of the support placed in the chamber. The raw material gases may contain a gas to supply aluminum atoms (Al), a gas to supply silicon atoms (Si), a gas to supply hydrogen atoms (H), an optional gas to supply atoms (Mc) to control image quality, an optional gas to supply atoms (CNOc) to control durability, an optional gas to supply halogen atoms (X), an optional gas to supply atoms (GSc) (germanium atoms (Ge) and tin atoms (Sn)), and an optional gas to supply atoms (Me) (at least one kind of alkali metal atoms, alkaline earth metal atoms, and transition metal atoms). They may be introduced into the chamber altogether or individually, and a halogen (X) gas is introduced into the chamber separately from said raw materials gas, and these gases are subjected to chemical reaction in the deposition chamber.

The sputtering method may be performed in the following manner to form the lower layer of AlSiH. The raw material gases are introduced into a sputtering deposition chamber, and a desired gas plasma environment is formed using an aluminum target and an Si target in an inert gas of Ar or He or an Ar- or He-containing gas. The raw material gases may contain a gas to supply hydrogen atoms (H), an optional gas to supply atoms (Mc) to control image quality, an optional gas to supply atoms (CNOc) to control durability, an optional gas to supply halogen atoms (X), an optional gas to supply atoms (GSc) (germanium atoms (Ge) and tin atoms (Sn)), and an optional gas to supply atoms (Me) (at least one kind of alkali metal atoms, alkaline earth metal atoms, and transition metal atoms). If necessary, a gas to supply aluminum atoms (Al) and/or a gas to supply silicon atoms (Si) are introduced into the sputtering chamber.

The ion plating method may be performed in the same manner as the sputtering method, except that vapors of aluminum and silicon are passed through the gas plasma environment. The vapors of aluminum and silicon are produced from aluminum and silicon polycrystal or single crystal placed in a boat which is heated by resistance or electron beams (EB method).

According to the present invention, the lower layer contains aluminum atoms (Al), silicon atoms (Si), hydrogen atoms (H), optional atoms (Mc) to control image quality, atoms (CNOc) to control durability, optional halogen atoms (X), optional germanium atoms (Ge), optional tin atoms (Sn), optional alkali metal atoms, optional alkaline earth metal atoms, and optional transition metal atoms (collectively referred to as atoms (ASH) hereinafter), which are distributed in different concentrations across the layer thickness. The lower layer having such a depth profile can be formed by controlling the flow rate of the feed gas to supply atoms (ASH) according to the desired rate of change in concentration. The flow rate may be changed by operating the needle valve in the gas passage manually or by means of a motor, or by adjusting the mass flow controller manually or by means of a programmable control apparatus.

In the case where the sputtering method is used, the lower layer having such a depth profile can be formed, as in the glow discharge method, by controlling the flow rate of the feed gas to supply atoms (ASH) according to the desired rate of change in concentration. Alternatively, it is possible to use a sputtering target in which the mixing ratio of Al and Si is properly changed in the direction of layer thickness of the target.

According to the present invention, the gas to supply Al includes, for example, $AlCl_3$, $AlBr_3$, $AlI_3$, $Al(CH_3)_2Cl$, $Al(CH_3)_3$, $Al(OCH_3)_3$, $Al(C_2H_5)_3$, $Al(OC_2H_5)_3$, $Al(i\text{-}C_4H_9)_3$, $Al(i\text{-}C_3H_7)_3$, $Al(C_3H_7)_3$, and $Al(OC_4H_9)_3$. These gases to supply Al may be diluted with an inert gas such as $H_2$, He, Ar, and Ne, if necessary.

According to the present invention, the gas to supply Si includes, for example, gaseous or gasifiable silicohydrides (silanes) such as $SiH_4$, $Si_2H_6$, $Si_3H_8$, and $Si_4H_{10}$. $SiH_4$ and $Si_2H_6$ are preferable from the standpoint of ease of handling and the efficient supply of Si. These gases to supply Si may be diluted with an inert gas such as $H_2$, He, Ar, and Ne, if necessary.

According to the present invention, the gas to supply H includes, for example, silicohydrides (silanes) such as $SiH_4$, $Si_2H_6$, $Si_3H_8$, and $Si_4H_{10}$.

The amount of hydrogen atoms contained in the lower layer may be controlled by regulating the flow rate of the feed gas to supply hydrogen and/or regulating the temperature of the support and/or regulating the electric power for discharge.

The lower layer may contain atoms (Mc) to control image quality, such as Group III atoms, Group V atoms, and Group VI atoms. This is accomplished by introducing into the deposition chamber the raw materials to form the lower layer together with a raw material to introduce Group III atoms, a raw material to introduce Group V atoms, or a raw material to introduce Group VI atoms. The raw material to introduce Group II atoms, the raw material to introduce Group V atoms, or the raw material to introduce Group VI atoms may be gaseous at normal temperature and under normal pressure or gasifiable under the layer forming conditions. The raw material to introduce Group III atoms, especially boron atoms, include, for example, boron hydrides such as $B_2H_6$, $B_5H_9$, $B_5H_{11}$, $B_6H_{10}$, $B_6H_{12}$, and $B_6H_{14}$, and boron halides such as $BF_3$, $BCl_3$, and $BBr_3$. Additional examples include $GaCl_3$, $Ga(CH_3)_3$, $InCl_3$, and $TlCl_3$.

The raw material to introduce Group V atoms, especially phosphorus atoms, include, for example, phosphorus hydrides such as $PH_3$ and $P_3H_4$, and phosphorus halides such as $PH_4I$, $PF_3$, $PF_5$, $PCl_3$, $PBr_3$, $PBr_5$, and $PI_3$. Other examples include $AsH_3$, $AsF_3$, $AsCl_3$, $AsBr_{,3}$, $AsF_5$, $SbH_3$, $SbF_3$, $SbF_5$, $SbCl_3$, $SbCl_5$, $BiH_3$, $BiCl_3$, and $BiBr_3$.

The raw material to introduce Group VI atoms includes, for example, gaseous or gasifiable substances such as $H_2S$, $SF_4$, $SF_6$, $SO_2$, $SO_2F_2$, COS, $CS_2$, $CH_3SH$, $C_2H_5SH$, $C_4H_4S$, $(CH_3)_2S$, and $S(C_2H_2)_2S$. Other examples include gaseous or gasifiable substances such as $SeH_2$, $SeF_6$, $(CH_3)_2Se$, $(C_2H_3Se$, $TeH_2$, $TeF_6$, $(CH_3)_2Te$, and $(C_2H_5)_2Te$.

These raw materials to introduce atoms (Mc) to control image quality may be diluted with an inert gas such as H2, He, Ar, and Ne.

According to the present invention, the lower layer may contain atoms (CNOc) to control durability, e.g., carbon atoms (C), nitrogen atom (N), and oxygen atoms (O). This is accomplished by introducing into the deposition chamber the raw materials to form the lower layer, together with a raw material to introduce carbon atoms (C), or a raw material to introduce nitrogen atoms (N), or a raw material to introduce oxygen atoms (O). Raw materials to introduce carbon atoms (C), nitrogen atoms (N), or oxygen atoms ()) may be in the gaseous form at normal temperature and under normal pressure or may be readily gasifiable under the layer forming conditions.

A raw material gas to introduce carbon atoms (C) includes saturated hydrocarbons having 1 to 4 carbon atoms, ethylene series hydrocarbons having 2 to 4 carbon atoms, and acetylene series hydrocarbons having 2 to 3 carbon atoms.

Examples of the saturated hydrocarbons include methane ($CH_4$), ethane ($C_2H_6$), propane ($C_3H_6$), n-butane (n-$C_4H_{10}$), and pentane ($C_5H_{12}$). Examples of the ethylene series hydrocarbons include ethylene ($C_2H_4$), propylene ($C_3H_6$), butene-1 ($C_4H_8$), butene-2 ($C_4H_8$), isobutylene ($C_4H_8$), and pentene ($C_5H_{10}$). Examples of the acetylene series hydrocarbons include acetylene ($C_2H_2$), methylacetylene ($C_3H_4$), and butyne ($C_4H_6$).

The raw material gas composed of Si, C, and H includes alkyl silicides such as $Si(CH_3)_4$ and $Si(C_2H_5)_4$.

Additional examples include halogenated hydrocarbons such as $CF_4$, $CCl_4$, and $CH_3CF_3$, which introduce carbon atoms (C) as well as halogen atoms (X).

Examples of the raw material gas to introduce nitrogen atoms (N) include nitrogen and gaseous or gasifiable nitrogen compounds (e.g., nitrides and azides) which are composed of nitrogen and hydrogen, such as ammonia ($NH_3$), hydrazine ($H_2NNH_2$), hydrogen azide ($HN_3$, and ammonium azide ($NH_4N_3$).

Additional examples include halogenated nitrogen compounds such as nitrogen trifluoride ($F_3N$) and nitrogen tetrafluoride ($F_4N_2$), which introduce nitrogen (N) atoms as well as halogen atoms (X).

Examples of the raw material gas to introduce oxygen atoms (O) include oxygen ($O_2$), ozone ($O_3$), nitrogen monoxide (NO), nitrogen dioxide ($NO_2$), dinitrogen oxide ($N_2O$), dinitrogen trioxide ($N_2O_3$), trinitrogen tetraoxide ($N_3O_4$), dinitrogen pentaoxide ($N_2O_5$, and nitrogen trioxide ($NO_3$). Additional examples include lower siloxanes such as disiloxane ($H_3SiOSiH_3$) and trisiloxane ($H_3SiOSiH_2OSiH_3$), which are composed of silicon atoms (Si), oxygen atoms (O), and hydrogen atoms (H).

Examples of the gas to supply halogen atoms include halogen gases and gaseous or gasifiable halides, interhalogen compounds, and halogen-substituted silane derivatives. Additional examples include gaseous or gasifiable halogen-containing silicohydrides composed of silicon atoms and halogen atoms.

The halogen compounds that can be suitably used in the present invention include halogen gases such as fluorine, chlorine, bromine, and iodine; and interhalogen compounds such as BrF, ClF, $ClF_3$, $BrF_5$, $BrF_3$, $IF_3$, $IF_7$, ICl, and IBr.

Examples of the halogen-containing silicon compounds, or halogen-substituted silane compounds, include silane ($SiH_4$). and halogenated silicon such as $Si_2F_6$, $SiCl_4$, and $SiBr_4$.

In the case where the halogen-containing silicon compound is used to form the light receiving member for electrophotography by the glow discharge method or HRCVD method, it is possible to form the lower layer composed of AlSiH containing halogen atoms on the support without using a silicohydride gas to supply silicon atoms.

In the case where the lower layer containing halogen atoms is formed by the glow discharge method or HRCVD method, a silicon halide gas is used to supply silicon atoms. The silicon halide gas may be mixed with hydrogen or a hydrogen-containing silicon compound gas to facilitate the introduction of hydrogen atoms at a desired level.

The above-mentioned gases may be used individually or in combination with one another at a desired mixing ratio.

The raw materials to form the lower layer which are used in addition to the above-mentioned halogen compounds or halogen-containing silicon compounds include gaseous or gasifiable hydrogen halides such as HF, HCl, HBr, and HI; and halogen-substituted silicohydrides such as $SiH_3F$, $SiH_2F_2$, $SiHF_3$, $SiH_2I_2$, $SiH_2Cl_2$ , $SIHCl_3$, $SiH_2Br_2$, and $SiHBr_3$. Among these substances, the hydrogen-containing halides are a preferred halogen-supply gas because they supply the lower layer with halogen atoms as well as hydrogen atoms which are very effective for the control of electric or photoelectric characteristics.

The introduction of hydrogen atoms into the lower layer may also be accomplished in another method by inducing discharge in the deposition chamber containing a silicohydride such as $SiH_4$, $Si_2H_6$, $Si_3H_8$, and $Si_4H_{10}$ and a silicon compound to supply silicon atoms (Si).

The amount of hydrogen atoms (H) and/or halogen atoms (X) to be introduced into the lower layer may be controlled by regulating the temperature of the support, the electric power for discharge, and the amount of raw materials for hydrogen atoms and halogen atoms to be introduced into the deposition chamber.

The lower layer may contain germanium atoms (Ge) or tin atoms (Sn). This is accomplished by introducing into the deposition chamber the raw materials to form the lower layer together with a raw material to introduce germanium atoms (Ge) or tin atoms (Sn) in a gaseous form. The raw material to supply germanium atoms (Ge) or the raw material to supply!tin atoms (Sn) may be gaseous at normal temperature and under normal pressure or gasifiable under the layer forming conditions.

The substance that can be used as a gas to supply germanium atoms (Ge) include gaseous or gasifiable germanium hydrides such as $GeH_4$, $Ge_2H_6$, $Ge_3H_8$, and $Ge_4H_{10}$. Among them, $GeH_4$, $Ge_2H_6$, and $Ge_3H_8$ are preferable from the standpoint of easy handling at the time of layer forming and the efficient supply of germanium atoms (Ge).

Other effective raw materials to form the lower layer include gaseous or gasifiable germanium hydride-halides such as $GeHF_3$, $GeH_2F_2$, $GeH_3F$, $GeHCl_3$, $GeH_2Cl_2$, $GeH_3Cl$, $GeHBr_3$, $GeH_2Br_2$, $GeH_3Br$, $GeHI_3$, $GeH_2I_2$, and $GeH_3I$, and germanium halides such as $GeF_4$, $GeCl_4$, $GeBr_4$, $GeI_4$, $GeF_2$, $GeCl_2$, $GeBr_2$, and $GeI_2$.

The substance that can be used as a gas to supply tin atoms (Sn) include gaseous or gasifiable tin hydrides such as $SnH_4$, $Sn_2H_6$, $Sn_3H_8$, and $Sn_4H_{10}$. Among them, $SnH_4$, $Sn_2H_6$, and $Sn_3H_8$ are preferable from the standpoint of easy handling at the time of layer forming and the efficient supply of tin atoms (Sn).

Other effective raw materials to form the lower layer include gaseous or gasifiable tin hydride-halides such as $SnHF_3$, $SnH_2F_2$, $SnH_3F$, $SnHCl_3$, $SnH_2Cl_2$, $SnH_3Cl$, $SnHBr_3$, $SnH_2Br_2$, $SnH_3Br$, $SnHI_3$, $SnH_2I_2$, and $SnH_3I$, and tin halides such as $SnF_4$, $SnCl_4$, $SnBr_4$, $SnI_4$, $SnF_2$, $SnCl_2$, $SnBr_2$, and $SnI_2$.

The gas to supply GSc may be diluted with an inert gas such as $H_2$, He, Ar, and Ne, if necessary.

The lower layer may contain magnesium atoms (Mg). This is accomplished by introducing into the deposition chamber the raw materials to form the lower layer together with a raw material to introduce magnesium atoms (Mg) in a gaseous form. The raw material to supply magnesium atoms (Mg) may be gaseous at normal temperature and under normal pressure or gasifiable under the layer forming conditions.

The substance that can be used as a gas to supply magnesium atoms (Mg) include organometallic compounds containing magnesium atoms (Mg). Bis(cyclopentadienyl)magnesium (II) complex salt ($Mg(C_5H_5)_2$, is preferable from the standpoint of easy handling at the time of layer forming and the efficient supply of, magnesium atoms (Mg).

The gas to supply magnesium atoms (Mg) may be diluted with an inert gas such as $H_2$, He, Ar, and Ne, if necessary.

The lower layer may contain copper atoms (Cu). This is accomplished by introducing into the deposition chamber the raw materials to form the lower layer together with a raw material to introduce copper atoms (Cu) in a gaseous form. The raw material to supply copper atoms (Cu) may be gaseous at normal temperature and under normal pressure or gasifiable under the layer forming conditions.

The substance that can be used as a gas to supply copper atoms (Cu) include organometallic compounds containing copper atoms (Cu). Copper (II) bisdimethylglyoximate $Cu(C_4H_7N_2O_2)_2$, is preferable from the standpoint of easy handling at the time of layer forming and the efficient supply of copper atoms (Cu).

The gas to supply copper atoms (Cu) may be diluted with an inert gas such as $H_2$, He, Ar, and Ne, if necessary.

The lower layer may contain sodium atoms (Na) or yttrium atoms (Y) or manganese atoms (Mn) or zinc atoms (Zn). This is accomplished by introducing into the deposition chamber the raw materials to form the lower layer together with a raw material to introduce sodium atoms (Na) or yttrium atoms (Y) or manganese atoms (Mn) or zinc atoms (Zn). The raw material to supply sodium atoms (Na) or yttrium atoms (Y) or manganese atoms (Mn) or zinc atoms (Zn) may be gaseous at normal temperature and under normal pressure or gasifiable under the layer forming conditions.

The substance that can be used as a gas to supply sodium atoms (Na) includes sodium amine ($NaNH_2$) and organometallic compounds containing sodium atoms (Na). Among them, sodium amine ($NaNH_2$), is preferable from the standpoint of easy handling at the time of layer forming and the efficient supply of sodium atoms (Na).

The substance that can be used as a gas to supply yttrium atoms (Y) includes organometallic compounds containing yttrium atoms (Y). Triisopropanol yttrium $Y(Oi\text{-}C_3H_7)_3$ is preferable from the standpoint of easy handling at the time of layer forming and the efficient supply of yttrium atoms (Y).

The substance that can be used as a gas to supply manganese atoms (Mn) includes organometallic compounds containing manganese atoms (Mn. Monomethylpentacarbonylmanganese $Mn(CH_3)(CO)_5$ is preferable from the standpoint of easy handling at the time of layer forming and the efficient supply of manganese atoms (Mn).

The substance that can be used as a gas to supply zinc atoms (Zn) includes organometallic compounds containing zinc atoms (Zn). Diethyl zinc $Zn(C_2H_5)_2$ is preferable from the standpoint of easy handling at the time of layer forming and the efficient supply of zinc atoms (Zn).

The gas to supply sodium atoms (Na) or yttrium atoms (Y) or manganese atoms (Mn) or zinc atoms (Zn) may be diluted with an inert gas such as $H_2$, He, Ar, and Ne, if necessary.

According to the present invention, the lower layer should have a thickness of $0.03\sim5$ μm, preferably $0.01\sim1$ μm, and most desirably $0.05\sim0.5$ μm, from the standpoint of the desired electrophotographic characteristics and economic effects.

According to the present invention, the lower layer has an interface region which is in contact with the aluminum support and contains less than 95% of the aluminum atoms contained in the aluminum support. If the interface region contains more than 95% of the aluminum atoms contained in the aluminum support, it merely functions as the support. The lower layer also has an interface which is in contact with the upper layer and contains more than 5% of the aluminum atoms contained in the lower layer. If the interface region contains less than 5% of the aluminum atoms contained in the lower layer, it merely functions as the upper layer.

In order to form the lower layer of AlSiH which has the characteristic properties to achieve the object of the present invention, it is necessary to properly establish the gas pressure in the deposition chamber and the temperature of the support.

The gas pressure in the deposition chamber should be properly selected according to the desired layer. It is usually $1\times10^{-5}\sim10$ Torr, preferably $1\times10^{-4}\sim3$ Torr, and most desirably $1\times10^{-4}\sim1$ Torr.

The temperature (Ts) of the support should be properly selected according to the desired layer. It is usually $50\sim00°$ C., and preferably $100\sim400°$ C.

In order to form the lower layer of AlSiH by the glow discharge method according to the present invention, it is necessary to properly establish the discharge electric power to be supplied to the deposition chamber according to the desired layer. It is usually $5\times10^{-5}\sim10$ W/cm$^3$, preferably $5\times10^{-4}\sim5$ W/cm$^3$, and most desirably $1\times10^{-3}\sim2\times10^{-3}$ W/cm$^3$.

The gas pressure of the deposition chamber, the temperature of the support, and the discharge electric power to be supplied to the deposition chamber mentioned above should be established interdependently so that the lower layer having the desired characteristic properties can be formed.

Upper layer

According to the present invention, the upper layer is made of non-Si(H,X) so that it has the desired photoconductive characteristics.

According to the present invention, the upper layer has a layer region which is in contact with the lower layer, said layer region containing substantially none of atoms (M) to control conductivity, carbon atoms (C), nitrogen atoms (N), oxygen atoms (O), germanium atoms (Ge), and tin atoms (Sn). The upper layer has another layer region which may contain at least one kind of atoms (M) to control conductivity, carbon atoms (C), nitrogen atoms (N), oxygen atoms (O), germanium atoms (Ge), and tin atoms (Sn). The upper layer should preferably have a layer region near the free surface which contains at least one kind of carbon atoms (C), nitrogen atoms (N), and oxygen atoms (O).

In the case where the upper layer has a layer region which contains at least one kind of atoms (M) to control conductivity, carbon atoms (C), nitrogen atoms (N), oxygen atoms (O), germanium atoms (Ge), and tin atoms (Sn), the layer region may contain atoms (M) to control conductivity, carbon atoms (C), nitrogen atoms (N), oxygen atoms (O), germanium atoms (Ge), and tin atoms (Sn) in such a manner that they are uniformly distributed in the layer region or they are distributed unevenly across the layer thickness. In either cases, it is necessary that they should be uniformly distributed in the plane parallel to the surface of the support.

According to the present invention, the upper layer may contain at least one kind of alkali metal atoms, alkaline earth metal atoms, and transition metal atoms. They may be contained in the entire upper layer or in a portion of the upper layer, and they may be distributed uniformly throughout the upper layer or unevenly across the layer thickness. In either cases, it is necessary that they should be uniformly distributed in the plane parallel to the surface of the support. This is important to ensure the uniform characteristics within the plane.

The upper layer may have a layer region (abbreviated as layer region (M) hereinafter) containing atoms (M) to control conductivity (abbreviated as atoms (M) hereinafter), a layer region (abbreviated as layer region (CNO) hereinafter) containing carbon atoms (C) and/or nitrogen atoms (N) and/or oxygen atoms (O) (abbreviated as atoms (CNO) hereinafter), a layer region (abbreviated as region (GS) hereinafter) containing germanium atoms (Ge) and/or tin atoms (Sn) (abbreviated as atoms (GS) hereinafter), and a layer region containing at least one kind of alkali metal atoms, alkaline earth metal atoms, and transition metal atoms. These layer regions may partly or entirely overlap one another.

FIGS. 17 to 36 show the typical example of the across-the-layer distribution of atoms (M) contained in layer region (M), the typical example of the across-the-layer distribution of atoms (CNO) contained in layer region (CNO), the typical example of the across-the-layer distribution of atoms (GS) contained in layer region (GS), and the typical example of the across-the-layer distribution of alkali metal atoms, alkaline earth metal atoms, and transition metal atoms contained in the layer region containing at least one kind of alkali metal atoms, alkaline earth metal atoms, and transition metal atoms, in the upper layer of the light receiving member for electrophotography according to the present invention. (These layer regions will be collectively referred to as "layer region (Y)" and these atoms, "atoms (Y)", hereinafter.)

Accordingly, FIGS. 17 to 36 show the typical examples of the across-the-layer distribution of atoms (Y) contained in layer region (Y). If layer region (M), layer region (CNO), layer region (GS), and a layer region containing at least one kind of alkali metal, alkaline earth metal, and transition metal are substantially the same, as mentioned above, the number of layer region (Y) in the upper layer is single; otherwise, it is plural.

In FIGS. 17 to 36, the abscissa represents the concentration (C) of atoms (Y) and the ordinate represents the thickness of layer region (Y), with $t_B$ representing the position of the end of layer region (Y) adjoining the lower layer, $t_T$ representing the position of the end of layer region (Y) adjoining the free surface. In other words, layer region (Y) containing atoms (Y) is formed from the $t_B$ side to the $t_T$ side.

Figure 17:
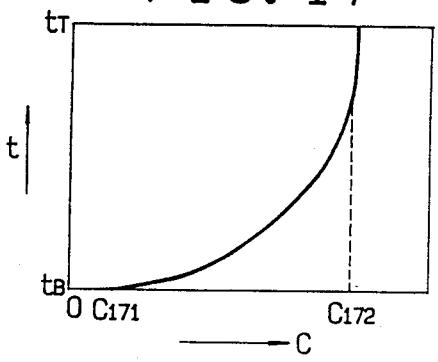
FIGS. 17 to 36 are diagrams illustrating the distribution of atoms (M) to control conductivity, carbon atoms (c), and/or nitrogen atoms (N), and/or oxygen atoms (O), and/or germanium atoms (Ge), and/or tin atoms (Sn), and/or alkali metal atoms, and/or alkaline earth metal atoms, and/or transition metal atoms, which are contained in the upper layer.

FIG. 17 shows a first typical example of the distribution of atoms (Y) across layer thickness in layer region (Y).

The distribution shown in FIG. 17 is such that the concentration (C) of atoms (Y) gradually and continuously increases from $C_{171}$ to $C_{172}$ between position $t_B$ and position $t_T$.

Figure 18:
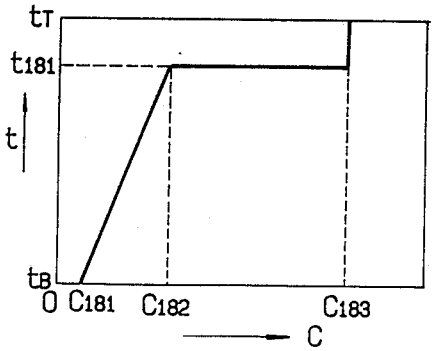

The distribution shown in FIG. 18 is such that the concentration (C) of atoms (Y) linearly increases from $C_{181}$ to $C_{182}$ between position $t_B$ and position $t_{181}$ and then remains constant at $C_{183}$ between position $t_{181}$ and position $t_T$.

Figure 19:
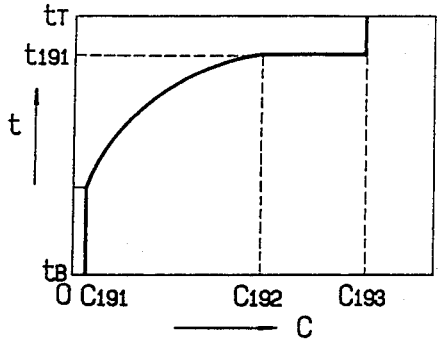

The distribution shown in FIG. 19 is such that the concentration (C) of atoms (Y) remains constant at $C_{191}$ between position $t_B$ and position $t_{191}$, increases gradually and continuously from $C_{191}$ to $C_{192}$ between position $t_{191}$ to position $t_{192}$, and remains constant at $C_{193}$ between position $t_{192}$ and position $t_T$.

Figure 20:
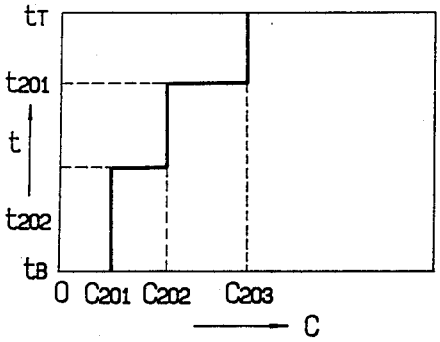

The distribution shown in FIG. 20 is such that the concentration (C) of atoms (Y) remains constant at $C_{201}$ between position $t_B$ and position $t_{201}$, remains constant at $C_{202}$ between position $t_{201}$ and position $t_{202}$, and remains constant at $C_{203}$ between position $t_{202}$ and position $t_T$.

Figure 21:
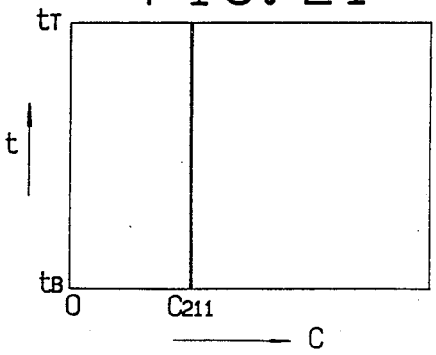

The distribution shown in FIG. 21 is such that the concentration (C) of atoms (Y) remains constant at $C_{121}$ between position $t_B$ and position $t_T$.

Figure 22:
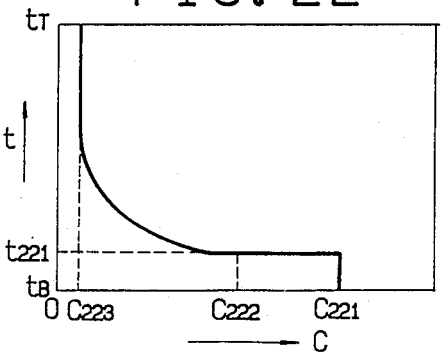

The distribution shown in FIG. 22 is such that the concentration (C) of atoms (Y) remains constant at $C_{221}$ between position $t_B$ and position $t_{221}$, and decreases gradually and continuously from $C_{222}$ to $C_{223}$ between position $t_{221}$ and $t_T$.

Figure 23:
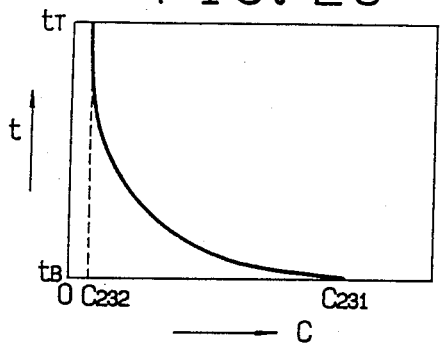

The distribution shown in FIG. 23 is such that the concentration (C) of atoms (Y) decreases gradually and continuously from $C_{231}$ to $C_{232}$ between position $t_B$ and position $t_T$.

Figure 24:
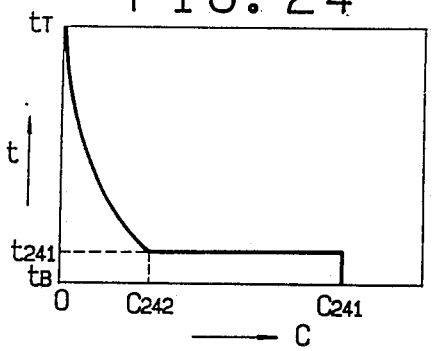

The distribution shown in FIG. 24 is such that the concentration (C) of atoms (Y) remains constant at $C_{241}$ between position $t_B$ and position $t_{241}$, and decreases gradually and continuously from $C_{242}$ to substantially zero between position $t_{241}$ and position $t_T$. ("Substantially zero" means that the amount is lower than the detection limit. The same shall apply hereinafter.)

Figure 25:
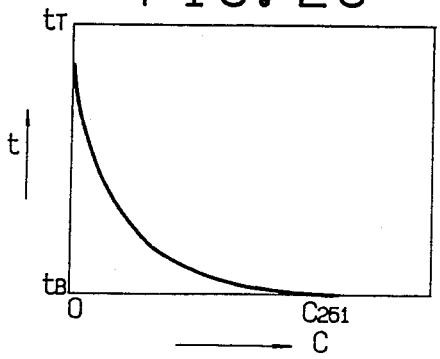

The distribution shown in FIG. 25 is such that the concentration (C) of atoms (Y) decreases gradually and continuously from $C_{251}$ to substantially zero between position $t_B$ and position $t_T$.

Figure 26:
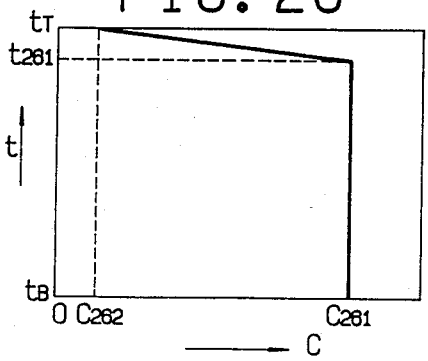

The distribution shown in FIG. 26 is such that the concentration (C) of atoms (Y) remains constant at $C_{261}$ between position $t_B$ and position $t_{261}$, and decreases linearly from $C_{261}$ to $C_{262}$ between position $t_{261}$ and $T_T$.

Figure 27:
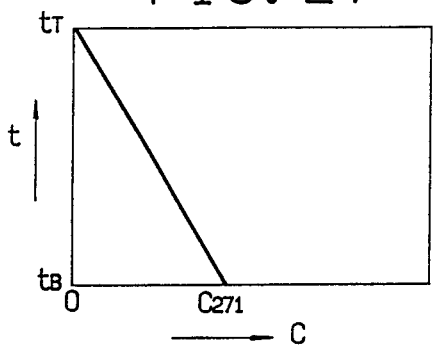

The distribution shown in FIG. 27 is such that the concentration (C) of atoms (Y) decreases linearly from $C_{271}$ to substantially zero between position $t_B$ and position $t_T$.

Figure 28:
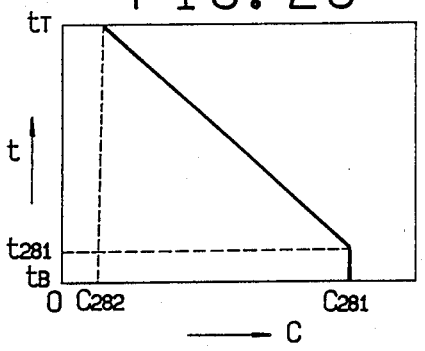

The distribution shown in FIG. 28 is such that the concentration (C) of atoms (Y) remains constant at $C_{281}$ between position $t_B$ and position $t_{281}$ and decreases linearly from $C_{281}$ to $C_{282}$ between position $t_{281}$ and position $t_T$.

Figure 29:
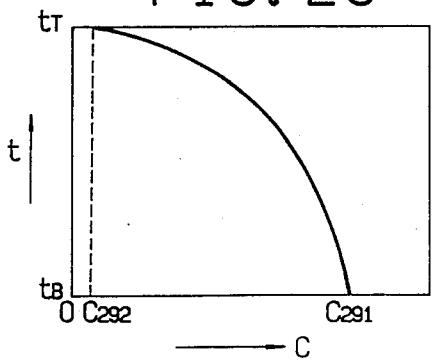

The distribution shown in FIG. 29 is such that the concentration (C) of atoms (Y) decreases gradually and continuously from $C_{291}$ to $C_{292}$ between position $t_B$ and position $t_T$.

Figure 30:
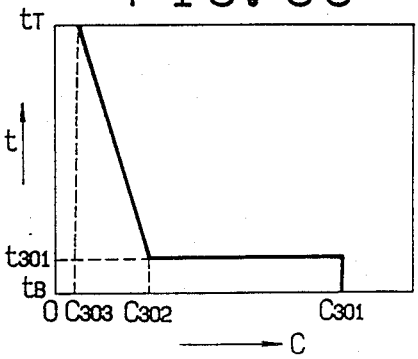

The distribution shown in FIG. 30 is such that the concentration (C) of atoms (Y) remains constant at $C_{301}$ between position $t_B$ and position $t_{301}$ and decreases linearly from $C_{302}$ to $C_{303}$ between position $t_{301}$ and position $t_T$.

Figure 31:
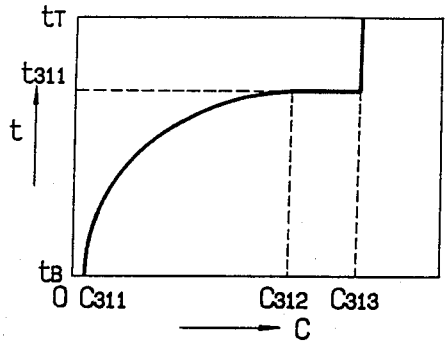

The distribution shown in FIG. 31 is such that the concentration (C) of atoms (Y) increases gradually and continuously from $C_{311}$ to $C_{312}$ between position $t_B$ and position $t_{311}$ and remains constant at $C_{313}$ between position $t_{311}$ and position $t_T$.

Figure 32:
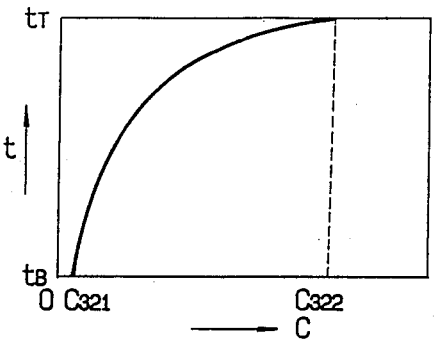

The distribution shown in FIG. 32 is such that the concentration (C) of atoms (Y) increases gradually and continuously from $C_{321}$ to $C_{322}$ between position $t_B$ and position $t_T$.

Figure 33:
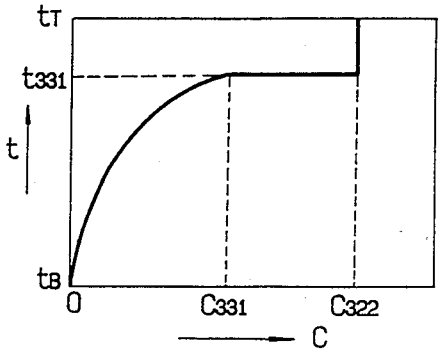

The distribution sown in FIG. 33 is such that the concentration (C) of atoms (Y) increases gradually from substantially zero to $C_{331}$ between position $t_B$ and position $t_{331}$ and remains constant at $C_{332}$ between position $t_{331}$ and position $t_T$.

Figure 34:
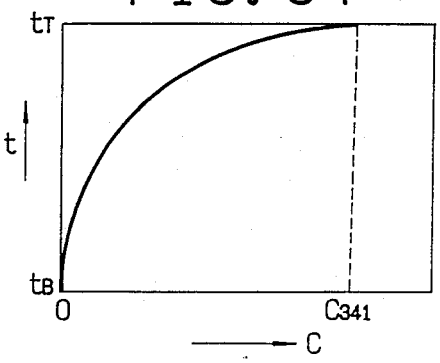

The distribution shown in FIG. 34 is such that the concentration (C) of atoms (Y) increases gradually from substantially zero to $C_{341}$ between position $t_B$ and position $t_T$.

Figure 35:
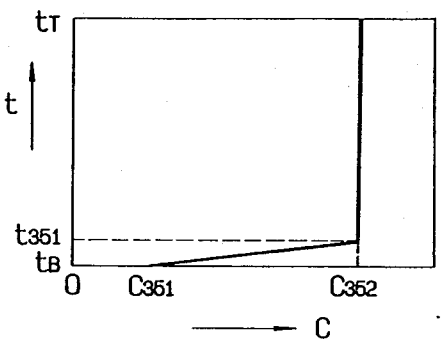

The distribution shown in FIG. 35 is such that the concentration (C) of atoms (Y) increases linearly from $C_{351}$ to $C_{352}$ between position $t_B$ and position $t_{351}$ and remains constant at $C_{352}$ between position $t_{351}$ and position $t_T$.

Figure 36:
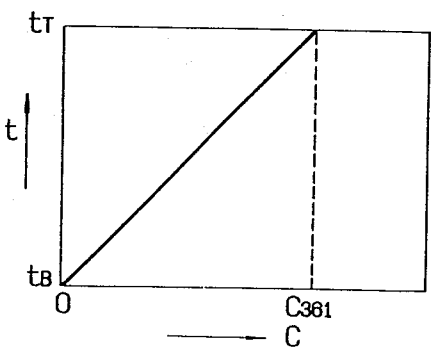

The distribution shown in FIG. 36 is such that the concentration (C) of atoms (Y) increases linearly from $C_{361}$ to $C_{362}$ between position $t_B$ and position $t_T$.

The above-mentioned atoms (M) to control conductivity include so-called impurities in the field of semiconductor. According to the present invention, they are selected from atoms belonging to Group III of the periodic table, which impart the p-type conductivity (abbreviated as "Group III atoms" hereinafter); atoms belonging to Group V of the periodic table excluding nitrogen atoms (N), which impart the n-type conductivity (abbreviated as "Group V atoms" hereinafter); and atoms belonging to Group VI of the periodic table excluding oxygen atoms (O) (abbreviated as "Group VI atoms" hereinafter).

Examples of Group III atoms include B (boron), Al (aluminum), Ga (gallium), In (indium), and Tl (thallium), with B, Al, and Ga being preferable. Examples of Group V atoms include P (phosphorus), As (arsenic), Sb (antimony), and Bi (bismuth), with P and As being preferable. Examples of Group VI atoms include S (sulfur), Se (selenium), Te (tellurium), and Po (polonium), with S and Se being preferable.

According to the present invention, the layer region (M) may contain atoms (M) to control conductivity, which are Group III atoms, Group V atoms, or Group VI atoms. The atoms (M) control the conduction type and/or conductivity, and/or improve the injection of electric charge across the layer region (M) and the other layer region than the layer region (M) in the upper layer.

In the layer region (M), the content of atoms to control conductivity should be $1\times10^{-3}\sim5\times10^{4}$ atom-ppm, preferably $1\times10^{-2}\sim1\times10^{4}$ atom-ppm, and most desirably $1\times10^{-1}\sim5\times10^{3}$ atom-ppm. In the case where the layer region (M) contains carbon atoms (C) and/or nitrogen atoms (N) and/or oxygen atoms (O) in an amount less than $1\times10^{-3}$ atom-ppm, the layer region (M) should preferably contain atoms (M) to control conductivity in an amount of $1\times10^{-3}\sim1\times10^{3}$ atom-ppm. In the case where the layer region (M) contains carbon atoms (C) and/or nitrogen atoms (N) and/or oxygen atoms (O) in an amount more than $1\times10^{3}$ atom-ppm, the layer region (M) should preferably contain atoms (M) to control conductivity in an amount of $1\times10^{-1}\sim5\times10^{4}$ atom-ppm.

According to the present invention, the layer region (M) may contain carbon atoms (C) and/or nitrogen atoms (N) and/or oxygen atoms (O). They increase dark resistance and/or increase hardness and/or control spectral sensitivity and/or improve the adhesion between the layer region (CNO) and the other layer region than the layer region (CNO) in the upper layer.

The layer region (CNO) should contain carbon atoms (C) and/or nitrogen atoms (N) and/or oxygen atoms (O) in an amount of $1\sim9\times10^{5}$ atom-ppm, preferably $1\times10^{1}\sim5\times10^{5}$ atom-ppm, and most desirably $1\times10^{2}\sim3\times10^{5}$ atom-ppm. If it is necessary to increase dark resistance and/or increase hardness, the content should be $1\times10^{3}\sim9\times10^{5}$ atom-ppm; and if it is necessary to control spectral sensitivity, the content should be $1\times10^{2}\sim5\times10^{5}$ atom-ppm.

According to the present invention, the germanium atoms (Ge) and/or tin atoms (Sn) contained in the layer region (GS) produce the effect of controlling principally the spectral sensitivity, especially improving the sensitivity for long-wavelength light in the case where long-wavelength light such as semiconductor laser is used as the light source for image exposure in the electrophotographic apparatus, and/or preventing the occurrence of interference, and/or improving the adhesion of the layer region (GS) to the lower layer, and/or improving the adhesion of the layer region (GS) to the other layer region than the layer region (GS) in the upper layer.

According to the present invention, the germanium atoms (Ge) and/or tin atoms (Sn) contained in the layer region (GS) produce the effect of controlling principally the spectral sensitivity for long-wavelength light, especially in the case where long-wavelength light such as semiconductor light is used as the light source for image exposure in the electrophotographic apparatus. The amount of the germanium atoms (Ge) and/or tin atoms (Sn) contained in the layer region (GS) should be $1\sim9.5\times10^{5}$ atom-ppm, preferably $1\times10^{2}\sim8\times10^{5}$ atom-ppm, and most desirably $5\times10^{2}\sim7\times10^{5}$ atom-ppm.

According to the present invention, the hydrogen atoms (H) and/or halogen atoms (X) contained in the upper layer compensate for the unbonded hands of silicon atoms (Si), thereby improving the quality of the layer. The amount of hydrogen atoms (H) or the total amount of hydrogen atoms (H) and halogen atoms (X) contained in the upper layer should preferably be $1\times10^{3}\sim7\times10^{5}$ atom-ppm. The amount of halogen atoms (X) should preferably be $1\sim4\times10^{5}$ atom-ppm. In the case where the content of carbon atoms (C) and/or nitrogen atoms (N) and/or oxygen atoms (O) in the upper layer is less than $3\times10^{5}$ atom-ppm, the amount of hydrogen atoms (H) or the total amount of hydrogen atoms (H) and halogen atoms (X) should preferably be $1\times10^{3}\sim4\times10^{5}$ atom-ppm. Moreover, in the case where the upper layer is made of poly-Si(H,X), the amount of hydrogen atoms (H) or the total amount of hydrogen atoms (H) and halogen atoms (X) in the upper layer should preferably be $10^{3}\sim2\times10^{5}$ atom-ppm. In the case where the upper layer is made of A-Si(H,X), it should preferably be $1\times10^{4}\sim7\times10^{5}$ atom-ppm.

According to the present invention, the amount of at least one kind of of atoms selected from alkali metal atoms, alkaline earth metals, and transition metal atoms contained in the upper layer should be $1\times10^{-3}\sim1\times10^{4}$ atom-ppm, preferably $1\times10^{-2}\sim1\times10^{3}$ atom-ppm, and most desirably $5\times10^{-2}\sim1\times10^{2}$ atom-ppm.

According to the present invention, the upper layer composed of non-Si(H,X) is formed by the vacuum deposition film forming method, as in the lower layer which was mentioned earlier. The preferred methods include glow discharge method, sputtering method, ion plating method, HRCVD method, and FOCVD method. These methods may be used in combination with one another in the same apparatus.

The glow discharge method may be performed in the following manner to form the upper layer of non-Si(H,X). The raw material gases are introduced into an evacuatable deposition chamber, and glow discharge is performed, with the gases kept at a desired pressure, so that a layer of non-Si(H,X) is formed as required on the lower layer which has previously been formed on the surface of the support placed in the chamber. The raw material gases are composed mainly of a gas to supply silicon atoms (Si), a gas to supply hydrogen atoms (H), and/or a gas to supply halogen atoms (X). They may also optionally contain a gas to supply atoms (M) to control conductivity and/or a gas to supply carbon atoms (C) and/or a gas to supply nitrogen atoms (N) and/or a gas to supply oxygen atoms (O) and/or a gas to supply germanium atoms (Ge) and/or a gas to supply tin atoms (Sn) and/or a gas to supply at least one kind of atoms selected from alkali metal atoms, alkaline earth metal atoms, and transition metal atoms.

The HRCVD method may be performed in the following manner to form the upper layer of non-Si(H,X). The raw material gases are introduced all together or individually into an activation space in an evacuatable deposition chamber, and glow discharge is performed or the gases are heated, with the gases kept at a desired pressure, during which an active substance (A) is formed. Simultaneously, a gas to supply hydrogen atoms (H) is introduced into another activation space to form an active substance (B) in the same manner. The active substance (A) and active substance (B) are introduced individually into the deposition chamber, so that a layer of non-Si(H,X) is formed on the lower layer which has previously been formed on the surface of the support placed in the chamber. The raw material gases are composed mainly of a gas to supply silicon atoms (Si) and a gas to supply halogen atoms (X). They may also optionally contain a gas to supply atoms (M) to control conductivity and/or a gas to supply carbon atoms (C) and/or a gas to supply nitrogen atoms (N) and/or a gas to supply oxygen atoms (O) and/or a gas to supply germanium atoms (Ge) and/or a gas to supply tin atoms (Sn) and/or a gas to supply at least one kind of atoms selected from alkali metal atoms, alkaline earth metal atoms, and transition metal atoms.

The FOCVD method may be performed in the following manner to form the upper layer of non-Si(H,X). The raw material gases are introduced all together or individually into an evacuatable deposition chamber and a halogen (X) gas is introduced separately into the deposition chamber. With the gases kept at a desired pressure, chemical reactions are carried out so that a layer of non-Si(H,X) is formed on the lower layer which has previously been formed on the surface of the support placed in the chamber. The raw material gases are composed mainly of a gas to supply silicon atoms (Si) and a gas to supply hydrogen atoms (H). They may also optionally contain a gas to supply atoms (M) to control conductivity and/or a gas to supply carbon atoms (C) and/or a gas to supply nitrogen atoms (N) and/or a gas to supply oxygen atoms (O) and/or a gas to supply germanium atoms (Ge) and/or a gas to supply tin atoms (Sn) and/or a gas to supply at least one kind of atoms selected from alkali metal atoms, alkaline earth metal atoms, and transition metal atoms.

The sputtering method or ion plating method may be performed to form the upper layer of non-Si(H,X) according to the known method as disclosed in, for example, Japanese Patent Laid-open No. 59342/1986.

According to the present invention, the upper layer contains atoms (M) to control conductivity, carbon atoms (C), nitrogen atoms (N), oxygen atoms (O), germanium atoms (Ge), tin atoms (Sn), and at least one kind of atoms selected from alkali metal atoms, alkaline earth metal atoms, and transition metal atoms (collectively referred to as "atoms (Z)" hereinafter), which are distributed in different concentrations across the layer thickness. The upper layer having such a depth profile can be formed by controlling the flow rate of the feed gas to supply atoms (Z) into the deposition chamber according to the desired curve of change in the case of glow discharge method, HRCVD method, and FOCVD method. The flow rate may be changed by operating the needle valve in the gas passage manually or by means of a motor, or by adjusting the mass flow controller manually or by means of a programmable control apparatus.

According to the present invention, the gas to supply Si includes, for example, gaseous or gasifiable silicohydrides (silanes) such as $SiH_4$, $Si_2H_6$, $Si_3H_8$, and $Si_4H_{10}$. $SiH_4$ and $Si_2H_6$ are preferable from the standpoint of ease of handling and the efficiency of Si supply. These gases to supply Si may be diluted with an inert gas such as $H_2$, He, Ar, and Ne, if necessary.

Examples of the gas used in the invention to supply halogen atoms include halogen gases and gaseous or gasifiable halides, interhalogen compounds, and halogen-substituted silane derivatives. Additional examples include gaseous or gasifiable halogen-containing silicohydrides composed of silicon atoms (Si) and halogen atoms (X).

The halogen compounds that can be suitably used in the present invention include halogen gases such as fluorine, chlorine, bromine, and iodine; and interhalogen compounds such as BrF, ClF, $ClF_3$, $BrF_5$, $BrF_3$, $IF_3$, $IF_7$, ICl, and IBr.

Examples of the halogen-containing silicon compounds, or halogen-substituted silane compounds, include halogenated silicon such as $SiF_4$, $Si_2F_6$, $SiCl_4$, and $SiBr_4$.

In the case where the halogen-containing silicon compound is used to form the light receiving member for electrophotography by the glow discharge method or HRCVD method, it is possible to form the upper layer composed of non-Si(H,X) containing halogen atoms on the lower layer without using a silicohydride gas to supply silicon atoms.

In the case where the upper layer containing halogen atoms is formed by the glow discharge method or HRCVD method, a silicon halide gas is used to supply silicon atoms. The silicon halide gas may be mixed with hydrogen or a hydrogen-containing silicon compound gas to facilitate the introduction of hydrogen atoms (H) at a desired level.

The above-mentioned gases may be used individually or in combination with one another at a desired mixing ratio.

The raw materials to form the upper layer which are used in addition to the above-mentioned halogen compounds or halogen-containing silicon compounds include gaseous or gasifiable hydrogen halides such as HF, HCl, HBr, and HI; and halogen-substituted silicohydrides such as $SiH_3F$, $SiH_2F_2$, $SiHF_3$, $SiH_2I_2$, $SiH_2Cl_2$, $SiHCl_3$, $SiH_2Br_2$, and $SiHBr_3$. Among these substances, the hydrogen-containing halides are a preferred halogen-supply gas because they supply the upper layer with halogen atoms (X) as well as hydrogen atoms (H) which are very effective for the control of electric or photoelectric characteristics.

The introduction of hydrogen atoms (H) into the upper layer may also be accomplished in another method by inducing discharge in the deposition chamber containing a silicohydride such as $SiH_4$, $Si_2H_6$, $Si_3H_8$,and $Si_4H_{10}$ and a silicon compound to supply silicon atoms (Si).

The amount of hydrogen atoms (H) and/or halogen atoms (X) to be introduced into the upper layer may be controlled by regulating the temperature of the support, the electric power for discharge, and the amount of raw materials for hydrogen atoms (H) and halogen atoms (X) to be introduced into the deposition chamber.

The upper layer may contain atoms (M) to control conductivity, such as Group III atoms, Group V atoms, and Group VI atoms. This is accomplished by introducing into the deposition chamber the raw materials to form the upper layer together with a raw material to introduce Group III atoms, a raw material to introduce Group V atoms, or a raw material to introduce Group VI atoms. The raw material to introduce Group III atoms, the raw material to introduce Group V atoms, or the raw material to introduce Group VI atoms may be gaseous at normal temperature and under normal pressure or gasifiable under the layer forming conditions. The raw material to introduce Group III atoms, especially boron atoms, include, for example, boron hydrides such as $B_2H_6$, $B_4H_{10}$, $B_5H_9$, $B_5H_{11}$, $B_6H_{10}$, $B_6H_{12}$, and $B_6H_{14}$, and boron halides such as $BF_3$, $BCl_3$, and $BBr_3$. Additional examples include $AlCl_3$, $GaCl_3$, $Ga(CH_3)_3$, $InCl_3$, and $TlCl_3$.

The raw material to introduce Group V atoms, especially phosphorus atoms, include, for example, phosphorus hydrides such as $PH_3$ and $P_3H_4$, and phosphorus halides such as $PH_4I$, $PF_3$, $PF_5$, $PCl_3$, $PCl_5$, $PBr_3$, $PBr_5$, and $PI_3$. Other examples include $AsH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$, and $BiBr_3$.

The raw material to introduce Group VI atoms includes, for example, gaseous or gasifiable substances such as $H_2S$, $SF_4$, $SF_6$, $SO_2$, $SO_2F_2$, COS, $CS_2$, $CH_3SH$, $C_2H_5SH$, $C_4H_4S$, $(CH_3)_2S$, and $S(C_2H_5)_2S$. Other examples include gaseous or gasifiable substances such as $SeH_2$, $SeF_6$, $(CH_3)_2Se$, $(C_2H_5)_2Se$, $TeH_2$, $TeF_6$, $(CH_3)_2Te$, and $(C_2H_5)_2Te$.

These raw materials to introduce atoms (M) to control conductivity may be diluted with an inert gas such as $H_2$, He, Ar, and Ne.

According to the present invention, the upper layer may contain carbon atoms (C) or nitrogen atom (N) or oxygen atoms (O). This is accomplished by introducing into the deposition chamber the raw materials to form the upper layer, together with a raw material to introduce carbon atoms (C), or a raw material to introduce nitrogen atoms (N), or a raw material to introduce oxygen atoms (O). Raw materials to introduce carbon atoms (C), nitrogen atoms (N), or oxygen atoms (O) may be in the gaseous form at normal temperature and under normal pressure or may be readily gasifiable under the layer forming conditions.

A raw material gas to introduce carbon atoms (C) includes saturated hydrocarbons having 1 to 4 carbon atoms, ethylene series hydrocarbons having 2 to 4 carbon atoms, and acetylene series hydrocarbons having 2 to 3 carbon atoms.

Examples of the saturated hydrocarbons include methane ($CH_4$), ethane ($C_2H_6$), propane ($C_3H_6$), n-butane (n-$C_4H_{10}$), and pentane ($C_5H_{12}$). Examples of the ethylene series hydrocarbons include ethylene ($C_2H_4$), propylene ($C_3H_6$), butene-1 ($C_4H_8$, butene-2 ($C_4H_8$), isobutylene ($C_4H_8$), and pentene ($C_5H_{10}$). Examples of the acetylene series hydrocarbons include acetylene ($C_2H_2$), methylacetylene ($C_3H_4$), and butyne ($C_4H_6$).

Additional examples include halogenated hydrocarbons such as $CF_4$, $CCl_4$, and $CH_4CF_3$, which introduce carbon atoms (C) as well as halogen atoms (X).

Examples of the raw material gas to introduce nitrogen atoms (N) include nitrogen and gaseous or gasifiable nitrogen compounds (e.g., nitrides and azides) which are composed of nitrogen and hydrogen, such as ammonia ($NH_3$), hydrazine ($H_2NNH_2$), hydrogen azide ($HN_3$), and ammonium azide ($NH_3N)_3$). Additional examples include halogenated nitrogen compounds such as nitrogen trifluoride ($F_3N$) and nitrogen tetrafluoride ($F_4N_2$) which introduce nitrogen atoms (N) as well as halogen atoms (X).

Examples of the raw material gas to introduce oxygen atoms (O) include oxygen ($O_2$), ozone ($O_3$), nitrogen monoxide (NO), nitrogen dioxide ($NO_2$), dinitrogen oxide ($N_2O$), dinitrogen trioxide ($N_2O_3$), trinitrogen tetroxide ($N_3O_4$), dinitrogen pentoxide ($N_2O_5$), and nitrogen trioxide ($NO_3$). Additional examples include lower siloxanes such as diiloxane ($H_3SiOSiH_3$) and trisiloxane ($H_3SiOSiH_2,OSiH_3$) which are composed of silicon atoms (Si), oxygen atoms (O), and hydrogen atoms (H).

The upper layer may contain germanium atoms (Ge) or tin atoms (Sn). This is accomplished by introducing into the deposition chamber the raw materials to form the upper layer together with a raw material to introduce germanium atoms (Ge) or tin atoms (Sn) in a gaseous form. The raw material to supply germanium atoms (Ge) or the raw material to supply tin atoms (Sn) may be gaseous at normal temperature and under normal pressure or gasifiable under the layer forming conditions.

The substance that can be used as a gas to supply germanium atoms (Ge) include gaseous or gasifiable germanium hydrides such as $GeH_4$, $Ge_2H_6$, $Ge_3H_8$, and $Ge_4H_{10}$, Among them, $GeH_4$, $Ge_2H_6$, and $Ge_3H_8$ are preferable from the standpoint of easy handling at the time of layer forming and the efficient supply of germanium atoms (Ge).

Other effective raw materials to form the upper layer include gaseous or gasifiable germanium hydride-halides such as $GeHF_3$, $GeH_2F_2$, $GeH_3F$, $GeHCl_3$, $GeH_2Cl_2$, $GeH_3Cl$, $GeHBr_3$, $GeH_2Br_2$, $GeH_3Br$, $GeHI_3$, $GeH_2I_2$, and $GeH_3I$, and germanium halides such as $GeF_4$, $GeCl_4$, $GeBr_4$, $GeI_4$, $GeF_2$, $GeCl_2$, $GeBr_2$, and $GeI_2$.

The substance that can be used as a gas to supply tin atoms (Sn) include gaseous or gasifiable tin hydrides such as $SnH_4$, $Sn_2H_6$, $Sn_3H_8$, and $Sn_4H_{10}$. Among them, $SnH_4$, $Sn_2H_6$, and $Sn_3H_8$ are preferable from the standpoint of easy handling at the time of layer forming and the efficient supply of tin atoms (Sn).

Other effective raw materials to form the upper layer include gaseous or gasifiable tin hydride-halides such as $SnHF_3$, $SnH_2F_2$, $SnH_3F$, $SnHCl_3$, $SnH_2Cl_2$, $SnH_3Cl$, $SnHBr_3$, $SnH_2Br_2$, $SnH_3Br$, $SnHI_3$, $SnH_2I_2$, and $SnH_3I$, and tin halides such as $SnF_4$, $SnCl_4$, $SnBr_4$, $SnI_4$, $SnF_2$, $SnBr_2$, and $SnI_2$.

The upper layer may contain magnesium atoms (Mg). This is accomplished by introducing into the deposition chamber the raw materials to form the upper layer together with a raw material to introduce magnesium atoms (Mg) in a gaseous form. The raw material to supply magnesium atoms (Mg) may be gaseous at normal temperature and under normal pressure or gasifiable under the layer forming conditions.

The substance that can be used as a gas to supply magnesium atoms (Mg) include organometallic compounds containing magnesium atoms (Mg). Bis(cyclopentadienyl)magnesium (II) complex salt ($Mg(C_5H_5)_2$ is preferable from the standpoint of easy handling at the time of layer forming and the efficient supply of magnesium atoms (Mg).

The gas to supply magnesium atoms (Mg) may be diluted with an inert gas such as $H_2$, He, Ar, and Ne, if necessary.

The upper layer may contain copper atoms (Cu). This is accomplished by introducing into the deposition chamber the raw materials to form the upper layer together with a raw material to introduce copper atoms (Cu) in a gaseous form. The raw material to supply copper atoms (Cu) may be gaseous at normal temperature and under normal pressure or gasifiable under the layer forming conditions.

The substance that can be used as a gas to supply copper atoms (Cu) include organometallic compounds containing copper atoms (Cu). Copper (II) bisdimethylglyoximate $Cu(C_4H_7N_2O_2)_2$ is preferable from the standpoint of easy handling at the time of layer forming and the efficient supply of copper atoms (Cu).

The gas to supply copper atoms (Cu) may be diluted with an inert gas such as $H_2$, He, Ar, and Ne, if necessary.

The upper layer may contain sodium atoms (Na) or yttrium atoms (Y) or manganese atoms (Mn) or zinc atoms (Zn). This is accomplished by introducing into the deposition chamber the raw materials to form the upper layer together with a raw material to introduce sodium atoms (Na) or yttrium atoms (Y) or manganese atoms (Mn) or zinc atoms (Zn). The raw material to supply sodium atoms (Na) or yttrium atoms (Y) or manganese atoms (Mn) or zinc atoms (Zn) may be gaseous at normal temperature and under normal pressure or gasifiable under the layer forming conditions.

The substance that can be used as a gas to supply sodium atoms (Na) includes sodium amine ($NaNH_2$), and organometallic compounds containing sodium atoms (Na). Among them, sodium amine ($NaNH_2$) is preferable from the standpoint of easy handling at the time of layer forming and the efficient supply of sodium atoms (Na).

The substance that can be used as a gas to supply yttrium atoms (Y) includes organometallic compounds containing yttrium atoms (Y). Triisopropanol yttrium $Y(Oi\text{-}C_3H_7)_3$ is preferable from the standpoint of easy handling at the time of layer forming and the efficient supply of yttrium atoms (Y).

The substance that can be used as a gas to supply manganese atoms (Mn) includes organometallic compounds containing manganese atoms (Mn). Monomethylpentacarbonylmanganese $Mn(CH_3)(CO)_5$ is preferable from the standpoint of easy handling at the time of layer forming and the efficient supply of manganese atoms (Mn).

The substance that can be used as a gas to supply zinc atoms (Zn) includes organometallic compounds containing zinc atoms (Zn). Diethyl zinc $Zn(C_2H_5)_2$ is preferable from the standpoint of easy handling at the time of layer forming and the efficient supply of zinc atoms (Zn).

The gas to supply sodium atoms (Na) or yttrium atoms (Y) or manganese atoms (Mn) or zinc atoms (Zn) may be diluted with an inert gas such as $H_2$, He, Ar, and Ne, if necessary.

According to the present invention, the upper layer should have a thickness of $1\sim130$ μm, preferably $3\sim100$ μm, and most desirably $5\sim60$ μm, from the standpoint of the desired electrophotographic characteristics and economic effects.

In order to form the upper layer of non-Si(H,X) which has the characteristic properties to achieve the object of the present invention, it is necessary to properly establish the gas pressure in the deposition chamber and the temperature of the support.

The gas pressure in the deposition chamber should be properly selected according to the desired layer. It is usually $1\times10^{-5}\sim10$ Torr, preferably $1\times10^{-4}\sim3$ Torr, and most desirably $1\times10^{-4}\sim1$ Torr.

In the case where the upper layer is made of A-Si(H,X) as non-Si(H,X), the support temperature (Ts) should be properly selected according to the desired layer. It is usually $50°\sim400°$ C., and preferably $100°\sim300°$ C. In the case where the upper layer is made of poly-Si(H,X) as non-Si(H,X), the upper layer may be formed in various manners as exemplified below.

According to one method, the support temperature is established at $400°\sim600°$ C. and a film is deposited on the support by the plasma CVD method.

According to another method, an amorphous film is formed on the support by the plasma CVD method while keeping the support temperature at 250° C., and the amorphous film is made "poly" by annealing. The annealing is accomplished by heating the support at $400°\sim600°$ C. for about $5\sim30$ minutes, or irradiating the support with laser beams for about $5\sim30$ minutes.

In order to form the upper layer of non-Si(H,X) by the glow discharge method according to the present invention, it is necessary to properly establish the discharge electric power to be supplied to the deposition chamber according to the desired layer. It is usually $5\times10^{-5}\sim10$ W/cm$^3$, preferably $5\times10^{-4}\sim5$ W/cm$^3$, and most desirably $1\times10^{-3}\sim2\times10^{-3}$ W/cm$^3$.

The gas pressure of the deposition chamber, the temperature of the support, and the discharge electric power to be supplied to the deposition chamber mentioned above should be established interdependently so that the upper layer having the desired characteristic properties can be formed.

Effect of the invention

The light receiving member for electrophotography pertaining to the present invention has a specific layer construction as mentioned above. Therefore, it is completely free of the problems involved in the conventional light receiving member for electrophotography which is made of A-Si. It exhibits outstanding electric characteristics, optical characteristics, photoconductive characteristics, image characteristics, durability, and adaptability to use environments.

According to the present invention, the lower layer contains aluminum atoms (Al), silicon atoms (Si), and hydrogen atoms (H) in such a manner that their distribution is uneven across the layer thickness. This improves the injection of electric charge (photocarrier) across the aluminum support and the upper layer, and also improves the structural continuity of the constituting elements in the aluminum support and the upper layer. This in turn leads to the improvement of image characteristics such as dots and coarse image and the reproduction of high-quality images having a sharp half tone and high resolution.

The above-mentioned layer structure prevents the occurrence of defective images caused by impactive mechanical pressure applied for a short time to the light receiving member for electrophotography and also prevents the peeling of the non-Si(H,X) film, improving the durability. In addition, the layer structure relieves the stress resulting from the difference of the aluminum support and the non-Si(H,X) film in the coefficient of thermal expansion, preventing the occurrence of cracking and peeling in the non-Si(H,X) film. This leads to improved yields in production.

According to the present invention, the lower layer contains aluminum atoms (Al), silicon atoms (Si), hydrogen atoms (H), and atoms (Mc) to control image quality. This improves the injection of electric charge (photocarrier) across the aluminum support and the upper layer, and also improves the transferability of electric charge (photocarrier) in the lower layer. This in turn leads to the improvement of image characteristics such as coarse image and the reproduction of high-quality images having a sharp half tone and high resolution.

According to the present invention, the lower layer also contains halogen atoms which compensate dangling bonds of silicon atoms and aluminum atoms, thereby providing a structurally stable state. This, in combination with the effect produced..by the unevenly distributed silicon atoms, aluminum atoms, and hydrogen atoms, greatly improves the image characteristics such as coarse image and dots.

According to the present invention, the lower layer also contains at least either of germanium atoms (Ge) and tin atoms (Sn). This improves the injection of electric charge (photocarrier) across the aluminum support and the upper layer, the adhesion, and the transferability of electric charge in the lower layer. This in turn leads to the remarkable improvement in image characteristics and durability.

According to the present invention, the lower layer also contains at least one kind of atoms selected from alkali metal atoms, alkaline earth metal atoms, and transition metal atoms. This contributes to the dispersion of hydrogen atoms and halogen atoms contained in the lower layer, and also prevents the peeling of film which occurs after use for a long time as the result of aggregation of hydrogen atoms and/or halogen atoms. This also improves the injection of electric charge (photocarrier) across the aluminum support and the upper layer, the adhesion of the light receiving layer to the aluminum support and the transferability of electric charge in the lower layer. This in turn leads to the remarkable improvement in the characteristics and durability of a light receiving member and also to stable production of the light-receiving member having a stable quality.

PREFERRED EMBODIMENT OF THE INVENTION

The invention will be described in more detail with reference to the following examples, which are not intended to limit the scope of the invention.

EXAMPLE 1

A light receiving member for electrophotography pertaining to the present invention was produced by the high-frequency ("RF" for short hereinafter) glow discharge decomposition method.

Figure 37:
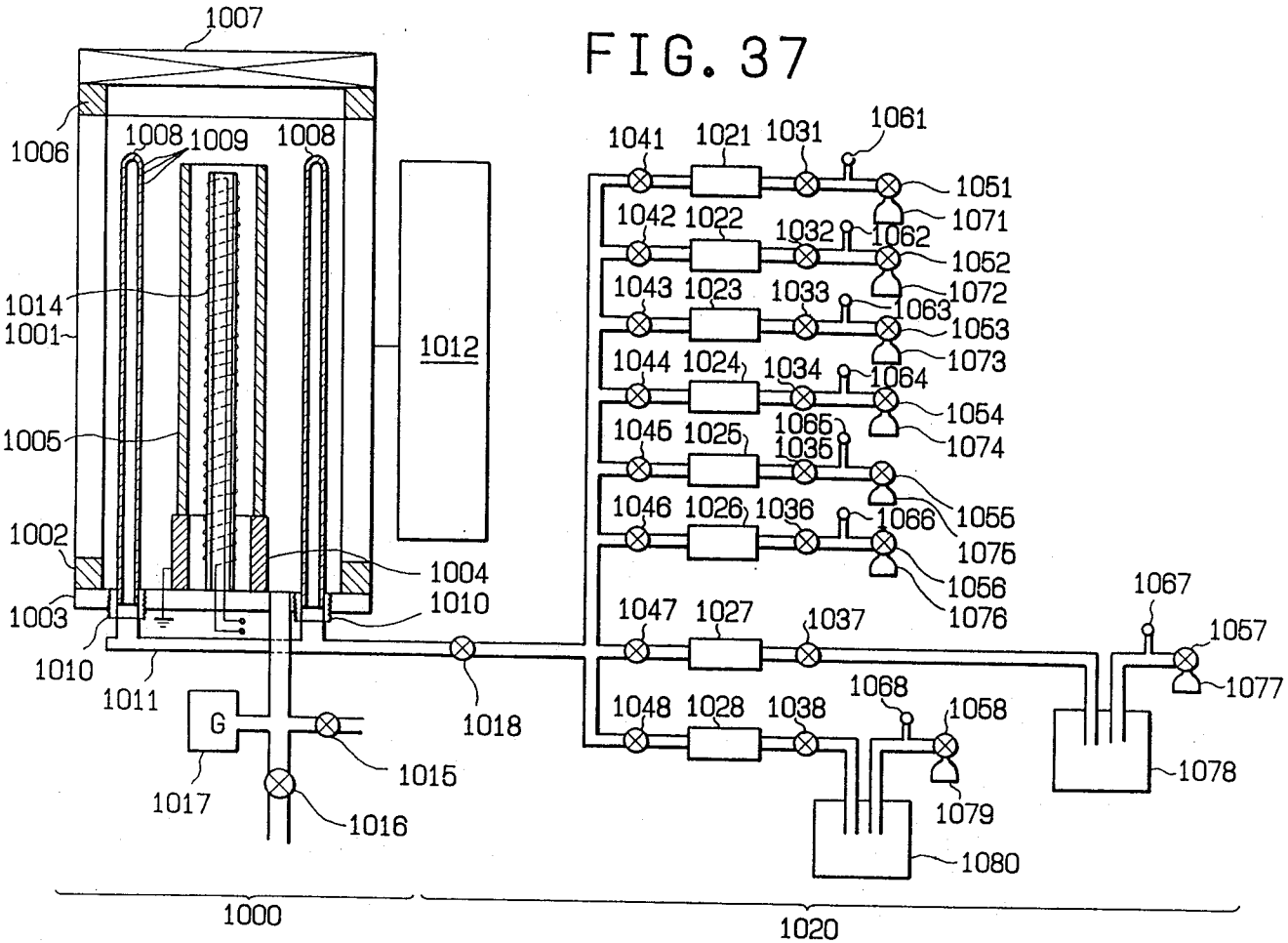
FIG. 37 is a schematic diagram illustrating an apparatus to form the light receiving layer of the light receiving member for electrophotography by RF glow discharge method according to the present invention.

FIG. 37 shows the apparatus for producing the light receiving member for electrophotography by the RF glow discharge decomposition method, said apparatus being composed of the raw material gas supply unit 1020 and the deposition unit 1000.

In FIG. 37, there are shown gas cylinders 1071, 1072, 1073, 1074, 1075, 1076, and 1077, and a closed vessel 1078. They contain raw material gases to form the layers according to the invention. The cylinder 1071 contains $SiH_4$ gas (99.99% pure); the cylinder 1072 contains $H_2$, gas (99.9999% pure); the cylinder 1073 contains $CH_4$ gas (99.999% pure); the cylinder 1074 contains $PH_3$ gas (99.999% pure) diluted with $H_2$ gas ("$PH_3/H_2$" for short hereinafter); the cylinder 1075 contains $B_2H_6$ gas (99.999% pure) with $H_2$ gas ("$B_2H_6/H_2$" for short hereinafter); the cylinder 1076 contains $N_2$ gas (99.9999% pure); the cylinder 1077 contains He gas (99.999% pure); and the closed vessel 1078 contains $AlCl_3$ (99.99% pure).

In FIG. 37, there is shown the cylindrical aluminum support 1005, 108 mm in outside diameter, having the mirror-finished surface.

With the valves 1031~1037, of the cylinders 1071~1077, the inlet valves 1031~1037, and the leak valve 1015 of the deposition chamber 1001 closed, and with the outlet valves 1041~1047 and the auxiliary valve 1018 open, the main valve 1016 was opened and the deposition chamber 1001 and the gas piping were evacuated by a vacuum pump (not shown).

When the vacuum gauge 1017 registered $1\times10^{-3}$ Torr, the auxiliary valve 1018 and the outlet valves 1041~1047 were closed.

After that, the valves 1061~1057 were opened to introduce $SiH_4$ gas from the cylinder 1071, $H_2$ gas from the cylinder 1072, $CH_4$ gas from the cylinder 1073, $PH_3/H_2$ gas from the cylinder 1074, $B_2H_6/H_2$ gas from the cylinder 1075, $N_2$ gas from the cylinder 1076, and He gas from the cylinder 1077. The pressure of each gas was maintained at 2 kg/cm$^2$ by means of the pressure regulators 1061~1067.

Then, the inlet valves 1031~1037 were opened to introduce the respective gases into the mass flow controller 1021~1027. Since He gas from the cylinder 1077 passes through the closed vessel containing $AlCl_3$ 1078, the $AlCl_3$ gas diluted with He gas ("$AlCl_3$/He" for short hereinafter) is introduced into the mass flow controller 1027.

The cylindrical aluminum support 1005 placed in the deposition chamber 1001 was heated to 250° C. by the heater 1014.

Now that the preparation for film forming was completed as mentioned above, the lower layer and upper layer were formed on the cylindrical aluminum support 1005.

The lower layer was formed as follows: The outlet valves 1041, 1042, and 1047, and the auxiliary valve 1018 were opened slowly to introduce $SiH_4$ gas, $H_2$ gas, and $AlCl_3$/He gas into the deposition chamber 1001 through the gas discharge hole 1009 on the gas introduction pipe 1008. The mass flow controllers 1021, 1022 and 1027 were adjusted so that the flow rate of $SiH_4$ gas was 50 SCCM, the flow rate of $H_2$ gas was 10 SCCM, and the flow rate of $AlCl_3$/He gas was 120 SCCM. The pressure in the deposition chamber 1001 was maintained at 0.4 Torr as indicated by the vacuum gauge 1071 by adjusting the opening of the main valve 1016. Then, the output of the RF power source (not shown) was set to 5 mW/cm$^3$, and RF power was applied to the deposition chamber 1001 through the high-frequency matching box 1012 in order to bring about RF glow discharge, thereby forming the lower layer on the aluminum support. While the lower layer was being formed, the mass flow controllers 1021, 1022, and 1027 were controlled so that the flow rate of $SiH_4$ gas remained constant at 50 SCCM, the flow rate of $H_2$ gas increased from 10 SCCM to 200 SCCM at a constant ratio, and the flow rate of $AlCl_3$/He decreased from 120 SCCM to 40 SCCM at a constant ratio. When the lower layer became 0.05 μm thick, the RF glow discharge was suspended, and the outlet valves 1041, 1042, and 1047 and the auxiliary valve 1018 were closed to stop the gases from flowing into the deposition chamber 1001. The formation of the lower layer was completed.

The first layer region of the upper layer was formed as follows: The outlet valves 1041 and 1042 and the auxiliary valve 1018 were slowly opened to introduce $SiH_4$ gas and $H_2$ gas into the deposition chamber 1001 through the gas discharge hole 1009 on the gas introduction pipe 1008. The mass flow controllers 1021 and 1022 were adjusted so that the flow rate of $SiH_4$ gas was 300 SCCM and the flow rate of $H_2$ gas was 300 SCCM. The pressure in the deposition chamber 1001 was maintained at 0.5 Torr as indicated by the vacuum gauge 1017 by adjusting the opening of the main valve 1016. Then, the output of the RF power source (not shown) was set to 15 mW/cm$^3$, and RF power was applied to the deposition chamber 1001 through the high-frequency matching box 1012 in order to bring about RF glow discharge, thereby forming the first layer region of the upper layer on the lower layer. When the first layer region of the upper layer became 20 μm thick, the RF glow discharge was suspended, and the outlet valves 1041 and 1042 and the auxiliary valve 1018 were closed to stop the gases from flowing into the deposition chamber 1001. The formation of the first layer region of the upper layer was completed.

The second layer region of the upper layer was formed as follows: The outlet valves 1041 and 1043 and the auxiliary valve 1018 were slowly opened to introduce $SiH_4$ gas and $CH_4$ gas into the deposition chamber 1001 through the gas discharge hole 1009 on the gas introduction pipe 1008. The mass flow controllers 1021 and 1023 were adjusted so that the flow rate of $SiH_4$ gas was 50 SCCM and the flow rate of $CH_4$ gas was 500 SCCM. The pressure in the deposition chamber 1001 was maintained at 0.4 Torr as indicated by the vacuum gauge 1017 by adjusting the opening of the main valve 1016. Then, the output of the RF power source (not shown) was set to 10 mW/cm$^3$, and RF power was applied to the deposition chamber 1001 through the high-frequency matching box 1012 in order to bring about RF glow discharge, thereby forming the second layer region on the first layer region of the upper layer. When the second layer region of the upper layer became 0.5 μm thick, the RF glow discharge was suspended, and the outlet valves 1041 and 1043 and the auxiliary valve 1018 were closed to stop the gases from flowing into the deposition chamber 1001. The formation of the second layer region of the upper layer was completed.

Table 1 shows the conditions under which the light receiving member for electrophotography was prepared as mentioned above.

It goes without saying that all the valves were kept closed completely except those for the gases necessary to form the individual layers. Before the switching of the gas, the system was completely evacuated, with the outlet valves 1041~1047 closed and the main valve and the auxiliary valve 1018 open, to prevent the gases from remaining in the deposition chamber 1001 and the piping leading from the outlet valves 1041~1047 to the deposition chamber 1001.

While the layer was being formed, the cylindrical aluminum support 1005 was turned at a prescribed speed by a drive unit (not shown) to ensure uniform deposition.

COMPARATIVE EXAMPLE 1

A light receiving member for electrophotography was prepared in the same manner as in Example 1, except that $H_2$ gas was not used when the lower layer was formed. Table 2 shows the conditions under which the light receiving member for electrophotography was prepared.

The light receiving members for electrophotography prepared in Example 1 and Comparative Example 1 were evaluated for electrophotographic characteristics under various conditions by running them on an experimental electrophotographic apparatus which is a remodeled version of Canon's duplicating machine NP-7550.

The light receiving member for electrophotography produced in Example 1 gave less than three-quarters the number of dots (especially those smaller than 0.1 mm in diameter) in the case of the light receiving member for electrophotography produced in Comparative Example 1. In addition, the degree of coarseness was evaluated by measuring the dispersion of the image density at 100 points in a circular region 0.05 mm in diameter. The light receiving member for electrophotography produced in Example 1 gave less than two-thirds the dispersion in the case of the light receiving member for electrophotography produced in Comparative Example 1. It was also visually recognized that the one in Example 1 was superior to the one in Comparative Example 1.

The light receiving member for electrophotography was also tested for whether it gives defective images or it suffers the peeling of the light receiving layer when it is subjected to an impactive mechanical pressure for a comparatively short time. This test was carried out by dropping stainless steel balls 3.5 mm in diameter onto the surface of the light receiving member for electrophotography from a height of 30 cm. The probability that cracking occurs in the light receiving layer was measured. The light receiving member for electrophotography in Example 1 gave a probability smaller than three-fifths that of the light receiving member for electrophotography in Comparative Example 1.

As mentioned above, the light receiving member for electrophotography in Example 1 was superior to the light receiving member for electrophotography in Comparative Example 1.

EXAMPLE 2

A light receiving member for electrophotography was produced in the same manner as in Example 1 except that the flow rate of $AlCl_3$/He gas for the lower layer was changed in a different manner. The conditions for production are shown in Table 3. According to the evaluation carried out in the same manner as in Example 1, it has improved performance for dots, coarseness, and layer peeling as in Example 1.

EXAMPLE 3

A light receiving member for electrophotography was produced in the same manner as in Example 1 except that the $CH_4$ gas was not used for the upper layer. The conditions for production are shown in Table 4. According to the evaluation carried out in the same manner as in Example 1, it has improved performance for dots, coarseness, and layer peeling as in Example 1.

EXAMPLE 4

A light receiving member for electrophotography was produced in the same manner as in Example 1 except that the $PH_3/H_2$ gas cylinder was replaced by an He gas (99.9999% pure) cylinder, the $B_2H_6/H_2$ gas cylinder was replaced by an NO gas (99.9% pure) cylinder, and the $H_2$ gas was replaced by He gas, and NO gas, $N_2$ gas, and $AlCl_3$/He gas were used for the upper layer. The conditions for production are shown in Table 5. According to the evaluation carried out in the same manner as in Example 1, it has improved performance for dots, coarseness, and layer peeling as in Example 1.

EXAMPLE 5

A light receiving member for electrophotography was produced in the same manner as in Example 1 except that the $PH_3/H_2$ gas cylinder was replaced by an Ar gas (99.9999% pure) cylinder, the $N_2$ gas cylinder was replaced by an $NH_3$ gas (99.999% pure) cylinder, and the $H_2$ gas was replaced by Ar gas and the $CH_4$ gas was replaced by $NH_3$, gas for the upper layer. The conditions for production are shown in Table 6. According to the evaluation carried out in the same manner as in Example 1, it has improved performance for dots, coarseness, and layer peeling as in Example 1.

EXAMPLE 6

A light receiving member for electrophotography was produced in the same manner as in Example 1 except that the $PH_3/H_2$ gas was additionally used for the upper layer. The conditions for production are shown in Table 7. According to the evaluation carried out in the same manner as in Example 1, it has improved performance for dots, coarseness, and layer peeling as in Example 1.

EXAMPLE 7

A light receiving member for electrophotography was produced in the same manner as in Example 1 except that the $N_2$ gas cylinder was replaced by an $SiF_4$ gas (99.999% pure) cylinder and $B_2H_6/H_2$ gas and $SiF_4$ gas were additionally used for the upper layer. The conditions for production are shown in Table 8. According to the evaluation carried out in the same manner as in Example 1, it has improved performance for dots, coarseness, and layer peeling as in Example 1.

EXAMPLE 8

A light receiving member for electrophotography was produced in the same manner as in Example 1 except that $PH_3/H_2$ gas and $N_2$ gas were additionally used for the upper layer. The conditions for production are shown in Table 9. According to the evaluation carried out in the same manner as in Example 1, it has improved performance for dots, coarseness, and layer peeling as in Example 1.

EXAMPLE 9

A light receiving member for electrophotography was produced in the same manner as in Example 1 except that the $CH_4$ gas cylinder was replaced by a $C_2H_4$ gas (99.9999% pure) cylinder and the $N_2$ gas cylinder was replaced by an NO gas cylinder, and the $CH_4$ gas was replaced by $C_2H_2$ gas and NO gas was additionally used for the upper layer. The conditions for production are shown in Table 10. According to the evaluation carried out in the same manner as in Example 1, it has improved performance for dots, coarseness, and layer peeling as in Example 1.

EXAMPLE 10

A light receiving member for electrophotography was produced in the same manner as in Example 1 under the conditions shown in Table 11. According to the evaluation carried out in the same manner as in Example 1, it has improved performance for dots, coarseness, and layer peeling as in Example 1.

EXAMPLE b 11

A light receiving member for electrophotography was produced in the same manner as in Example 1 except that the $N_2$ gas cylinder was replaced by an $NH_3$ gas (99.999% pure) cylinder, and the $CH_4$ gas was replaced by $NH_3$ gas for the upper layer. The conditions for production are shown in Table 12. According to the evaluation carried out in the same manner as in Example 1, it has improved performance for dots, coarseness, and layer peeling as in Example 1.

EXAMPLE 12

A light receiving member for electrophotography was produced in the same manner as in Example 6 except that the $N_2$ gas cylinder was replaced by an $SiF_4$ gas cylinder, and $SiF_4$ gas was additionally used for the upper layer. The conditions for production are shown in Table 13. According to the evaluation carried out in the same manner as in Example 6, it has improved performance for dots, coarseness, and layer peeling as in Example 6.

EXAMPLE 13

A light receiving member for electrophotography was produced in the same manner as in Example 9 except that $B_2H_6/H_2$ gas was additionally used for the upper layer. The conditions for production are shown in Table 14. According to the evaluation carried out in the same manner as in Example 9, it has improved performance for dots, coarseness, and layer peeling as in Example 9.

EXAMPLE 14

A light receiving member for electrophotography was produced in the same manner as in Example 11 except that $PH_3/H_4$ gas was additionally used for the upper layer. The conditions for production are shown in Table 15. According to the evaluation carried out in the same manner as in Example 11, it has improved performance for dots, coarseness, and layer peeling as in Example 11.

EXAMPLE 15

A light receiving member for electrophotography was produced in the same manner as in Example 1 except that the $N_2$ gas cylinder was replaced by a $GeH_4$ gas (99.999% pure) cylinder, and $GeH_4$ gas was additionally used for the upper layer. The conditions for production are shown in Table 16. According to the evaluation carried out in the same manner as in Example 1, it has improved performance for dots, coarseness, and layer peeling as in Example 1.

EXAMPLE 16

A light receiving member for electrophotography was produced in the same manner as in Example 1 except that the cylindrical aluminum support was replaced by the one having an outside diameter of 80 mm. The conditions for production are shown in Table 17. According to the evaluation carried out in the same manner as in Example 1, except that a remodeled version of Canon's duplicating machine NP-9030 was used, it has improved performance for dots, coarseness, and layer peeling as in Example 1.

EXAMPLE 17

A light receiving member for electrophotography was produced in the same manner as in Example 1 except that the cylindrical aluminum support was replaced by the one having an outside diameter of 60 mm. The conditions for production are shown in Table 18. According to the evaluation carried out in the same manner as in Example 1, except that a remodeled version of Canon's duplicating machine NP-150Z was used, it has improved performance for dots, coarseness, and layer peeling as in Example 1.

EXAMPLE 18

A light receiving member for electrophotography was produced in the same manner as in Example 1 except that the cylindrical aluminum support was replaced by the one having an outside diameter of 30 mm. The conditions for production are shown in Table 19. According to the evaluation carried out in the same manner as in Example 1, except that a remodeled version of Canon's duplicating machine FC-5 was used, it has improved performance for dots, coarseness, and layer peeling as in Example 1.

EXAMPLE 19

A light receiving member for electrophotography was produced in the same manner as in Example 1 except that the cylindrical aluminum support was replaced by the one having an outside diameter of 15 mm. The conditions for production are shown in Table 20. According to the evaluation carried out in the same manner as in Example 1, except that an experimentally constructed electrophotographic apparatus was used, it has improved performance for dots, coarseness, and layer peeling as in Example 1.

EXAMPLE 20

Figure 38:
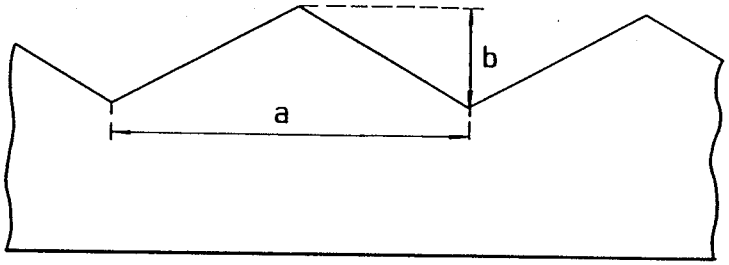
FIG. 38 is an enlarged sectional view of the aluminum support having a V-shape rugged surface which is used to form the light receiving member for electrophotography according to the present invention.

A light receiving member for electrophotography was produced in the same manner as in Example 16 except that the cylindrical aluminum support was replaced by a mirror-finished cylindrical aluminum support lathed by a diamond point tool, which has a cross section as shown in FIG. 38, in which a $=25$ μm and b $=0.8$ μm. According to the evaluation carried out in the same manner as in Example 16, it has improved performance for dots, coarseness, and layer peeling as in Example 16.

EXAMPLE 21

Figure 39:
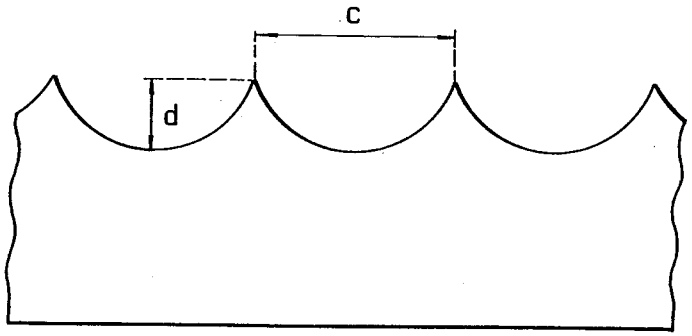
FIG. 39 is an enlarged sectional view of the aluminum support having a dimpled surface on which is used to form the light receiving member for electrophotography according to the present invention.

A light receiving member for electrophotography was produced in the same manner as in Example 16 except that the cylindrical aluminum support was replaced by a mirror-finished cylindrical aluminum support dimpled by falling bearing balls, which has a cross section as shown in FIG. 39, in which c $=50$ μm and d $=1$ μm. According to the evaluation carried out in the same manner as in Example 16, it has improved performance for dots, coarseness, and layer peeling as in Example 16.

EXAMPLE 22

A light receiving member for electrophotography was produced in the same manner as in Example 9 under the conditions shown in Table 21, except that the cylindrical aluminum support was kept at 500° C. and the upper layer was composed of poly-Si(H,X). According to the evaluation carried out in the same manner as in Example 9, it has improved performance for dots, coarseness, and layer peeling as in Example 9.

EXAMPLE 23

A light receiving member for electrophotography pertaining to the present invention was produced by the microwave glow discharge decomposition method.

Figure 40:
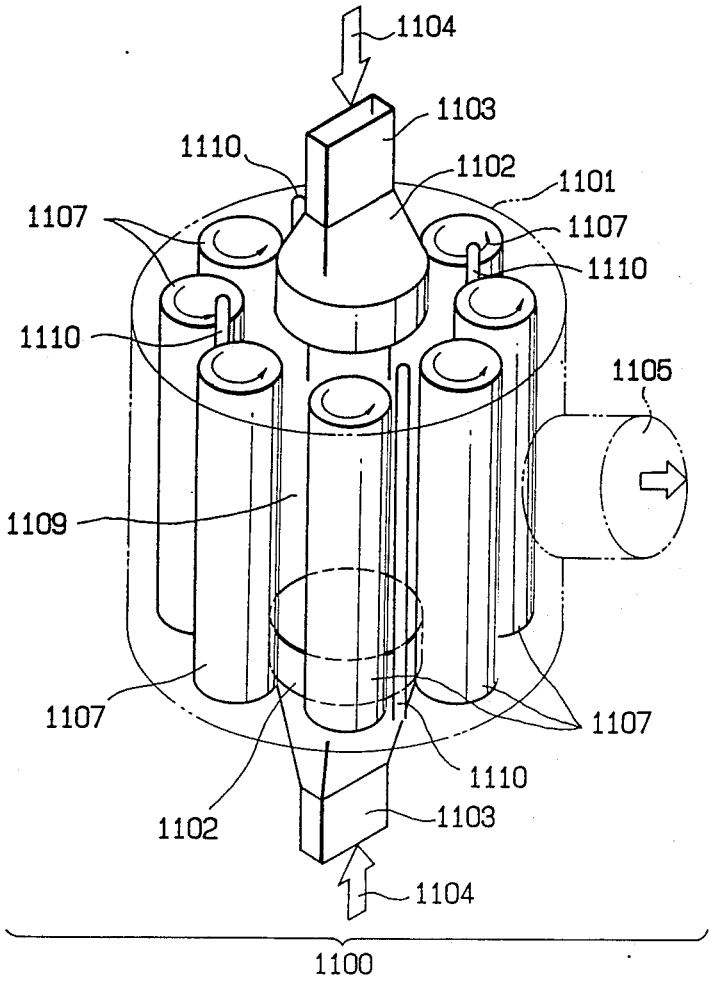
FIG. 40 is a schematic diagram of the depositing apparatus to form the light receiving layer of the light receiving member for electrophotography by microwave glow discharge method according to the present invention.
Figure 41:
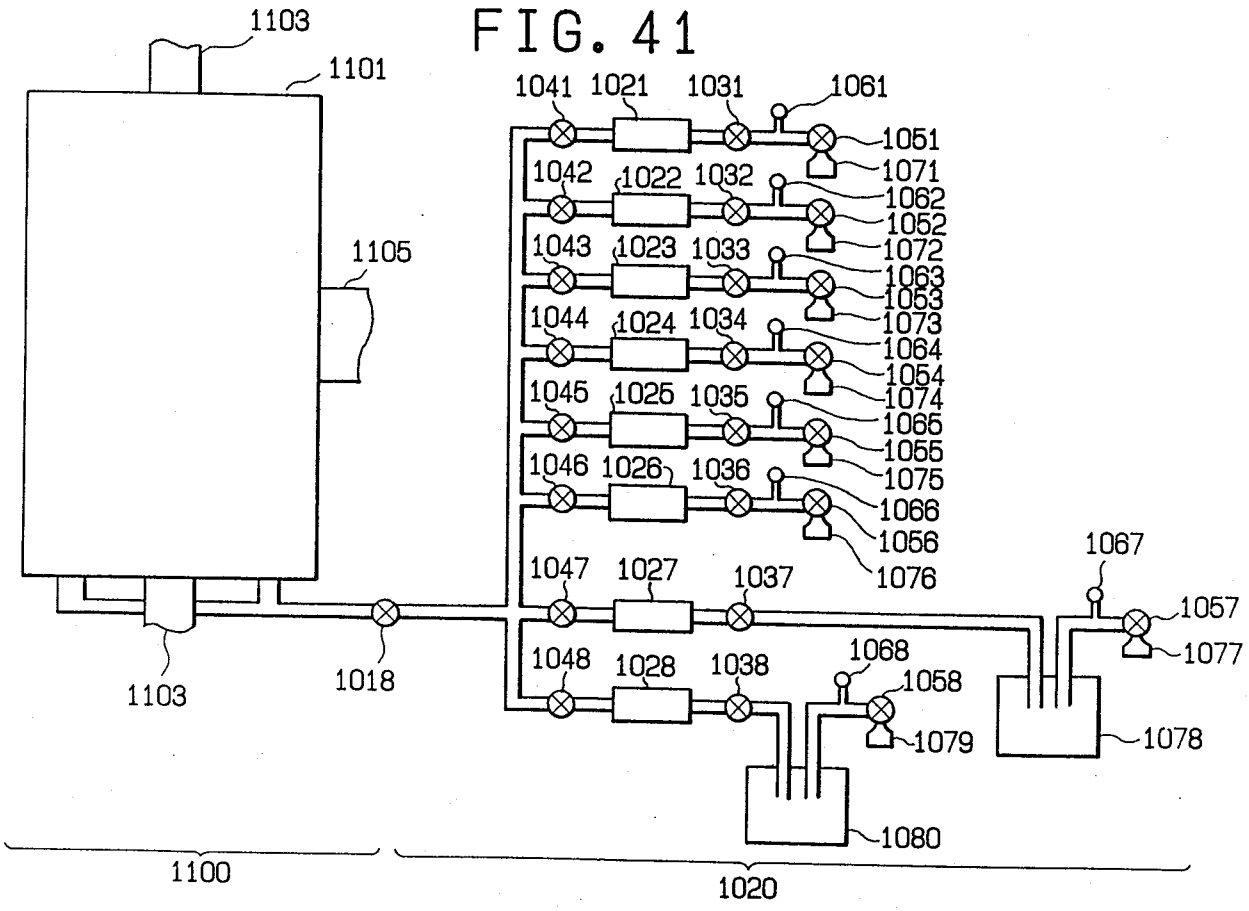
FIG. 41 is a schematic diagram of the apparatus to form the light receiving layer of the light receiving member for electrophotography by microwave glow discharge method according to the present invention.

FIG. 41 shows the apparatus for producing the light receiving member for electrophotography by the microwave glow discharge decomposition method. This apparatus differs from the apparatus for the RF glow discharge decomposition method as shown in FIG. 37 in that the deposition unit 1000 is replaced by the deposition unit 1100 for the microwave glow discharge decomposition method as shown in FIG. 40.

In FIG. 40, there is shown the cylindrical aluminum support 1107, 108 mm in outside diameter, having the mirror-finished surface.

As in Example 1, the deposition chamber 1101 and the gas piping were evacuated until the pressure in the deposition chamber 1101 reached $5\times10^{-6}$ Torr. Subsequently, the gases were introduced into the mass flow controllers 1021~1027 as in Example 1, except that the $N_2$ gas cylinder was replaced by an $SiF_4$ gas cylinder.

The cylindrical aluminum support II07 placed in the deposition chamber 1001 was heated to 250° C. by a heater (not shown).

Now that the preparation for film forming was completed as mentioned above, the lower layer and upper layer were formed on the cylindrical aluminum support 1107.

The lower layer was formed as follows: The outlet valves 1041, 1042, and 1047, and the auxiliary valve 1018 were opened slowly to introduce $SiH_4$ gas, $H_2$ gas, and $AlCl_3$ /He gas into the plasma generation region 1109 through the gas discharge hole (not shown) on the gas introduction pipe 1110. The mass flow controllers 1021, 1022, and 1027 were adjusted so that the flow rate of $SiH_4$ gas was 150 SCCM, the flow rate of $H_2$ gas was 20 SCCM, and the flow rate of $AlCl_3$/He gas was 400 SCCM. The pressure in the deposition chamber 1101 was maintained at 0.6 mTorr as indicated by the vacuum gauge (not shown) by adjusting the opening of the main valve (not shown). Then, the output of the microwave power source (not shown) was set to 0.5 W/cm$^3$, and microwave power was applied to the plasma generation region 1109 through the waveguide 1103 and the dielectric window 1102 in order to bring about microwave glow discharge, thereby forming the lower layer on the aluminum support 1107. While the lower layer was being formed, the mass flow controllers 1021, 1022, and 1027 were adjusted so that the flow rate of $SiH_4$ gas remained constant at 150 SCCM, the flow rate of $H_2$, gas increased from 20 SCCM to 500 SCCM at a constant ratio, and the flow rate of $AlCl_3$/He decreased from 400 SCCM to 80 SCCM at a constant ratio for the support side (0.01 μm) and the flow rate of $AlCl_3$/He decreased from 80 SCCM to 50 SCCM at a constant ratio for the upper layer side (0.01 μm). When the lower layer became 0.02 μm thick, the microwave glow discharge was suspended, and the outlet valves 1041, 1042, and 1047 and the auxiliary valve 1018 were closed to stop the gases from flowing into the plasma generation region 1109. The formation of the lower layer was completed.

The first layer region of the upper layer was formed as follows: The outlet valves 1041, 1042, and 1046, and the auxiliary valve 1018 were slowly opened to introduce $SiH_4$ gas, $H_2$ gas, and $SiF_4$ gas into the plasma generation space 1109 through the gas discharge hole (not shown) on the gas introduction pipe 1110. The mass flow controllers 1021, 1022, and 1026 were adjusted so that the flow rate of $SiH_4$ gas was 700 SCCM, the flow rate of $H_2$ gas was 500 SCCM, and the flow rate of $SiF_4$ gas was 30 SCCM. The pressure in the deposition chamber 1101 was maintained at 0.5 mTorr. Then, the output of the microwave power source (not shown) was set to 0.5 W/cm$^3$, and microwave power was applied to bring about microwave glow discharge in the plasma generation chamber 1109, as in the case of the lower layer, thereby forming the first layer region (20 μm thick) of the upper layer on the lower layer.

The second layer region of the upper layer was formed as follows: The outlet valves 1041 and 1043 and the auxiliary valve 1018 were slowly opened to introduce $SiH_4$ gas and $CH_4$ gas into the plasma generation space 1109 through the gas discharge hole (not shown) on the gas introduction pipe 1110. The mass flow controllers 1021 and 1023 were adjusted so that the flow rate of $SiH_4$ gas was 150 SCCM and the flow rate of $CH_4$ gas was 500 SCCM. The pressure in the deposition chamber 1101 was maintained at 0.3 mTorr. Then, the output of the microwave power source (not shown) was set to 0.5 W/cm$^3$, and microwave power was applied to bring about microwave glow discharge in the plasma generation region 1109, thereby forming the second layer region (1 μm thick) on the first layer region of the upper layer.

Table 22 shows the conditions under which the light receiving member for electrophotography was prepared as mentioned above.

According to the evaluation carried out in the same manner as in Example 1, it has improved performance for dots, coarseness, and layer peeling as in Example 1.

EXAMPLE 24

A light receiving member for electrophotography was prepared in the same manner as in Example 1, except that $B_2H_6$ gas was additionally used when the lower layer was formed. The conditions for production are shown in Table 23.

COMPARATIVE EXAMPLE 2

A light receiving member for electrophotography was prepared in the same manner as in Example 23, except that $B_2H_6/H_2$ gas and $H_2$ gas were not used when the lower layer was formed. The conditions for production are shown in Table 24.

The light receiving members for electrophotography prepared in Example 24 and Comparative Example 2 were evaluated for electrophotographic characteristics under various conditions by running them on an experimental electrophotographic apparatus which is a remodeled version of Canon's duplicating machine NP-7550.

The light receiving member for electrophotography produced in Example 24 gave less than three-quarters the number of dots (especially those smaller than 0.1 mm in diameter) in the case of the light receiving member for electrophotography produced in Comparative Example 2. In addition, the degree of coarseness was evaluated by measuring the dispersion of the image density at 100 points in a circular region 0.05 mm in diameter. The light receiving member for electrophotography produced in Example 24 gave less than a half the dispersion in the case of the light receiving member for electrophotography produced in Comparative Example 2. It was also visually recognized that the one in Example 24 was superior to the one in Comparative Example 2.

The light receiving member for electrophotography was also tested for whether it gives defective images or it suffers the peeling of the light receiving layer when it is subjected to an impactive mechanical pressure for a comparatively short time. This test was carried out by dropping stainless steel balls 3.5 mm in diameter onto the surface of the light receiving member for electrophotography from a height of 30 cm. The probability that cracking occurs in the light receiving layer was measured. The light receiving member for electrophotography in Example 4 gave a probability smaller than three-fifths that of the light receiving member for electrophotography in Comparative Example 2.

As mentioned above, the light receiving member for electrophotography in Example 24 was superior to the light receiving member for electrophotography in Comparative Example 2.

EXAMPLE 25

A light receiving member for electrophotography was produced in the same manner as in Example 24 except that the flow rate of $SiH_4$ gas, the flow rate of $H_2$ gas, and the flow rate of $AlCl_3$/He gas for the lower layer were changed in a different manner. The conditions for production are shown in Table 25. According to the evaluation carried out in the same manner as in Example 24, it has improved performance for dots, coarseness, and layer peeling as in Example 24.

EXAMPLE 26

A light receiving member for electrophotography was produced in the same manner as in Example 24 except that the $N_2$ gas cylinder was replaced by an $H_2S$ gas (99.5% pure) cylinder and the $CH_4$ gas was not used for the upper layer. The conditions for production are shown in Table 26. According to the evaluation carried out in the same manner as in Example 24, it has improved performance for dots, coarseness, and layer peeling as in Example 24.

EXAMPLE 27

A light receiving member for electrophotography was produced in the same manner as in Example 24 except that the $PH_3/H_2$ gas cylinder was replaced by an He gas (99.9999% pure) cylinder, and the $H_2$ gas cylinder was replaced by an NO gas (99.9% pure) gas cylinder and He gas, $N_2$ gas, $AlCl_3$/He gas, and $B_2H_6/H_2$ gas were used for the upper layer. The conditions for production are shown in Table 27. According to the evaluation carried out in the same manner as in Example 24, it has improved performance for dots, coarseness, and layer peeling as in Example 24.

EXAMPLE 28

A light receiving member for electrophotography was produced in the same manner as in Example 24 except that the $PH_3/H_2$ gas cylinder was replaced by an Ar gas (99.9999% pure) cylinder and the $N_2$ gas cylinder was replaced by $NH_3$ gas (99.999% pure) cylinder, and the $H_2$ gas was replaced by Ar gas and the $CH_4$ gas was replaced by $NH_3$ gas for the upper layer. The conditions for production are shown in Table 28. According to the evaluation carried out in the same manner as in Example 24, it has improved performance for dots, coarseness, and layer peeling as in Example 24.

EXAMPLE 29

A light receiving member for electrophotography was produced in the same manner as in Example 24 except that the $PH_3/H_2$ gas was additionally used for the upper layer. The conditions for production are shown in Table 29. According to the evaluation carried out in the same manner as in Example 24, it has improved performance for dots, coarseness, and layer peeling as in Example 24.

EXAMPLE 30

A light receiving member for electrophotography was produced in the same manner as in Example 24 except that the $N_2$ gas cylinder was replaced by an $SiF_4$ gas (99.999% pure) cylinder, and $B_2H_6/H_2$ gas and $SiF_4$ gas were additionally used for the upper layer. The conditions for production are shown in Table 30. According to the evaluation carried out in the same manner as in Example 24, it has improved performance for dots, coarseness, and layer peeling as in Example 24.

EXAMPLE 31

A light receiving member for electrophotography was produced in the same manner as in Example 24 except that $PH_3/H_2$ gas and $N_2$ gas were additionally used for the upper layer. The conditions for production are shown in Table 1. According to the evaluation carried out in the same manner as in Example 24, it has improved performance for dots, coarseness, and layer peeling as in Example 24.

EXAMPLE 32

A light receiving member for electrophotography was produced in the same manner as in Example 24 except that the $CH_4$ gas cylinder was replaced by a $C_2H_2$ gas (99.9999% pure) cylinder and the $N_2$ gas cylinder was replaced by an NO gas cylinder, and the $CH_4$ gas was replaced by $C_2H_2$ gas and NO gas was additionally used for the upper layer. The conditions for production are shown in Table 32. According to the evaluation carried out in the same manner as in Example 24, it has improved performance for dots, coarseness, and layer peeling as in Example 24.

EXAMPLE 33

A light receiving member for electrophotography was produced in the same manner as in Example 24 under the conditions shown in Table 33 for the upper layer. According to the evaluation carried out in the same manner as in Example 24, it has improved performance for dots, coarseness, and layer peeling as in Example 24.

EXAMPLE 34

A light receiving member for electrophotography was produced in the same manner as in Example 24 except that the $N_2$ gas cylinder was replaced by an $NH_3$ gas (99.999% pure) cylinder, and the $CH_4$ gas was replaced by $NH_3$ gas for the upper layer. The conditions for production are shown in Table 34. According to the evaluation carried out in the same manner as in Example 24, it has improved performance for dots, coarseness, and layer peeling as in Example 24.

EXAMPLE 35

A light receiving member for electrophotography was produced in the same manner as in Example 29 except that the $N_2$ gas cylinder was replaced by an $SiF_4$ gas cylinder, and $SiF_4$ gas was additionally used for the upper layer. The conditions for production are shown in Table 35. According to the evaluation carried out in the same manner as in Example 29, it has improved performance for dots, coarseness, and layer peeling as in Example 29.

EXAMPLE 36

A light receiving member for electrophotography was produced in the same manner as in Example 32 except that $B_2H_6/H_2$ gas and $Si_2H_6$ gas (99.99% pure) were additionally used for the upper layer. The conditions for production are shown in Table 36. According to the evaluation carried out in the same manner as in Example 32, it has improved performance for dots, coarseness, and layer peeling as in Example 32.

EXAMPLE 37

A light receiving member for electrophotography was produced in the same manner as in Example 34 except that $PH_3/H_2$ gas was additionally used for the upper layer. The conditions for production are shown in Table 37. According to the evaluation carried out in the same manner as in Example 34, it has improved performance for dots, coarseness, and layer peeling as in Example 34.

EXAMPLE 38

A light receiving member for electrophotography was produced in the same manner as in Example 24 except that the $N_2$ gas cylinder was replaced by a $GeH_4$ gas (99.999% pure) cylinder, and $GeH_4$ gas was additionally used for the upper layer. The conditions for production are shown in Table 38. According to the evaluation carried out in the same manner as in Example 24, it has improved performance for dots, coarseness, and layer peeling as in Example 24.

EXAMPLE 39

A light receiving member for electrophotography was produced in the same manner as in Example 24 except that the cylindrical aluminum support was replaced by the one having an outside diameter of 80 mm. The conditions for production are shown in Table 39. According to the evaluation carried out in the same manner as in Example 24, except that a remodeled version of Canon's duplicating machine NP-9030 was used, it has improved performance for dots, coarseness, and layer peeling as in Example 24.

EXAMPLE 40

A light receiving member for electrophotography was produced in the same manner as in Example 24 except that the cylindrical aluminum support was replaced by the one having an outside diameter of 60 mm. The conditions for production are shown in Table 40. According to the evaluation carried out in the same manner as in Example 24, except that a remodeled version of Canon's duplicating machine NP-150Z was used, it has improved performance for dots, coarseness, and layer peeling as in Example 24.

Example 41

A light receiving member for electrophotography was produced in the same manner as in Example 24 except that the cylindrical aluminum support was replaced by the one having an outside diameter of 30 mm. The conditions for production are shown in Table 41. According to the evaluation carried out in the same manner as in Example 24, except that a remodeled version of Canon's duplicating machine FC-5 was used, it has improved performance for dots, coarseness, and layer peeling as in Example 24.

EXAMPLE 42

A light receiving member for electrophotography was produced in the same manner as in Example 24 except that the cylindrical aluminum support was replaced by the one having an outside diameter of 15 mm. The conditions for production are shown in Table 42. According to the evaluation carried out in the same manner as in Example 24, except that an experimentally constructed electrophotographic apparatus was used, it has improved performance for dots, coarseness, and layer peeling as in Example 24.

EXAMPLE 43

A light receiving member for electrophotography was produced in the same manner as in Example 39 except that the cylindrical aluminum support was replaced by a mirror-finished cylindrical aluminum support lathed by a diamond point tool, which has a cross section as shown in FIG. 38, in which a $=25$ μm and b $=0.8$ μm. According to the evaluation carried out in the same manner as in Example 39, it has improved performance for dots, coarseness, and layer peeling as in Example 39.

EXAMPLE 44

A light receiving member for electrophotography was produced in the same manner as in Example 39 except that the cylindrical aluminum support was replaced by a mirror-finished cylindrical aluminum support dimpled by falling bearing balls, which has a cross section as shown in FIG. 39, in which c $=50$ μm and d $=1$ μm. According to the evaluation carried out in the same manner as in Example 39, it has improved performance for dots, coarseness, and layer peeling as in Example 39.

EXAMPLE 45

A light receiving member for electrophotography was produced in the same manner as in Example 32 except that the cylindrical aluminum support was kept at 500° C. and the upper layer was composed of poly-Si(H,X). According to the evaluation carried out in the same manner as in Example 32, it has improved performance for dots, coarseness, and layer peeling as in Example 32.

EXAMPLE 46

A light receiving member for electrophotography was prepared by the microwave glow discharge decomposition method in the same manner as in Example 23, except that $H_2S$ gas and $PH_3$ gas were additionally used when the lower layer was formed. The conditions for production are shown in Table 44. According to the evaluation carried out in the same manner as in Example 24, it has improved performance for dots, coarseness, and layer peeling as in Example 24.

EXAMPLE 47

A light receiving member for electrophotography was prepared in the same manner as in Example 1, except that NO gas was additionally used when the lower layer was formed. The conditions for production are shown in Table 45.

COMPARATIVE EXAMPLE 3

A light receiving member for electrophotography was prepared in the same manner as in Example 47, except that $H_2$ gas and NO gas were not used when the lower layer was formed. The conditions for production are shown in Table 46.

The light receiving members for electrophotography prepared in Example 47 and Comparative Example 3 were evaluated for electrophotographic characteristics under various conditions by running them on an experimental electrophotographic apparatus which is a remodeled version of Canon's duplicating machine NP-7550.

The light receiving member for electrophotography produced in Example 47 gave less than three-quarters the number of dots (especially those smaller than 0.1 mm in diameter) in the case of the light receiving member for electrophotography produced in Comparative Example 3. In addition, the degree of coarseness was evaluated by measuring the dispersion of the image density at 100 points in a circular region 0.05 mm in diameter. The light receiving member for electrophotography produced in Example 47 gave less than a half the dispersion in the case of the light receiving member for electrophotography produced in Comparative Example 3. It was also visually recognized that the one in Example 47 was superior to the one in Comparative Example 3.

The light receiving member for electrophotography was also tested for whether it gives defective images or it suffers the peeling of the light receiving layer when it is subjected to an impactive mechanical pressure for a comparatively short time. This test was carried out by dropping stainless steel balls 3.5 mm in diameter onto the surface of the light receiving member for electrophotography from a height of 30 cm. The probability that cracking occurs in the light receiving layer was measured. The light receiving member for electrophotography in Example 47 gave a probability smaller than two-fifths that of the light receiving member for electrophotography in Comparative Example 3.

As mentioned above, the light receiving member for electrophotography in Example 47 was superior to the light receiving member for electrophotography in Comparative Example 3.

EXAMPLE 48

A light receiving member for electrophotography was produced in the same manner as in Example 47 except that the flow rate of $AlCl_3$/He gas for the lower layer was changed in a different manner. The conditions for production are shown in Table 47. According to the evaluation carried out in the same manner as in Example 47, it has improved performance for dots, coarseness, and layer peeling as in Example 47.

EXAMPLE 49

A light receiving member for electrophotography was produced in the same manner as in Example 47 except that the $CH_4$ gas was not used for the upper layer. The conditions for production are shown in Table 48. According to the evaluation carried out in the same manner as in Example 47, it has improved performance for dots, coarseness, and layer peeling as in Example 47.

EXAMPLE 50

A light receiving member for electrophotography was produced in the same manner as in Example 47 except that the $PH_3/H_2$ gas cylinder was replaced by an He gas (99.9999% pure) cylinder, and the $H_2$ gas cylinder was replaced by a NO gas (99.9% pure) cylinder and He gas, $N_2$ gas, $AlCl_3$/He gas, and $B_2H_6/H_2$ gas were used for the upper layer. The conditions for production are shown in Table 49. According to the evaluation carried out in the same manner as in Example 47, it has improved performance for dots, coarseness, and layer peeling as in Example 47.

EXAMPLE 51

A light receiving member for electrophotography was produced in the same manner as in Example 47 except that the $PH_3/H_2$ gas cylinder was replaced by an Ar gas (99.9999% pure) cylinder, the $B_2H_6/H_2$ gas cylinder was replaced by an $NH_3$ gas (99.999% pure) cylinder, and the $H_2$ gas was replaced by Ar gas and the $CH_4$ gas was replaced by $NH_3$ gas for the upper layer. The conditions for production are shown in Table 50. According to the evaluation carried out in the same manner as in Example 47, it has improved performance for dots, coarseness, and layer peeling as in Example 47.

EXAMPLE 52

A light receiving member for electrophotography was produced in the same manner as in Example 47 except that $PH_3/H_2$ gas was additionally used for the upper layer. The conditions for production are shown in Table 51. According to the evaluation carried out in the same manner as in Example 47, it has improved performance for dots, coarseness, and layer peeling as in Example 47.

EXAMPLE 53

A light receiving member for electrophotography was produced in the same manner as in Example 47 except that $B_2H_6/H_2$ gas and $SiF_4$ gas (99.999% pure) (not shown) were additionally used for the upper layer. The conditions for production are shown in Table 52. According to the evaluation carried out in the same manner as in Example 47, it has improved performance for dots, coarseness, and layer peeling as in Example 47.

EXAMPLE 54

A light receiving member for electrophotography was produced in the same manner as in Example 47 except that $PH_3/H_2$ gas and $N_2$ gas were additionally used for the upper layer. The conditions for production are shown in Table 53. According to the evaluation carried out in the same manner as in Example 47, it has improved performance for dots, coarseness, and layer peeling as in Example 47.

EXAMPLE 55

A light receiving member for electrophotography was produced in the same manner as in Example 47 except that the $CH_4$ gas cylinder was replaced by a $C_2H_2$ gas (99.9999% pure) cylinder and the $N_2$ gas cylinder was replaced by an NO gas cylinder, and the $CH_4$ gas was replaced by $C_2H_2$ gas and NO gas was additionally used for the upper layer. The conditions for production are shown in Table 54. According to the evaluation carried out in the same manner as in Example 47, it has improved performance for dots, coarseness, and layer peeling as in Example 47.

EXAMPLE 56

A light receiving member for electrophotography was produced in the same manner as in Example 47 under the conditions shown in Table 55. According to the evaluation carried out in the same manner as in Example 47, it has improved performance for dots, coarseness, and layer peeling as in Example 47.

EXAMPLE 57

A light receiving member for electrophotography was produced in the same manner as in Example 47 except that the $PH_3/H_2$ gas cylinder was replaced by an $NH_3$ gas (99.999% pure) cylinder, and the $CH_4$ gas was replaced by $NH_3$ gas for the upper layer. The conditions for production are shown in Table 56. According to the evaluation carried out in the same manner as in Example 47, it has improved performance for dots, coarseness, and layer peeling as in Example 47.

EXAMPLE 58

A light receiving member for electrophotography was produced in the same manner as in Example 52 except that $SiF_4$ gas was additionally used for the upper layer. The conditions for production are shown in Table 57. According to the evaluation carried out in the same manner as in Example 52, it has improved performance for dots, coarseness, and layer peeling as in Example 52.

EXAMPLE 59

A light receiving member for electrophotography was produced in the same manner as in Example 55 except that $B_2H_6/H_2$gas and $Si_2H_6$ gas were additionally used for the upper layer. The conditions for production are shown in Table 58. According to the evaluation carried out in the same manner as in Example 55, it has improved performance for dots, coarseness, and layer peeling as in Example 55.

EXAMPLE 60

A light receiving member for electrophotography was produced in the same manner as in Example 57 except that $PH_3/H_2$ gas was additionally used for the upper layer. The conditions for production are shown in Table 59. According to the evaluation carried out in the same manner as in Example 57, it has improved performance for dots, coarseness, and layer peeling as in Example 57.

EXAMPLE 61

A light receiving member for electrophotography was produced in the same manner as in Example 47 except that the $B_2H_6/H_2$ gas cylinder was replaced by a $GeH_4$ gas (99.999% pure) cylinder, and $GeH_4$ gas was additionally used for the upper layer. The conditions for production are shown in Table 60. According to the evaluation carried out in the same manner as in Example 47, it has improved performance for dots, coarseness, and layer peeling as in Example 47.

EXAMPLE 62

A light receiving member for electrophotography was produced in the same manner as in Example 47 except that the cylindrical aluminum support was replaced by the one having an outside diameter of 80 mm. The conditions for production are shown in Table 61. According to the evaluation carried out in the same manner as in Example 47, except that a remodeled version of Canon's duplicating machine NP-9030 was used, it has improved performance for dots, coarseness, and layer peeling as in Example 47.

EXAMPLE 63

A light receiving member for electrophotography was produced in the same manner as in Example 47 except that the cylindrical aluminum support was replaced by the one having an outside diameter of 60 mm. The conditions for production are shown in Table 62. According to the evaluation carried out in the same manner as in Example 47, except that a remodeled version of Canon's duplicating machine NP-150Z was used, it has improved performance for dots, coarseness, and layer peeling as in Example 47.

EXAMPLE 64

A light receiving member for electrophotography was produced in the same manner as in Example 47 except that the cylindrical aluminum support was replaced by the one having an outside diameter of 30 mm. The conditions for production are shown in Table 63. According to the evaluation carried out in the same manner as in Example 47, except that a remodeled version of Canon's duplicating machine FC-5 was used, it has improved performance for dots, coarseness, and layer peeling as in Example 47.

EXAMPLE 65

A light receiving member for electrophotography was produced in the same manner as in Example 47 except that the cylindrical aluminum support was replaced by the one having an outside diameter of 15 mm. The conditions for production are shown in Table 64. According to the evaluation carried out in the same manner as in Example 47, except that an experimentally constructed electrophotographic apparatus was used, it has improved performance for dots, coarseness, and layer peeling as in Example 47.

EXAMPLE 66

A light receiving member for electrophotography was produced in the same manner as in Example 62 except that the cylindrical aluminum support was replaced by a mirror-finished cylindrical aluminum support lathed by a diamond point tool, which has a cross section as shown in FIG. 38, in which a $=25$ μm and b $=0.8$ μm. According to the evaluation carried out in the same manner as in Example 62, it has improved performance for dots, coarseness, and layer peeling as in Example 62.

EXAMPLE 67

A light receiving member for electrophotography was produced in the same manner as in Example 62 except that the cylindrical aluminum support was replaced by a mirror-finished cylindrical aluminum support dimpled by falling bearing balls, which has a cross section as shown in FIG. 39, in which c $=50$ μm and d $=1$ μm. According to the evaluation carried out in the same manner as in Example 62, it has improved performance for dots, coarseness, and layer peeling as in Example 62.

EXAMPLE 68

A light receiving member for electrophotography was produced in the same manner as in Example 55 under the conditions shown in Table 65, except that the cylindrical aluminum support was kept at 500° C and the upper layer was composed of poly-Si(H,X). According to the evaluation carried out in the same manner as in Example 55, it has improved performance for dots, coarseness, and layer peeling as in Example 55.

EXAMPLE 69

A light receiving member for electrophotography was prepared by the microwave glow discharge decomposition method in the same manner as in Example 23, except that NO gas and $PH_3$ gas were additionally used when the lower layer was formed. The conditions for production are shown in Table 66. According to the evaluation carried out in the same manner as in Example 47, it has improved performance for dots, coarseness, and layer peeling as in Example 47.

EXAMPLE 70

A light receiving member for electrophotography was prepared in the same manner as in Example 1, except that $SiF_4$ gas and NO gas were additionally used when the lower layer was formed. The conditions for production are shown in Table 67.

COMPARATIVE EXAMPLE 4

A light receiving member for electrophotography was prepared in the same manner as in Example 70, except that $SiF_4$ gas, $H_2$ gas, and NO gas were not used when the lower layer was formed. The conditions for production are shown in Table 68.

The light receiving members for electrophotography prepared in Example 70 and Comparative Example 4 were evaluated for electrophotographic characteristics under various conditions by running them on an experimental electrophotographic apparatus which is a remodeled version of Canon's duplicating machine NP-7550.

The light receiving member for electrophotography produced in Example 70 gave less than a half the number of dots (especially those smaller than 0.1 mm in diameter) in the case of the light receiving member for electrophotography produced in Comparative Example 4. In addition, the degree of coarseness was evaluated by measuring the dispersion of the image density at 100 points in a circular region 0.05 mm in diameter. The light receiving member for electrophotography produced in Example 70 gave less than a half the dispersion in the case of the light receiving member for electrophotography produced in Comparative Example 4. It was also visually recognized that the one in Example 70 was superior to the one in Comparative Example 4.

The light receiving member for electrophotography was also tested for whether it gives defective images or it suffers the peeling of the light receiving layer when it is subjected to an impactive mechanical pressure for a comparatively short time. This test was carried out by dropping stainless steel balls 3.5 mm in diameter onto the surface of the light receiving member for electrophotography from a height of 30 cm. The probability that cracking occurs in the light receiving layer was measured. The light receiving member for electrophotography in Example 70 gave a probability smaller than two-fifths that of the light receiving member for electrophotography in Comparative Example 4.

As mentioned above, the light receiving member for electrophotography in Example 70 was superior to the light receiving member for electrophotography in Comparative Example 4.

EXAMPLE 71

A light receiving member for electrophotography was produced in the same manner as in Example 70 except that the NO gas not used for the lower layer and the flow rate of $AlCl_3$/He gas for the lower layer was changed in a different manner. The conditions for production are shown in Table 69. According to the evaluation carried out in the same manner as in Example 70, it has improved performance for dots, coarseness, and layer peeling as in Example 70.

EXAMPLE 72

A light receiving member for electrophotography was produced in the same manner as in Example 70 except that the $CH_4$ gas cylinder was replaced by an $H_2$ gas (99.9% pure) cylinder. The conditions for production are shown in Table 70. According to the evaluation carried out in the same manner as in Example 70, it has improved performance for dots, coarseness, and layer peeling as in Example 70.

EXAMPLE 73

A light receiving member for electrophotography was produced in the same manner as in Example 70 except that $N_2$ gas (99.9999% pure) and He gas (99.9999% pure) were used. The conditions for production are shown in Table 71. According to the evaluation carried out in the same manner as in Example 70, it has improved performance for dots, coarseness, and layer peeling as in Example 70.

EXAMPLE 74

A light receiving member for electrophotography was produced in the same manner as in Example 70 except that $AlCl_3$ was replaced by $Al(CH_3)_3$ (99.99% pure) for the lower layer, and the $SiF_4$ gas cylinder was replaced by an Ar gas (99.9999% pure) cylinder and the NO gas cylinder was replaced by an $NH_3$ gas (99.999% pure) cylinder. The conditions for production are shown in Table 72. According to the evaluation carried out in the same manner as in Example 70, it has improved performance for dots, coarseness, and layer peeling as in Example 70.

EXAMPLE 75

A light receiving member for electrophotography was produced in the same manner as in Example 70 except that the $PH_3/H_2$ gas (99.99%) was additionally used for the upper layer. The conditions for production are shown in Table 73. According to the evaluation carried out in the same manner as in Example 70, it has improved performance for dots, coarseness, and layer peeling as in Example 70.

EXAMPLE 76

A light receiving member for electrophotography was produced in the same manner as in Example 70 except that $PH_3/H_2$ gas was used for the lower layer and $B_2H_6/H_2$ gas and $SiF_4$ gas were additionally used for the upper layer. The conditions for production are shown in Table 74. According to the evaluation carried out in the same manner as in Example 70, it has improved performance for dots, coarseness, and layer peeling as in Example 70.

EXAMPLE 77

A light receiving member for electrophotography was produced in the same manner as in Example 70 except that $CH_4$ gas and $H_2$ S gas were used for the lower layer and $PH_3/H_2$ gas and $N_2$ gas were additionally used for the upper layer. The conditions for production are shown in Table 75. According to the evaluation carried out in the same manner as in Example 70, it has improved performance for dots, coarseness, and layer peeling as in Example 70.

EXAMPLE 78

A light receiving member for electrophotography was produced in the same manner as in Example 70 except that the $CH_4$ gas cylinder was replaced by a $C_2H_2$ gas (99.9999% pure) cylinder. The conditions for production are shown in Table 76. According to the evaluation carried out in the same manner as in Example 70, it has improved performance for dots, coarseness, and layer peeling as in Example 70.

EXAMPLE 79

A light receiving member for electrophotography was produced in the same manner as in Example 70 under the conditions shown in Table 77, except that $PF_5$ gas diluted with He (99.999% pure, "$PF_5$/He" for short hereinafter) was used for the lower layer. According to the evaluation carried out in the same manner as in Example 70, it has improved performance for dots, coarseness, and layer peeling as in Example 70.

EXAMPLE 80

A light receiving member for electrophotography was produced in the same manner as in Example 70 except that the NO gas cylinder was replaced by an $NH_3$ gas cylinder, and the $CH_4$ gas was replaced by $NH_3$ gas for the upper layer. The conditions for production are shown in Table 78. According to the evaluation carried out in the same manner as in Example 70, it has improved performance for dots, coarseness, and layer peeling as in Example 70.

EXAMPLE 81

A light receiving member for electrophotography was produced in the same manner as in Example 75 except that the $B_2H_6$ gas was replaced by $BF_5$ gas diluted with He (99.999% pure, "$BF_5$/He" for short hereinafter) was used for the lower layer and $SiF_4$ gas was additionally used for the upper layer. The conditions for production are shown in Table 79. According to the evaluation carried out in the same manner as in Example 75, it has improved performance for dots, coarseness, and layer peeling as in Example 75.

EXAMPLE 82

A light receiving member for electrophotography was produced in the same manner as in Example 70 except that the $Si_2F_6$ gas (99.99% pure) was replaced by $SiF_4$ gas for the lower layer and $B_2H_6$ gas (99.99% pure) was additionally used for the upper layer. The conditions for production are shown in Table 80. According to the evaluation carried out in the same manner as in Example 70, it has improved performance for dots, coarseness, and layer peeling as in Example 70.

EXAMPLE 83

A light receiving member for electrophotography was produced in the same manner as in Example 70 except that $Si_2F_6$ gas was used for the lower layer. The conditions for production are shown in Table 81. According to the evaluation carried out in the same manner as in Example 70, it has improved performance for dots, coarseness, and layer peeling as in Example 70.

EXAMPLE 84

A light receiving member for electrophotography was produced in the same manner as in Example 70 except that the NO gas cylinder was replaced by a $GeH_4$ gas (99.999% pure) cylinder, and $GeH_4$ gas was additionally used for the upper layer. The conditions for production are shown in Table 82. According to the evaluation carried out in the same manner as in Example 70, it has improved performance for dots, coarseness, and layer peeling as in Example 70.

EXAMPLE 85

A light receiving member for electrophotography was produced in the same manner as in Example 70 except that the cylindrical aluminum support was replaced by the one having an outside diameter of 80 mm. The conditions for production are shown in Table 83. According to the evaluation carried out in the same manner as in Example 70, except that a remodeled version of Canon's duplicating machine NP-9030 was used, it has improved performance for dots, coarseness, and layer peeling as in Example 70.

EXAMPLE 86

A light receiving member for electrophotography was produced in the same manner as in Example 70 except that the cylindrical aluminum support was replaced by the one having an outside diameter of 60 mm. The conditions for production are shown in Table 84. According to the evaluation carried out in the same manner as in Example 70, except that a remodeled version of Canon's duplicating machine NP-150Z was used, it has improved performance for dots, coarseness, and layer peeling as in Example 70.

EXAMPLE 87

A light receiving member for electrophotography was produced in the same manner as in Example 70 except that the cylindrical aluminum support was replaced by the one having an outside diameter of 30 mm. The conditions for production are shown in Table 85. According to the evaluation carried out in the same manner as in Example 70, except that a remodeled version of Canon's duplicating machine FC-5 was used, it has improved performance for dots, coarseness, and layer peeling as in Example 70.

EXAMPLE 88

A light receiving member for electrophotography was produced in the same manner as in Example 70 except that the cylindrical aluminum support was replaced by the one having an outside diameter of 15 mm. The conditions for production are shown in Table 86. According to the evaluation carried out in the same manner as in Example 70, except that an experimentally constructed electrophotographic apparatus was used, it has improved performance for dots, coarseness, and layer peeling as in Example 70.

EXAMPLE 89

A light receiving member for electrophotography was produced in the same manner as in Example 85 except that the cylindrical aluminum support was replaced by a mirror-finished cylindrical aluminum support lathed by a diamond point tool, which has a cross section as shown in FIG. 38, in which a $=25$ μm and b $=0.8$ μm. According to the evaluation carried out in the same manner as in Example 85, it has improved performance for dots, coarseness, and layer peeling as in Example 85.

EXAMPLE 90

A light receiving member for electrophotography was produced in the same manner as in Example 85 except that the cylindrical aluminum support was replaced by a mirror-finished cylindrical aluminum support dimpled by falling bearing balls, which has a cross section as shown in FIG. 39, in which c $=50$ μm and d $=1$ μm. According to the evaluation carried out in the same manner as in Example 85, it has improved performance for dots, coarseness, and layer peeling as in Example 85.

EXAMPLE 91

A light receiving member for electrophotography was produced in the same manner as in Example 78 under the conditions shown in Table 87, except that the cylindrical aluminum support was kept at 500° C. and the upper layer was composed of poly-Si(H,X). According to the evaluation carried out in the same manner as in Example 78, it has improved performance for dots, coarseness, and layer peeling as in Example 78.

EXAMPLE 92

A light receiving member for electrophotography was prepared by the microwave glow discharge decomposition method in the same manner as in Example 23, except that $SiF_4$ gas, NO gas, and $PH_3$ gas were additionally used when the lower layer was formed. The conditions for production are shown in Table 88. According to the evaluation carried out in the same manner as in Example 70, it has improved performance for dots, coarseness, and layer peeling as in Example 70.

EXAMPLE 93

A light receiving member for electrophotography was prepared in the same manner as in Example 1, except that $GeH_4$ gas was additionally used when the lower layer was formed. The conditions for production are shown in Table 89.

COMPARATIVE EXAMPLE 5

A light receiving member for electrophotography was prepared in the same manner as in Example 93, except that $GeH_4$ gas and $H_2$ gas were not used when the lower layer was formed. The conditions for production are shown in Table 90.

The light receiving members for electrophotography prepared in Example 93 and Comparative Example 5 were evaluated for electrophotographic characteristics under various conditions by running them on an experimental electrophotographic apparatus which is a remodeled version of Canon's duplicating machine NP-7550.

The light receiving member for electrophotography produced in Example 93 gave less than two-fifths the number of dots (especially those smaller than 0.1 mm in diameter) in the case of the light receiving member for electrophotography produced in Comparative Example 5. In addition, the degree of coarseness was evaluated by measuring the dispersion of the image density at 100 points in a circular region 0.05 mm in diameter. The light receiving member for electrophotography produced in Example 93 gave less than one-third the dispersion in the case of the light receiving member for electrophotography produced in Comparative Example 5. It was also visually recognized that the one in Example 93 was superior to the one in Comparative Example 5.

The light receiving member for electrophotography was also tested for whether it gives defective images or it suffers the peeling of the light receiving layer when it is subjected to an impactive mechanical pressure for a comparatively short time. This test was carried out by dropping stainless steel balls 3.5 mm in diameter onto the surface of the light receiving member for electrophotography from a height of 30 cm. The probability that cracking occurs in the light receiving layer was measured. The light receiving member for electrophotography in Example 93 gave a probability smaller than one-third that of the light receiving member for electrophotography in Comparative Example 5.

The lower layer of the light receiving member for electrophotography prepared in Example 93 was analyzed by SIMS. It was found that silicon atoms, hydrogen atoms, and aluminum atoms are distributed in the layer thickness direction as intended.

As mentioned above, the light receiving member for electrophotography in Example 93 was superior to the light receiving member for electrophotography in Comparative Example 5.

EXAMPLE 94

A light receiving member for electrophotography was produced in the same manner as in Example 93 except that the flow rate of $AlCl_3$/He gas for the lower layer was changed in a different manner. The conditions for production are shown in Table 91. According to the evaluation carried out in the same manner as in Example 93, it has improved performance for dots, coarseness, and layer peeling as in Example 93.

EXAMPLE 95

A light receiving member for electrophotography was produced in the same manner as in Example 93 except that the $CH_4$ gas cylinder was replaced by an $H_2S$ gas (99.9% pure) cylinder. The conditions for production are shown in Table 92. According to the evaluation carried out in the same manner as in Example 93, it has improved performance for dots, coarseness, and layer peeling as in Example 93.

EXAMPLE 96

A light receiving member for electrophotography was produced in the same manner as in Example 93 except that $N_2$ gas (99.9999% pure), He gas (99.9999% pure), and $SiF_4$ gas (99.999% pure) were additionally used. The conditions for production are shown in Table 93. According to the evaluation carried out in the same manner as in Example 93, it has improved performance for dots, coarseness, and layer peeling as in Example 93.

EXAMPLE 97

A light receiving member for electrophotography was produced in the same manner as in Example 93 except that $AlCl_3$ was replaced by $Al(CH_3)_3$ (99.99% pure) for the lower layer, and the $GeH_4$ gas cylinder was replaced by an Ar gas (99.9999% pure) cylinder and the NO gas cylinder was replaced by an $NH_3$ gas (99.999% pure) cylinder. The conditions for production are shown in Table 94. According to the evaluation carried out in the same manner as in Example 93, it has improved performance for dots, coarseness, and layer peeling as in Example 93.

EXAMPLE 98

A light receiving member for electrophotography was produced in the same manner as in Example 93 except that the $PH_3/H_2$ gas (99.99%) was additionally used for the upper layer. The conditions for production are shown in Table 95. According to the evaluation carried out in the same manner as in Example 93, it has improved performance for dots, coarseness, and layer peeling as in Example 93.

EXAMPLE 99

A light receiving member for electrophotography was produced in the same manner as in Example 93 except that $PH_3/H_2$ gas was used for the lower layer and $B_2H_6/H_2$ gas and $SiF_4$ gas were additionally used for the upper layer. The conditions for production are shown in Table 96. According to the evaluation carried out in the same manner as in Example 93, it has improved performance for dots, coarseness, and layer peeling as in Example 93.

EXAMPLE 100

A light receiving member for electrophotography was produced in the same manner as in Example 93 except that $CH_4$ gas and $H_2S$ gas were used for the lower layer and $PH_3H_2$ gas and $N_2$ gas were additionally used for the upper layer. The conditions for production are shown in Table 97. According to the evaluation carried out in the same manner as in Example 93, it has improved performance for dots, coarseness, and layer peeling as in Example 93.

EXAMPLE 101

A light receiving member for electrophotography was produced in the same manner as in Example 93 except that the $CH_4$ gas cylinder was replaced by a $C_2H_2$ gas (99.9999% pure) cylinder. The conditions for production are shown in Table 98. According to the evaluation carried out in the same manner as in Example 93, it has improved performance for dots, coarseness, and layer peeling as in Example 93.

EXAMPLE 102

A light receiving member for electrophotography was produced in the same manner as in Example 93 under the conditions shown in Table 99, except that $PF_5$/He gas (99.999% pure) was used for the lower layer. According to the evaluation carried out in the same manner as in Example 93, it has improved performance for dots, coarseness, and layer peeling as in Example 93.

EXAMPLE 103

A light receiving member for electrophotography was produced in the same manner as in Example 93 except that the NO gas cylinder was replaced by an $NH_3$ gas cylinder, and the $CH_4$ gas was replaced by $NH_3$ gas for the upper layer. The conditions for production are shown in Table 100. According to the evaluation carried out in the same manner as in Example 93, it has improved performance for dots, coarseness, and layer peeling as in Example 93.

EXAMPLE 104

A light receiving member for electrophotography was produced in the same manner as in Example 98 except that $B_2H_6/H_2$ gas was replaced by $BF_3$/He gas (99.999% pure) for the lower layer and $SiF_4$ gas was additionally used for the upper layer. The conditions for production are shown in Table 101. According to the evaluation carried out in the same manner as in Example 98, it has improved performance for dots, coarseness, and layer peeling as in Example 98.

EXAMPLE 105

A light receiving member for electrophotography was produced in the same manner as in Example 93 except that $Si_2F_6$ gas (99.99% pure) was used for the lower layer and $Si_2H_6$ gas (99.99% pure) was used for the upper layer. The conditions for production are shown in Table 102. According to the evaluation carried out in the same manner as in Example 93, it has improved performance for dots, coarseness, and layer peeling as in Example 93.

EXAMPLE 106

A light receiving member for electrophotography was produced in the same manner as in Example 93 except that $B_2H_6$ gas was used for the lower layer and $NH_3$ gas and $PH_3$ gas were used for the upper layer. The conditions for production are shown in Table 103. According to the evaluation carried out in the same manner as in Example 93, it has improved performance for dots, coarseness, and layer peeling as in Example 93.

EXAMPLE 107

A light receiving member for electrophotography was produced in the same manner as in Example 93 except that $GeH_4$ gas was additionally used for the upper layer. The conditions for production are shown in Table 104. According to the evaluation carried out in the same manner as in Example 93, it has improved performance for dots, coarseness, and layer peeling as in Example 93.

EXAMPLE 108

A light receiving member for electrophotography was produced in the same manner as in Example 93 except that the cylindrical aluminum support was replaced by the one having an outside diameter of 80 mm. The conditions for production are shown in Table 105. According to the evaluation carried out in the same manner as in Example 93, except that a remodeled version of Canon's duplicating machine NP-9030 was used, it has improved performance for dots, coarseness, and layer peeling as in Example 93.

EXAMPLE 109

A light receiving member for electrophotography was produced in the same manner as in Example 93 except that the cylindrical aluminum support was replaced by the one having an outside diameter of 60 mm. The conditions for production are shown in Table 106. According to the evaluation carried out in the same manner as in Example 93, except that a remodeled version of Canon's duplicating machine NP-150Z was used, it has improved performance for dots, coarseness, and layer peeling as in Example 93.

EXAMPLE 110

A light receiving member for electrophotography was produced in the same manner as in Example 93 except that the cylindrical aluminum support was replaced by the one having an outside diameter of 30 mm. The conditions for production are shown in Table 107. According to the evaluation carried out in the same manner as in Example 93, except that a remodeled version of Canon's duplicating machine FC-5 was used, it has improved performance for dots, coarseness, and layer peeling as in Example 93.

EXAMPLE 111

A light receiving member for electrophotography was produced in the same manner as in Example 93 except that the cylindrical aluminum support was replaced by the one having an outside diameter of 15 mm. The conditions for production are shown in Table 108. According to the evaluation carried out in the same manner as in Example 93, except that an experimentally constructed electrophotographic apparatus was used, it has improved performance for dots, coarseness, and layer peeling as in Example 93.

EXAMPLE 112

A light receiving member for electrophotography was produced in the same manner as in Example 108 except that the cylindrical aluminum support was replaced by a mirror-finished cylindrical aluminum support lathed by a diamond point tool, which has a cross section as shown in FIG. 38, in which a =25 μm and b =0.8 μm. According to the evaluation carried out in the same manner as in Example 108, it has improved performance for dots, coarseness, and layer peeling as in Example 108.

EXAMPLE 113

A light receiving member for electrophotography was produced in the same manner as in Example 108 except that the cylindrical aluminum support was replaced by a mirror-finished cylindrical aluminum support dimpled by falling bearing balls, which has a cross section as shown in FIG. 39, in which c =50 μm and d =1 μm. According to the evaluation carried out in the same manner as in Example 108, it has improved performance for dots, coarseness, and layer peeling as in Example 108.

EXAMPLE 114

A light receiving member for electrophotography was produced in the same manner as in Example 101 under the conditions shown in Table 109, except that the cylindrical aluminum support was kept at 500° C. and the upper layer was composed of poly-Si(H,X). According to the evaluation carried out in the same manner as in Example 101, it has improved performance for dots, coarseness, and layer peeling as in Example 101.

EXAMPLE 115

A light receiving member for electrophotography was prepared by the microwave glow discharge decomposition method in the same manner as in Example 23, except that $GeH_4$ gas, NO gas, and $SiF_4$ gas were additionally used when the lower layer was formed. The conditions for production are shown in Table 110. According to the evaluation carried out in the same manner as in Example 93, it has improved performance for dots, coarseness, and layer peeling as in Example 93.

EXAMPLE 116

A light receiving member for electrophotography was prepared in the same manner as in Example 1, except that $Mg(C_5H_5)_2$/He gas was used when the lower layer was formed. The conditions for production are shown in Table 111.

COMPARATIVE EXAMPLE 6

A light receiving member for electrophotography was prepared in the same manner as in Example 116, except that $Mg(C_5H_5)_2$ /He gas and $H_2$ gas were not used when the lower layer was formed. The conditions for production are shown in Table 112.

The light receiving members for electrophotography prepared in Example 116 and Comparative Example 6 were evaluated for electrophotographic characteristics under various conditions by running them on an experimental electrophotographic apparatus which is a remodeled version of Canon's duplicating machine NP-7550.

The light receiving member for electrophotography produced in Example 116 gave less than two-fifths the number of dots (especially those smaller than 0.1 mm in diameter) in the case of the light receiving member for electrophotography produced in Comparative Example 6. In addition, the degree of coarseness was evaluated by measuring the dispersion of the image density at 100 points in a circular region 0.05 mm in diameter. The light receiving member for electrophotography produced in Example 116 gave less than one-quarter the dispersion in the case of the light receiving member for electrophotography produced in Comparative Example 6. It was also visually recognized that the one in Example 116 was superior to the one in Comparative Example 6.

The light receiving member for electrophotography was also tested for whether it gives defective images or it suffers the peeling of the light receiving layer when it is subjected to an impactive mechanical pressure for a comparatively short time. This test was carried out by dropping stainless steel balls 3.5 mm in diameter onto the surface of the light receiving member for electrophotography from a height of 30 cm. The probability that cracking occurs in the light receiving layer was measured. The light receiving member for electrophotography in Example 116 gave a probability smaller than one-quarter that of the light receiving member for electrophotography in Comparative Example 6.

The lower layer of the light receiving member for electrophotography prepared in Example 116 was analyzed by SIMS. It was found that silicon atoms, hydrogen atoms, and aluminum atoms are distributed in the layer thickness direction as intended.

As mentioned above, the light receiving member for electrophotography in Example 116 was superior to the light receiving member for electrophotography in Comparative Example 6.

EXAMPLE 117

A light receiving member for electrophotography was produced in the same manner as in Example 116 except that the flow rate of $AlCl_3$/He gas for the lower layer was changed in a different manner. The conditions for production are shown in Table 113. According to the evaluation carried out in the same manner as in Example 116, it has improved performance for dots, coarseness, and layer peeling as in Example 116.

EXAMPLE 118

A light receiving member for electrophotography was produced in the same manner as in Example 116 except that the $CH_4$ gas cylinder was replaced by an $H_2H$ gas (99.9% pure) cylinder and $B_2H_6/H_2$ gas was additionally used. The conditions for production are shown in Table 114. According to the evaluation carried out in the same manner as in Example 116, it has improved performance for dots, coarseness, and layer peeling as in Example 116.

EXAMPLE 119

A light receiving member for electrophotography was produced in the same manner as in Example 116 except that NO gas, $B_2H_6/H_2$ gas, $SiF_4$ gas (99.999% pure) supplied from a cylinder (not shown), $GeH_4$ gas (99.999% pure), He gas (99.9999% pure), and $N_2$ gas were additionally used. The conditions for production are shown in Table 115. According to the evaluation carried out in the same manner as in Example 116, it has improved performance for dots, coarseness, and layer peeling as in Example 116.

EXAMPLE 120

A light receiving member for electrophotography was produced in the same manner as in Example 116, except that $AlCl_3$ was replaced by $Al(CH_2)_3$ (99.99% pure) for the lower layer, and the $PH_3/H_2$ gas cylinder was replaced by an Ar gas (99.9999% pure) cylinder and the NO gas cylinder was replaced by an $NH_3$ gas (99.999% pure) cylinder. The conditions for production are shown in Table 116. According to the evaluation carried out in the same manner as in Example 116, it has improved performance for dots, coarseness, and layer peeling as in Example 116.

EXAMPLE 121

A light receiving member for electrophotography was produced in the same manner as in Example 116 except that NO gas and $B_2H_6/H_2$ gas were additionally used for the lower layer and $PH_3/H_2$ gas was additionally used for the upper layer. The conditions for production are shown in Table 117. According to the evaluation carried out in the same manner as in Example 116, it has improved performance for dots, coarseness, and layer peeling as in Example 116.

EXAMPLE 122

A light receiving member for electrophotography was produced in the same manner as in Example 116 except that $PH_3/H_2$ gas and $GeH_4$ gas were used for the lower layer and $B_2H_6/H_2$ gas and $SiF_4$ gas were additionally used for the upper layer. The conditions for production are shown in Table 118. According to the evaluation carried out in the same manner as in Example 116, it has improved performance for dots, coarseness, and layer peeling as in Example 116.

EXAMPLE 123

A light receiving member for electrophotography was produced in the same manner as in Example 116 except that $CH_4$ gas and $H_2S$ gas were used for the lower layer and $PH_3/H_2$ gas and $N_2$ gas were additionally used for the upper layer. The conditions for production are shown in Table 119. According to the evaluation carried out in the same manner as in Example 116, it has improved performance for dots, coarseness, and layer peeling as in Example 116.

EXAMPLE 124

A light receiving member for electrophotography was produced in the same manner as in Example 116 except that the $CH_4$ gas cylinder was replaced by a $C_2H_2$ gas 99.9999% pure) cylinder, and $B_2H_6/H_2$ gas was additionally used for the lower layer and NO gas was additionally used for the upper layer. The conditions for production are shown in Table 120. According to the evaluation carried out in the same manner as in Example 116, it has improved performance for dots, coarseness, and layer peeling as in Example 116.

EXAMPLE 125

A light receiving member for electrophotography was produced in the same manner as in Example 116 under the conditions shown in Table 121, except that $PF_5$/He gas (99.999% pure) and $H_2S$ gas were additionally used for the lower layer. According to the evaluation carried out in the same manner as in Example 116, it has improved performance for dots, coarseness, and layer peeling as in Example 116.

EXAMPLE 126

A light receiving member for electrophotography was produced in the same manner as in Example 116 except that the NO gas cylinder was replaced by an $NH_3$ gas cylinder, and the $CH_4$ gas was replaced by $NH_3$ gas for the upper layer. The conditions for production are shown in Table 122. According to the evaluation carried out in the same manner as in Example 116, it has improved performance for dots, coarseness, and layer peeling as in Example 116.

EXAMPLE 127

A light receiving member for electrophotography was produced in the same manner as in Example 121 except that the $B_2H_6/H_2$ gas cylinder was replaced by a $BF_3$/He gas (99.999% pure) cylinder, and $SiF_4$ gas was additionally used for the upper layer. The conditions for production are shown in Table 123. According to the evaluation carried out in the same manner as in Example 121, it has improved performance for dots, coarseness, and layer peeling as in Example 121.

EXAMPLE 128

A light receiving member for electrophotography was produced in the same manner as in Example 124 except that $PH_3/H_2$ gas, $Si_2F_6$ gas (99.99% pure) from a cylinder (not shown), $N_2$ gas, and $H_2S$ gas were used for the lower layer and $Si_2H_6/H_2$ gas and $Si_2H_6$ gas (99.99% pure) were additionally used for the upper layer. The conditions for production are shown in Table 124. According to the evaluation carried out in the same manner as in Example 124, it has improved performance for dots, coarseness, and layer peeling as in Example 124.

EXAMPLE 129

A light receiving member for electrophotography was produced in the same manner as in Example 126 except that $B_2H_6/H_2$ gas was additionally used for the lower layer and $PH_3/H_2$ gas was additionally used for the upper layer. The conditions for production are shown in Table 125. According to the evaluation carried out in the same manner as in Example 126, it has improved performance for dots, coarseness, and layer peeling as in Example 126.

EXAMPLE I30

A light receiving member for electrophotography was produced in the same manner as in Example 116 except that the NO gas cylinder was replace by a $GeH_4$ gas cylinder. The conditions for production are shown in Table 126. According to the evaluation carried out in the same manner as in Example 116, it has improved performance for dots, coarseness, and layer peeling as in Example 116.

EXAMPLE 131

A light receiving member for electrophotography was produced in the same manner as in Example 116 except that the cylindrical aluminum support was replaced by the one having an outside diameter of 80 mm. The conditions for production are shown in Table 127. According to the evaluation carried out in the same manner as in Example 116, except that a remodeled version of Canon's duplicating machine NP-9030 was used, it has improved performance for dots, coarseness, and layer peeling as in Example 116.

EXAMPLE 132

A light receiving member for electrophotography was produced in the same manner as in Example 116 except that the cylindrical aluminum support was replaced by the one having an outside diameter of 60 mm. The conditions for production are shown in Table 128. According to the evaluation carried out in the same manner as in Example 116, except that a remodeled version of Canon's duplicating machine NP-150Z was used, it has improved performance for dots, coarseness, and layer peeling as in Example 116.

EXAMPLE 133

A light receiving member for electrophotography was produced in the same manner as in Example 116 except that the cylindrical aluminum support was replaced by the one having an outside diameter of 30 mm. The conditions for production are shown in Table 129. According to the evaluation carried out in the same manner as in Example 116, except that a remodeled version of Canon's duplicating machine FC-5 was used, it has improved performance for dots, coarseness, and layer peeling as in Example 116.

EXAMPLE 134

A light receiving member for electrophotography was produced in the same manner as in Example 116 except that the cylindrical aluminum support was replaced by the one having an outside diameter of 15 mm. The conditions for production are shown in Table 130. According to the evaluation carried out in the same manner as in Example 116, except that an experimentally constructed electrophotographic apparatus was used, it has improved performance for dots, coarseness, and layer peeling as in Example 116.

EXAMPLE 135

A light receiving member for electrophotography was produced in the same manner as in Example 131 except that the cylindrical aluminum support was replaced by a mirror-finished cylindrical aluminum support lathed by a diamond point tool, which has a cross section as shown in FIG. 38, in which a $=25$ μm and b $=0.8$ μm. According to the evaluation carried out in the same manner as in Example 131, it has improved performance for dots, coarseness, and layer peeling as in Example 131.

EXAMPLE 136

A light receiving member for electrophotography was produced in the same manner as in Example 131 except that the cylindrical aluminum support was replaced by a mirror-finished cylindrical aluminum support dimpled by falling bearing balls, which has a cross section as shown in FIG. 39, in which c $=50$ μm and d $=1$ μm. According to the evaluation carried out in the same manner as in Example 131, it has improved performance for dots, coarseness, and layer peeling as in Example 131.

EXAMPLE 137

A light receiving member for electrophotography was produced in the same manner as in Example 124 under the conditions shown in Table 131, except that the cylindrical aluminum support was kept at 500° C. and the upper layer was composed of poly-Si(H,X). According to the evaluation carried out in the same manner as in Example 124, it has improved performance for dots, coarseness, and layer peeling as in Example 124.

EXAMPLE 138

A light receiving member for electrophotography was prepared by the microwave glow discharge decomposition method in the same manner as in Example 23, except that $SiF_4$ gas, NO gas, $Mg(C_5H_5)_2$/He gas, and $B_2H_6$ gas were additionally used when the lower layer was formed. The conditions for production are shown in Table 132. According to the evaluation carried out in the same manner as in Example 116, it has improved performance for dots, coarseness, and layer peeling as in Example 116.

EXAMPLE 139

A light receiving member for electrophotography pertaining to the present invention was produced by the RF sputtering method for the lower layer and by the RF glow discharge decomposition method for the upper layer.

Figure 42:
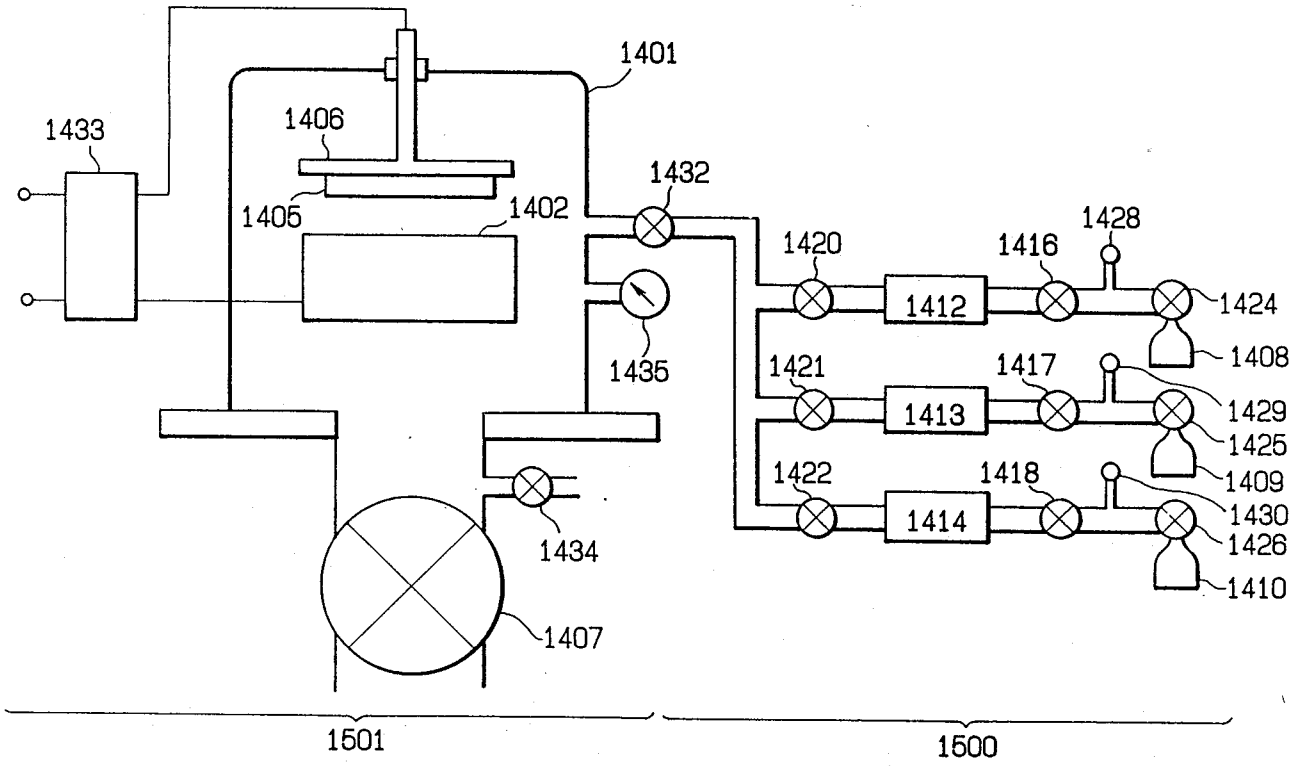
FIG. 42 is a schematic diagram of the apparatus to form the light receiving layer of the light receiving member for electrophotography by RF sputtering method according to the present invention.

FIG. 42 shows the apparatus for producing the light receiving member for electrophotography by the RF sputtering method, said apparatus being composed of the raw material gas supply unit 1500 and the deposition unit 1501.

In FIG. 42, there is shown a target 1405 composed of Si, Al, and Mg to constitute the lower layer. The atoms of these elements are distributed according to a certain pattern across the thickness.

In FIG. 42, there are shown gas cylinders 1408, 1409, and 1410. They contain raw material gases to form the lower layer. The cylinder 1408 contains $SiH_4$ gas (99.99% pure); the cylinder 1409 contains $H_2$ gas (99.9999% pure); and the cylinder 1401 contains Ar gas (99.999% pure).

In FIG. 42, there is shown the cylindrical aluminum support 1402, 108 mm in outside diameter, having the mirror-finished surface.

The deposition chamber 1401 and the gas piping were evacuated in the same manner as in Example 1 until the pressure in the deposition chamber reached $1\times10^{-6}$. Torr.

The gases were introduced into the mass flow controllers 1412~1414 in the same manner as in Example 1.

The cylindrical aluminum support 1402 placed in the deposition chamber 1401 was heated to 300° C. by a heater (not shown).

Now that the preparation for film forming was completed as mentioned above, the lower layer was formed on the cylindrical aluminum support 1402.

The lower layer was formed as follows: The outlet valves 1420, 1421, and 1422, and the auxiliary valve 1432 were opened slowly to introduce $SiH_4$ gas, $H_2$ gas, and Ar gas into the deposition chamber 1401. The mass flow controllers 1412, 1413 and 1414 were adjusted so that the flow rate of $SiH_4$ gas was 10 SCCM, the flow rate of $H_2$ gas was 5 SCCM, and the flow rate of Ar gas was 200 SCCM. The pressure in the deposition chamber 1401 was maintained at 0.01 Torr as indicated by the vacuum gauge 1435 by adjusting the opening of the main valve 1407. Then, the output of the RF power source (not shown) was set to 1 mW/cm$^3$, and RF power was applied to the target 1405 and the aluminum support 1402 through the high-frequency matching box 1433 in order to form the lower layer on the aluminum support. While the lower layer was being formed, the mass flow controllers 1412, 1413 and 1414 were adjusted so that the flow rate of Ar gas remained constant at 200 SCCM, the flow rate of $SiH_4$ gas increased from 10 SCCM to 50 SCCM at a constant ratio, and the flow rate of $H_2$ gas increased from 5 SCCM to 100 SCCM at a constant ratio. When the lower layer became 0.2 μm thick, the RF glow discharge was suspended, and the outlet valves 1420, 1421, and 1422 and the auxiliary valve 1432 were closed to stop the gases from flowing into the deposition chamber 1401. The formation of the lower layer was completed.

While the lower layer was being formed, the cylindrical aluminum support 1402 was turned at a prescribed speed by a drive unit (not shown) to ensure uniform deposition.

The upper layer was formed using the apparatus as shown in FIG. 37 in the same manner as in Example 116. The conditions for production are shown in Table 133. According to the evaluation carried out in the same manner as in Example 116, it has improved performance for dots, coarseness, and layer peeling as in Example 116.

EXAMPLE 140

A light receiving member for electrophotography was prepared in the same manner as in Example 1, except that $Cu(C_4H_7N_2O_2)_2$/He gas was additionally used when the lower layer was formed. The conditions for production are shown in Table 134.

COMPARATIVE EXAMPLE 7

A light receiving member for electrophotography was prepared in the same manner as in Example 140, except that $H_2$ gas and $Cu(C_4H_7N_2O_2)_2$/He gas were not used when the lower layer was formed. The conditions for production are shown in Table 135.

The light receiving members for electrophotography prepared in Example 140 and Comparative Example 7 were evaluated for electrophotographic characteristics under various conditions by running them on an experimental electrophotographic apparatus which is a remodeled version of Canon's duplicating machine NP-7550.

The light receiving member for electrophotography produced in Example 140 gave less than two-quarter the number of dots (especially those smaller than 0.1 mm in diameter) in the case of the light receiving member for electrophotography produced in Comparative Example 7. In addition, the degree of coarseness was evaluated by measuring the dispersion of the image density at 100 points in a circular region 0.05 mm in diameter. The light receiving member for electrophotography produced in Example 140 gave less than one-fifth the dispersion in the case of the light receiving member for electrophotography produced in Comparative Example 7. It was also visually recognized that the one in Example 140 was superior to the one in Comparative Example 7.

The light receiving member for electrophotography was also tested for whether it gives defective images or it suffers the peeling of the light receiving layer when it is subjected to an impactive mechanical pressure for a comparatively short time. This test was carried out by dropping stainless steel balls 3.5 mm in diameter onto the surface of the light receiving member for electrophotography from a height of 30 cm. The probability that cracking occurs in the light receiving layer was measured. The light receiving member for electrophotography in Example 140 gave a probability smaller than one-fifth that of the light receiving member for electrophotography in Comparative Example 7.

The lower layer of the light receiving member for electrophotography prepared in Example 140 was analyzed by SIMS. It was found that silicon atoms, hydrogen atoms, and aluminum atoms are distributed in the layer thickness direction as intended.

As mentioned above, the light receiving member for electrophotography in Example 140 was superior to the light receiving member for electrophotography in Comparative Example 7.

EXAMPLE 141

A light receiving member for electrophotography was produced in the same manner as in Example 140 except that the flow rate of $AlCl_3$/He gas for the lower layer was changed in a different manner. The conditions for production are shown in Table 136. According to the evaluation carried out in the same manner as in Example 140, it has improved performance for dots, coarseness, and layer peeling as in Example 140.

EXAMPLE 142

A light receiving member for electrophotography was produced in the same manner as in Example 140 except that $GeH_4$ gas and $Mg(C_5H_5)_2$/He gas were used for the lower layer, and He gas from a cylinder (not shown) was used and $CH_4$ gas was not used for the upper layer. The conditions for production are shown in Table 137. According to the evaluation carried out in the same manner as in Example 140, it has improved performance for dots, coarseness, and layer peeling as in Example 140.

EXAMPLE 143

A light receiving member for electrophotography was produced in the same manner as in Example 140 except that $Mg(C_5H_5)_2$ gas supplied from a closed vessel (not shown), $CH_4$ gas, $B_2H_6/H_2$ gas, NO gas, $SiF_4$ gas (99.999% pure) supplied from a cylinder (not shown), and $N_2$ gas supplied from a cylinder (not shown) were additionally used. The conditions for production are shown in Table 138. According to the evaluation carried out in the same manner as in Example 140, it has improved performance for dots, coarseness, and layer peeling as in Example 140.

EXAMPLE 144

A light receiving member for electrophotography was produced in the same manner as in Example 140, except the $H_2$ gas cylinder was replaced by an Ar gas 99.9999% pure) cylinder, the $CH_4$ gas cylinder was replaced by an $NH_3$ gas (99.999% pure) cylinder, and $SiF_4$ gas was additionally used for the upper layer. The conditions for production are shown in Table 139. According to the evaluation carried out in the same manner as in Example 140, it has improved performance for dots, coarseness, and layer peeling as in Example 140.

EXAMPLE 145

A light receiving member for electrophotography was produced in the same manner as in Example 140 except that $CH_4$ gas was additionally used for the lower layer and $PH_3/H_2$ gas (99.999% pure) supplied from a cylinder (not shown) was additionally used for the upper layer. The conditions for production are shown in Table 140. According to the evaluation carried out in the same manner as in Example 140, it has improved performance for dots, coarseness, and layer peeling as in Example 140.

EXAMPLE 146

A light receiving member for electrophotography was produced in the same manner as in Example 140 except that the NO gas cylinder was replaced by an $SiF_4$ gas cylinder and $Mg(C_5H_5)_2$/He gas supplied from a closed vessel (not shown) was additionally used for the lower layer, and $B_2H_6/H_2$ gas was additionally used for the upper layer. The conditions for production are shown in Table 141. According to the evaluation carried out in the same manner as in Example 140, it has improved performance for dots, coarseness, and layer peeling as in Example 140.

EXAMPLE 147

A light receiving member for electrophotography was produced in the same manner as in Example 140 except that $Mg(C_5H_5)_2$/He gas supplied from a closed vessel (not shown) was used for the lower layer and $PH_3/_2$ gas supplied from a cylinder (not shown), $N_2$ gas, and $H_2S$ gas were additionally used for the upper layer. The conditions for production are shown in Table 142. According to the evaluation carried out in the same manner as in Example 140, it has improved performance for dots, coarseness, and layer peeling as in Example 140.

EXAMPLE 148

A light receiving member for electrophotography was produced in the same manner as in Example 140 except that the $GeH_4$ gas cylinder was replaced by a $GeF_4$ gas (99.999% pure) cylinder and the $CH_4$ gas cylinder was replaced by a $C_2H_2$ gas (99.9999% pure) cylinder. The conditions for production are shown in Table 143. According to the evaluation carried out in the same manner as in Example 140, it has improved performance for dots, coarseness, and layer peeling as in Example 140.

EXAMPLE 149

A light receiving member for electrophotography was produced in the same manner as in Example 140 under the conditions shown in Table 144, except that $Mg(C_5H_5)_2$/He gas supplied from a closed vessel (not shown) was used, the $B_2H_6$ gas cylinder was replaced by a $PH_3/H_2$ gas cylinder, and $SiF_4$ gas supplied from a cylinder (not shown) was additionally used. According to the evaluation carried out in the same manner as in Example 140, it has improved performance for dots, coarseness, and layer peeling as in Example 140.

EXAMPLE 150

A light receiving member for electrophotography was produced in the same manner as in Example 140 except that the $CH_4$ gas cylinder was replaced by an $NH_3$ gas (99.999% pure) cylinder, and $GeH_4$ gas was used for the lower layer. The conditions for production are shown in Table 145. According to the evaluation carried out in the same manner as in Example 140, it has improved performance for dots, coarseness, and layer peeling as in Example 140.

EXAMPLE 151

A light receiving member for electrophotography was produced in the same manner as in Example 145 except that $CH_4$ gas and $BF_3$ gas supplied from a cylinder (not shown) were used for the lower layer, and $SiF_4$ gas was additionally used for the upper layer. The conditions for production are shown in Table 146. According to the evaluation carried out in the same manner as in Example 145, it has improved performance for dots, coarseness, and layer peeling as in Example 145.

EXAMPLE 152

A light receiving member for electrophotography was produced in the same manner as in Example 148 except that $CH_4$ gas was replaced by $C_2H_2$ gas, $PH_3/H_2$ gas supplied from a cylinder (not shown) was used, and $Si_2F_6$ gas (99.99% pure) supplied from a cylinder (not shown) and $Si_2H_6$ gas (99.99% pure) were additionally used for the upper layer. The conditions for production are shown in Table 147. According to the evaluation carried out in the same manner as in Example 148, it has improved performance for dots, coarseness, and layer peeling as in Example 148.

EXAMPLE 153

A light receiving member for electrophotography was produced in the same manner as in Example 140 except that $Si_2F_6$ gas supplied from a cylinder (not shown), $PH_3$ gas, and $NH_3$ gas were additionally used. The conditions for production are shown in Table 148. According to the evaluation carried out in the same manner as in Example 140, it has improved performance for dots, coarseness, and layer peeling as in Example 140.

EXAMPLE 154

A light receiving member for electrophotography was produced in the same manner as in Example 140 except that $GeH_4$ gas was additionally used for the upper layer. The conditions for production are shown in Table 149. According to the evaluation carried out in the same manner as in Example 140, it has improved performance for dots, coarseness, and layer peeling as in Example 140.

EXAMPLE 155

A light receiving member for electrophotography was produced in the same manner as in Example 140 except that the cylindrical aluminum support was replaced by the one having an outside diameter of 80 mm and $GeH_4$ gas was used for the lower layer. The conditions for production are shown in Table 150. According to the evaluation carried out in the same manner as in Example 140, except that a remodeled version of Canon's duplicating machine NP-9030 was used, it has improved performance for dots, coarseness, and layer peeling as in Example 140.

EXAMPLE 156

A light receiving member for electrophotography was produced in the same manner as in Example 140 except that the cylindrical aluminum support was replaced by the one having an outside diameter of 60 mm and $GeH_4$ gas was used for the lower layer. The conditions for production are shown in Table 151. According to the evaluation carried out in the same manner as in Example 140, except that a remodeled version of Canon's duplicating machine NP-150Z was used, it has improved performance for dots, coarseness, and layer peeling as in Example 140.

EXAMPLE 157

A light receiving member for electrophotography was produced in the same manner as in Example 140 except that the cylindrical aluminum support was replaced by the one having an outside diameter of 30 mm and $GeH_4$ gas was used for the lower layer. The conditions for production are shown in Table 152. According to the evaluation carried out in the same manner as in Example 140, except that a remodeled version of Canon's duplicating machine FC-5 was used, it has improved performance for dots, coarseness, and layer peeling as in Example 140.

EXAMPLE 158

A light receiving member for electrophotography was produced in the same manner as in Example 140 except that the cylindrical aluminum support was replaced by the one having an outside diameter of 15 mm and $GeH_4$ gas was used for the lower layer. The conditions for production are shown in Table 153. According to the evaluation carried out in the same manner as in Example 140, except that an experimentally constructed electrophotographic apparatus was used, it has improved performance for dots, coarseness, and layer peeling as in Example 140.

EXAMPLE 159

A light receiving member for electrophotography was produced in the same manner as in Example 155 except that the cylindrical aluminum support was replaced by a mirror-finished cylindrical aluminum support lathed by a diamond point tool, which has a cross section as shown in FIG. 38, in which a $=25$ μm and b $=0.8$ μm. According to the evaluation carried out in the same manner as in Example 155, it has improved performance for dots, coarseness, and layer peeling as in Example 155.

EXAMPLE 160

A light receiving member for electrophotography was produced in the same manner as in Example 155 except that the cylindrical aluminum support was replaced by a mirror-finished cylindrical aluminum support dimpled by falling bearing balls, which has a cross section as shown in FIG. 39, in which c $=50$ μm and d $=1$ μm. According to the evaluation carried out in the same manner as in Example 155, it has improved performance for dots, coarseness, and layer peeling as in Example 155.

EXAMPLE 161

A light receiving member for electrophotography was produced in the same manner as in Example 148 under the conditions shown in Table 154, except that the cylindrical aluminum support was kept at 500° C., the $CH_4$ gas was replaced by $C_2H_2$ gas, and the upper layer was composed of poly-Si(H,X). According to the evaluation carried out in the same manner as in Example 148, it has improved performance for dots, coarseness, and layer peeling as in Example 148.

EXAMPLE 162

A light receiving member for electrophotography was prepared by the microwave glow discharge decomposition method in the same manner as in Example 23, except that $Cu(C_4H_7N_2O_2)_2$/He gas, $SiF_4$ gas, NO gas, and $B_2H_6$ gas were additionally used when the lower layer was formed. The conditions for production are shown in Table 155. According to the evaluation carried out in the same manner as in Example 140, it has improved performance for dots, coarseness, and layer peeling as in Example 140.

The lower layer of the light receiving member for electrophotography prepared in Example 162 was analyzed by SIMS. It was found that silicon atoms, hydrogen atoms, and aluminum atoms are distributed in the layer thickness direction as intended.

EXAMPLE 163

A light receiving member for electrophotography was prepared in the same manner as in Example 139, except that the target composed of Si, Al, and Mg was replaced by the one composed of Si, Al, and Cu for the formation of the lower layer. The conditions for production are shown in Table 156. According to the evaluation carried out in the same manner as in Example 140, it has improved performance for dots, coarseness, and layer peeling as in Example 140.

The lower layer of the light receiving member for electrophotography prepared in Example 163 was analyzed by SIMS. It was found that silicon atoms, hydrogen atoms, and aluminum atoms are distributed in the layer thickness direction as intended.

EXAMPLE 164

A light receiving member for electrophotography was prepared in the same manner as in Example 1, except that $NaNH_2$/He gas was used when the lower layer was formed. The conditions for production are shown in Table 157.

COMPARATIVE EXAMPLE 8

A light receiving member for electrophotography was prepared in the same manner as in Example 164, except that $H_2$ gas was not used when the lower layer was formed.

Figure 43A:
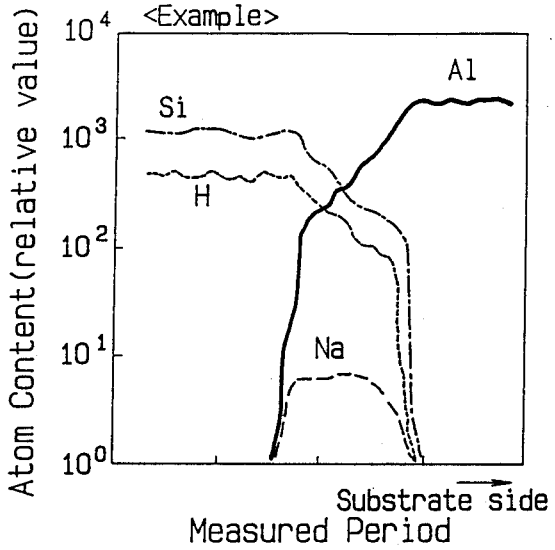
FIGS. 43(*a*) to 43(*d*) show the distribution of the content of the atoms across the layer thickness in Example 164, Comparative Example 8, Example 171, and Example 172, respectively, of the present invention.
Figure 43B:
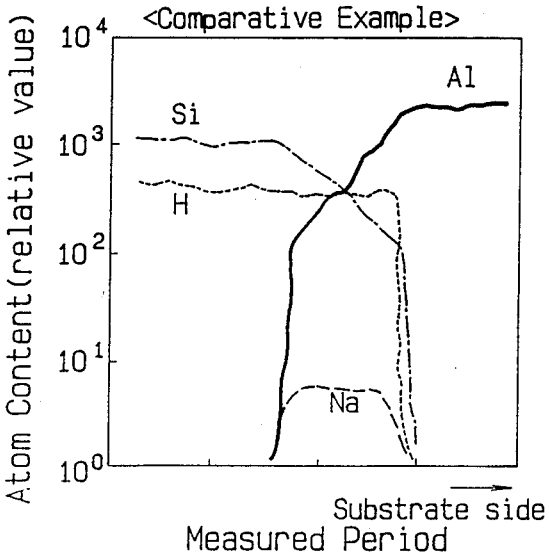
Figure 43C:
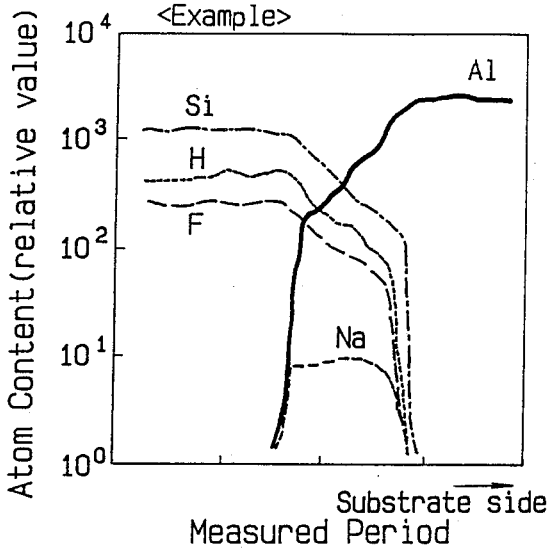
Figure 43D:
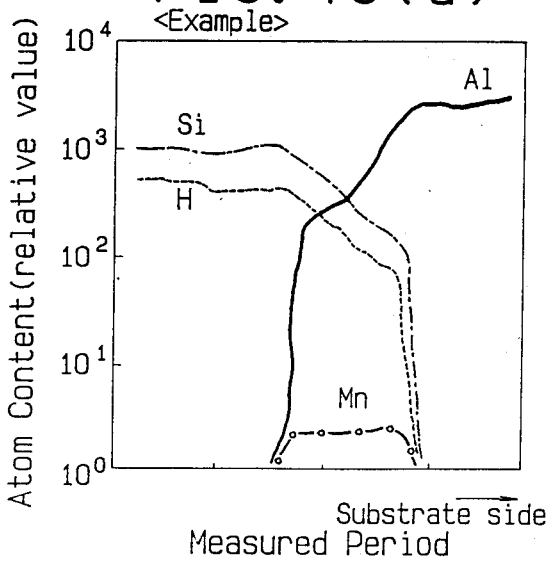

The lower layer of the light receiving member for electrophotography prepared in Example 164 and Comparative Example 8 was analyzed by SIMS (secondary ion mass spectrometer, Model IMS-3F, made by Cameca) to see the distribution of atoms in the layer thickness direction. The results are shown in FIGS. 43(a) and 43(b). In Fig. 43, the abscissa represents the time measured, which corresponds to the position in the layer thickness, and the ordinate represents the content of each atom in terms of relative values.

FIG. 43(*a*) shows the distribution of atoms in the layer thickness direction in Example 164. It is noted that aluminum atoms are distributed more in the part adjacent to the support and silicon atoms and hydrogen atoms are distributed more in the part adjacent to the upper layer.

FIG. 43(*b*) shows the distribution of atoms in the layer thickness direction in Comparative Example 8. It is noted that aluminum atoms are distributed more in the part adjacent to the support, silicon atoms are distributed more in the part adjacent to the upper layer, and hydrogen atoms are uniformly distributed throughout the layer.

The light receiving members for electrophotography prepared in Example 164 and Comparative Example 8 were evaluated for electrophotographic characteristics under various conditions by running them on an experimental electrophotographic apparatus which is a remodeled version of Canon's duplicating machine NP-7550.

The light receiving member for electrophotography was turned 1000 times, with all the chargers not in operation and the magnet roller as the cleaning roller coated with a positive toner. Images were reproduced from a black original by the ordinary electrophotographic process, and the number of dots which appeared on the images was counted. It was found that the number of dots in Example 164 was less than one-third that in Comparative Example 8.

The light receiving member for electrophotography was turned 20 times, with the grid of the separate charger intentionally fouled with massed paper powder so that anomalous discharge is liable to occur. After the removal of the massed paper powder, images were reproduced from a black original, and the number of dots that appeared in the images was counted. It was found that the number of dots in Example 164 was less than two-thirds that in Comparative Example 8.

The light receiving member for electrophotography was turned 500,000 times, with a roll made of high-density polyethylene (about 32 mm in diameter and 5 mm thick) pressed against it under a pressure of about 2 kg. The number of occurrence of the peeling of the light receiving layer was examined visually. It was found that the number of occurrence of peeling in Example 164 was less than a half that in Comparative Example 8.

As mentioned above, the light receiving members for electrophotography in Example 164 was superior in general to that in Comparative Example 8.

EXAMPLE 165

A light receiving member for electrophotography was prepared in the same manner as in Example 164, except that the flow rate of $Al(CH_3)_3$/He gas was changed as shown in Table 158. The conditions for production are shown in Table 157.

COMPARATIVE EXAMPLE 9

A light receiving member for electrophotography was prepared in the same manner as in Example 164, except that the flow rate of $Al(CH_3)_3$/He gas was changed as shown in Table 158. The conditions for production are shown in Table 157.

The light receiving members for electrophotography prepared in Example 165 and Comparative Example 9 were examined for the occurrence of layer peeling, with a roll made of high-density polyethylene pressed against them as in Example 164. The results are shown in Table 158. (The number of occurrence of layer peeling in Example 164 is regarded as 1.) In addition, the content of aluminum atoms in the upper part of the lower layer was determined by SIMS. The results are shown in Table 158.

As Table 158 shows, the layer peeling is less liable to occur in the upper region in the lower layer where the content of aluminum atoms is more than 20 atom%.

EXAMPLE 166

A light receiving member for electrophotography was prepared in the same manner as in Example 164, except that the temperature of the support was changed at a constant rate from 350° C. to 250° C. while the lower layer was being formed and the $NaNH_2$ was replaced by $Y(Oi\text{-}C_3H_7)_3$, under the conditions shown in Table 157. According to the evaluation carried out in the same manner as in Example 164, it has improved performance for dots and layer peeling as in Example 164.

EXAMPLE 167

A light receiving member for electrophotography was prepared in the same manner as in Example 164, except that the RF power was changed at a constant rate from 50 mW/cm$^3$ to 5 mW/cm$^3$ while the lower layer was being formed and the $NaNH_2$ was replaced by $Mn(CH_3)(CO)_5$, under the conditions shown in Table 157. According to the evaluation carried out in the same manner as in Example 164, it has improved performance for dots and layer peeling as in Example 164.

EXAMPLE 168

A light receiving member for electrophotography was prepared in the same manner as in Example 164, except that the $NaNH_2$ was replaced by $Zn(C_2H_5)_2$, under the conditions shown in Table 157. According to the evaluation carried out in the same manner as in Example 164, it has improved performance for dots and layer peeling as in Example 164.

EXAMPLE 169

A light receiving member for electrophotography was prepared in the same manner as in Example 164, except that the aluminum support was replaced by the one having an outside diameter of 30 mm and both the gas flow rate and RF power shown in Table 157 were reduced to one-third, under the conditions shown in Table 157. According to the evaluation carried out in the same manner as in Example 164, it has improved performance for dots and layer peeling as in Example 164.

EXAMPLE 170

A light receiving member for electrophotography was prepared in the same manner as in Example 164, under the conditions shown in Table 160. According to the evaluation carried out in the same manner as in Example 164, it has improved performance for dots and layer peeling as in Example 164.

EXAMPLE 171

A light receiving member for electrophotography was prepared by the microwave glow discharge decomposition method in the same manner as in Example 23, except that $SiF_4$ gas and $NaNH_2$/He gas were additionally used when the lower layer was formed. The conditions for production are shown in Table 171. According to the evaluation carried out in the same manner as in Example 164, it has improved performance for dots and layer peeling as in Example 164.

The distribution of atoms in the layer thickness direction in the lower layer was examined by SIMS in the same manner as in Example 164. The results are shown in FIG. 43(*c*). It was found that aluminum atoms, silicon atoms, and hydrogen atoms are distributed as in Example 164.

EXAMPLE 172

A light receiving member for electrophotography was prepared in the same manner as in Example 139, except that the target composed of Si, Al, and Mg used for the formation of the lower layer was replaced by the one composed of Si, Al, and Mn. The lower layer was formed under the conditions shown in Table 162. The upper layer was formed using the apparatus shown in FIG. 37 under the conditions shown in Table 157. According to the evaluation carried out in the same manner as in Example 164, it has improved performance for dots and layer peeling as in Example 164.

The distribution of atoms in the layer thickness direction in the lower layer was examined by SIMS in the same manner as in Example 164. The results are shown in FIG. 43(*d*). It was found that aluminum atoms, silicon atoms, and hydrogen atoms are distributed as in Example 164.

In the following Tables 1 to 162, the mark "*" means increase of a flow rate at constant proportion; the mark "**" means decrease of a flow rate at constant proportion; the term "S-side" means substrate side; the term "UL-side" means upper layer side; the term "LL-side" means lower layer side; the term "U·2nd LR-side" means 2nd layer region side of the upper layer; and the term "U·4th LR-side" means 4th layer region side of the upper layer.

TABLE 1

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 5 | 0.4 | 0.05 |
| | | $H_2$ | 10 → 200* | | | | |
| | | $AlCl_3$/He | 120 → 40** | | | | |
| Upper layer | 1st layer region | $SiH_4$ | 300 | 250 | 15 | 0.5 | 20 |
| | | $H_2$ | 300 | | | | |
| | 2nd layer region | $SiH_4$ | 50 | 250 | 10 | 0.4 | 0.5 |
| | | $CH_4$ | 500 | | | | |

TABLE 2

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 5 | 0.4 | 0.05 |
| | | $AlCl_3$/He | 120 → 40** | | | | |
| Upper layer | 1st layer region | $SiH_4$ | 300 | 250 | 15 | 0.5 | 20 |
| | | $H_2$ | 300 | | | | |
| | 2nd layer region | $SiH_4$ | 50 | 250 | 10 | 0.4 | 0.5 |
| | | $CH_4$ | 500 | | | | |

TABLE 3

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 5 | 0.4 | 0.03 |
| | | $H_2$ | 10 → 200* | | | | |
| | | $AlCl_3$/He | | | | | |
| | | (S-side: 0.01 μm) | 100 → 10** | | | | |
| | | (UL-side: 0.02 μm) | 10 | | | | |
| Upper layer | 1st layer region | $SiH_4$ | 300 | 250 | 15 | 0.5 | 20 |
| | | $H_2$ | 300 | | | | |
| | 2nd layer region | $SiH_4$ | 50 | 250 | 10 | 0.4 | 0.5 |
| | | $CH_4$ | 500 | | | | |

TABLE 4

| Order of lamination (layer name) | Gases and their flow rates (SCCM) | | Substrate temperature (°C.) | RF discharging power (mW/cm$^3$) | Inner pressure (Torr) | Layer thickness (μm) |
|---|---|---|---|---|---|---|
| Lower layer | $SiH_4$ | 50 | 150 ↓ 300 | 0.5 ↓ 1.5 | 0.3 | 0.02 |
| | $H_2$ | 5 → 200* | | | | |
| | $AlCl_3$/He | | | | | |
| | (S-side: 0.01 μm) | 200 → 30** | | | | |
| | (UL-side: 0.01 μm) | 30 → 10** | | | | |
| Upper layer | $SiH_4$ | 300 | 250 | 20 | 0.5 | 20 |
| | $H_2$ | 500 | | | | |

TABLE 5

| Order of lamination (layer name) | Gases and their flow rates (SCCM) | | Substrate temperature (°C.) | RF discharging power (mW/cm$^3$) | Inner pressure (Torr) | Layer thickness (μm) |
|---|---|---|---|---|---|---|
| | $SiH_4$ | 50 | | | | |

TABLE 5-continued

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| | | $H_2$ | 5 → 200* | | | | |
| Lower layer | | $AlCl_3$/He | | 250 | 1 | 0.3 | 0.02 |
| | | (S-side: 0.01 μm) | 200 → 30** | | | | |
| | | (UL-side: 0.01 μm) | 30 → 10** | | | | |
| | 1st | $SiH_4$ | 300 | | | | |
| | layer | He | 600 | 250 | 25 | 0.6 | 25 |
| Upper | region | | | | | | |
| layer | | $SiH_4$ | 50 | | | | |
| | 2nd | $CH_4$ | 500 | | | | |
| | layer | NO | 0.1 | 250 | 10 | 0.4 | 1 |
| | region | $N_2$ | 1 | | | | |
| | | $AlCl_3$/He | 0.1 | | | | |

TABLE 6

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| | | $SiH_4$ | 10 → 100* | | | | |
| | | $H_2$ | 5 → 200* | | | | |
| Lower layer | | $AlCl_3$/He | | 250 | 10 | 0.4 | 0.2 |
| | | (S-side: 0.05 μm) | 200 → 40** | | | | |
| | | (UL-side: 0.15 μm) | 40 → 10** | | | | |
| | 1st | $SiH_4$ | 400 | | | | |
| | layer | Ar | 200 | 250 | 10 | 0.5 | 15 |
| Upper | region | | | | | | |
| layer | 2nd | $SiH_4$ | 100 | | | | |
| | layer | $NH_3$ | 30 | 250 | 5 | 0.4 | 0.3 |
| | region | | | | | | |

TABLE 7

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| | | $SiH_4$ | 10 → 100* | | | | |
| | | $H_2$ | 5 → 200* | | | | |
| Lower layer | | $AlCl_3$/He | | 300 | 10 | 0.4 | 0.2 |
| | | (S-side: 0.05 μm) | 200 → 40** | | | | |
| | | (UL-side: 0.15 μm) | 40 → 10** | | | | |
| | 1st | $SiH_4$ | 300 | | | | |
| | layer | $H_2$ | 500 | 300 | 20 | 0.5 | 20 |
| | region | | | | | | |
| Upper | 2nd | $SiH_4$ | 100 | | | | |
| layer | layer | $CH_4$ | 600 | 300 | 15 | 0.4 | 7 |
| | region | $PH_3$(against $SiH_4$) | 3000 ppm | | | | |
| | 3rd | $SiH_4$ | 40 | | | | |
| | layer | $CH_4$ | 600 | 300 | 10 | 0.4 | 0.1 |
| | region | | | | | | |

TABLE 8

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| | | $SiH_4$ | 50 | | | | |
| Lower layer | | $H_2$ | 5 → 200* | 330 | 5 | 0.4 | 0.05 |
| | | $AlCl_3$/He | 200 → 20** | | | | |
| | 1st | $SiH_4$ | 400 | | | | |
| | layer | $SiF_4$ | 10 | 330 | 25 | 0.5 | 25 |
| | region | $H_2$ | 800 | | | | |
| Upper | 2nd | $SiH_4$ | 100 | | | | |
| layer | layer | $CH_4$ | 400 | 350 | 15 | 0.4 | 5 |
| | region | $B_2H_6$(against $SiH_4$) | 5000 ppm | | | | |
| | 3rd | $SiH_4$ | 20 | | | | |
| | layer | $CH_4$ | 400 | 350 | 10 | 0.4 | 1 |
| | region | $B_2H_6$(against $SiH_4$) | 8000 ppm | | | | |

TABLE 9

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | | | | |
| | | $H_2$ | 5 → 200* | | | | |
| | | $AlCl_3$/He | | 300 | 1 | 0.3 | 0.02 |
| | | (S-side: 0.01 μm) | 200 → 30** | | | | |
| | | (UL-side: 0.01 μm) | 30 → 10** | | | | |
| Upper layer | 1st layer region | $SiH_4$ | 300 | | | | |
| | | $H_2$ | 200 | 300 | 20 | 0.5 | 20 |
| | 2nd layer region | $SiH_4$ | 50 | | | | |
| | | $N_2$ | 500 | 300 | 20 | 0.4 | 5 |
| | | $PH_3$(against $SiH_4$) | 3000 ppm | | | | |
| | 3rd layer region | $SiH_4$ | 40 | | | | |
| | | $CH_4$ | 600 | 300 | 10 | 0.4 | 0.3 |

TABLE 10

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | | | | |
| | | $H_2$ | 5 → 200* | 250 | 5 | 0.4 | 0.05 |
| | | $AlCl_3$/He | 200 → 20** | | | | |
| Upper layer | 1st layer region | $SiH_4$ | 300 | | | | |
| | | $H_2$ | 300 | 250 | 15 | 0.5 | 10 |
| | 2nd layer region | $SiH_4$ | 200 | | | | |
| | | $C_2H_2$ | 10 → 20* | 250 | 15 | 0.4 | 20 |
| | | NO | 1 | | | | |

TABLE 11

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | | | | |
| | | $H_2$ | 5 → 200* | | | | |
| | | $AlCl_3$/He | | 250 | 1 | 0.4 | 0.02 |
| | | (S-side: 0.01 μm) | 200 → 30** | | | | |
| | | (UL-side: 0.01 μm) | 30 → 10** | | | | |
| Upper layer | 1st layer region | $SiH_4$ | 300 | | | | |
| | | $H_2$ | 300 | 300 | 20 | 0.5 | 5 |
| | 2nd layer region | $SiH_4$ | 100 | | | | |
| | | $CH_4$ | 100 | 300 | 15 | 0.4 | 20 |
| | 3rd layer region | $SiH_4$ | 50 | | | | |
| | | $CH_4$ | 600 | 300 | 10 | 0.4 | 0.5 |

TABLE 12

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 10 → 100* | | | | |
| | | $H_2$ | 5 → 200* | | | | |
| | | $AlCl_3$/He | | 300 | 5 | 0.4 | 0.2 |
| | | (S-side: 0.05 μm) | 200 → 40** | | | | |
| | | (UL-side: 0.15 μm) | 40 → 10** | | | | |
| Upper layer | 1st layer region | $SiH_4$ | 100 | | | | |
| | | $H_2$ | 300 | 300 | 5 | 0.2 | 8 |
| | 2nd layer region | $SiH_4$ | 300 | | | | |
| | | $NH_3$ | 50 | 300 | 15 | 0.4 | 25 |
| | 3rd layer region | $SiH_4$ | 100 | | | | |
| | | $NH_3$ | 50 | 300 | 10 | 0.4 | 0.3 |

TABLE 13

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10 → 100* | | | | |
| | | $H_2$ | 5 → 200* | | | | |
| | | $AlCl_3$/He | | 250 | 5 | 0.4 | 0.2 |
| | | (S-side: 0.05 μm) | 200 → 40** | | | | |
| | | (UL-side: 0.15 μm) | 40 → 10** | | | | |
| Upper layer | 1st layer region | $SiH_4$ | 100 | | | | |
| | | $SiF_4$ | 5 | 300 | 3 | 0.5 | 3 |
| | | $H_2$ | 200 | | | | |
| | 2nd layer region | $SiH_4$ | 100 | | | | |
| | | $CH_4$ | 100 | 300 | 15 | 0.4 | 30 |
| | | $PH_3$(against $SiH_4$) | 50 ppm | | | | |
| | 3rd layer region | $SiH_4$ | 50 | | | | |
| | | $CH_4$ | 600 | 300 | 10 | 0.4 | 0.5 |

TABLE 14

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | | | | |
| | | $H_2$ | 5 → 200* | 250 | 5 | 0.4 | 0.05 |
| | | $AlCl_3$/He | 200 → 20** | | | | |
| Upper layer | 1st layer region | $SiH_4$ | 200 | | | | |
| | | $H_2$ | 200 | 300 | 10 | 0.5 | 10 |
| | 2nd layer region | $SiH_4$ | 300 | | | | |
| | | $C_2H_2$ | 50 | | | | |
| | | $B_2H_6$(against $SiH_4$) | | 330 | 20 | 0.4 | 30 |
| | | (S-side: 1 μm) | 0 → 100 ppm** | | | | |
| | | (UL-side: 29 μm) | 100 ppm | | | | |
| | 3rd layer region | $SiH_4$ | 200 | | | | |
| | | $C_2H_2$ | 200 | 330 | 10 | 0.4 | 1 |

TABLE 15

| Order of laminaton layer name | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10 → 100* | | | | |
| | | $H_2$ | 5 → 200* | | | | |
| | | $AlCl_3$/He | | 250 | 5 | 0.4 | 0.2 |
| | | (S-side: 0.05 μm) | 200 → 40** | | | | |
| | | (UL-side: 0.15 μm) | 40 → 10** | | | | |
| Upper layer | 1st layer region | $SiH_4$ | 100 | | | | |
| | | $H_2$ | 300 | 300 | 5 | 0.2 | 8 |
| | 2nd layer region | $SiH_4$ | 300 | | | | |
| | | $NH_3$ | 30 → 50* | 300 | 15 | 0.4 | 25 |
| | | $PH_3$(against $SiH_4$) | 50 ppm | | | | |
| | 3rd layer region | $SiH_4$ | 100 | | | | |
| | | $NH_3$ | 80 → 100* | 300 | 5 | 0.4 | 0.7 |
| | | $PH_3$(against $SiH_4$) | 500 ppm | | | | |

TABLE 16

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | | | | |
| | | $H_2$ | 5 → 200* | | | | |
| | | $AlCl_3$/He | | 250 | 1 | 0.4 | 0.02 |
| | | (S-side: 0.01 μm) | 200 → 30** | | | | |
| | | (UL-side: 0.01 μm) | 30 → 10** | | | | |
| Upper | 1st layer region | $SiH_4$ | 300 | | | | |
| | | $H_2$ | 500 | 300 | 20 | 0.5 | 20 |
| | 2nd | $SiH_4$ | 100 | | | | |

TABLE 16-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| layer | layer region | $GeH_4$ | 10 → 50* | 300 | 5 | 0.4 | 1 |
| | | $H_2$ | 300 | | | | |
| | 3rd layer region | $SiH_4$ | 100 → 40** | | | | |
| | | $CH_4$ | 100 → 600* | 300 | 10 | 0.4 | 1 |

TABLE 17

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | | | | |
| | | $H_2$ | 5 → 200* | | | | |
| | | $AlCl_3$/He (S-side: 0.01 μm) | | 300 | 1 | 0.3 | 0.02 |
| | | | 200 → 30** | | | | |
| | | (UL-side: 0.01 μm) | | | | | |
| | | | 30 → 10** | | | | |
| Upper layer | 1st layer region | $SiH_4$ | 300 | | | | |
| | | $H_2$ | 400 | 300 | 15 | 0.5 | 20 |
| | 2nd layer region | $SiH_4$ | 50 | | | | |
| | | $CH_4$ | 500 | 300 | 10 | 0.4 | 0.5 |

TABLE 18

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH^4$ | 50 | | | | |
| | | $H_2$ | 5 → 200* | | | | |
| | | $AlCl_3$/He (S-side: 0.01 μm) | | 300 | 0.7 | 0.3 | 0.02 |
| | | | 200 → 30** | | | | |
| | | (UL-side: 0.01 μm) | | | | | |
| | | | 30 → 10** | | | | |
| Upper layer | 1st layer region | $SiH_4$ | 200 | | | | |
| | | $H_2$ | 400 | 300 | 12 | 0.4 | 20 |
| | 2nd layer region | $SiH_4$ | 40 | | | | |
| | | $CH_4$ | 400 | 300 | 7 | 0.3 | 0.5 |

TABLE 19

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 25 | | | | |
| | | $H_2$ | 5 → 100* | | | | |
| | | $AlCl_3$/He (S-side: 0.01 μm) | | 300 | 0.5 | 0.2 | 0.02 |
| | | | 100 → 15** | | | | |
| | | (UL-side: 0.01 μm) | | | | | |
| | | | 15 → 5** | | | | |
| Upper layer | 1st layer region | $SiH_4$ | 150 | | | | |
| | | $H_2$ | 300 | 300 | 10 | 0.4 | 20 |
| | 2nd layer region | $SiH_4$ | 30 | | | | |
| | | $CH_4$ | 300 | 300 | 5 | 0.3 | 0.5 |

TABLE 20

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| Lower layer | $SiH_4$ | 20 | | | | |
| | $H_2$ | 5 → 100* | | | | |
| | $AlCl_3$/He (S-side: 0.01 μm) | | 300 | 0.3 | 0.2 | 0.02 |
| | | 80 → 15** | | | | |

TABLE 20-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | (UL-side: 0.01 μm) | | | | | |
| | | | 15 → 5** | | | | |
| | 1st | $SiH_4$ | 100 | | | | |
| | layer | $H_2$ | 300 | 300 | 6 | 0.3 | 20 |
| Upper | region | | | | | | |
| layer | 2nd | $SiH_4$ | 20 | | | | |
| | layer | $CH_4$ | 200 | 300 | 3 | 0.2 | 0.5 |
| | region | | | | | | |

TABLE 21

| Order of lamination (layer name) | | Gases and their flow rates (SCCM) | | Substrate temperature (°C.) | RF discharging power (mW/cm3) | Inner pressure (Torr) | Layer thickness (μm) |
|---|---|---|---|---|---|---|---|
| | | $SiH_4$ | 50 | | | | |
| Lower layer | | $H_2$ | 5 → 200* | 500 | 5 | 0.4 | 0.05 |
| | | $AlCl_3$/He | 200 → 20** | | | | |
| | 1st | $SiH_4$ | 300 | | | | |
| | layer | $H_2$ | 1500 | 500 | 30 | 0.5 | 10 |
| Upper | region | | | | | | |
| layer | 2nd | $SiH_4$ | 200 | | | | |
| | layer | $C_2H_2$ | 10 → 20* | 500 | 30 | 0.4 | 20 |
| | region | NO | 1 | | | | |

TABLE 22

| Order of lamination (layer name) | | Gases and their flow rates (SCCM) | | Substrate temperature (°C.) | μW discharging power (mW/cm³) | Inner pressure (Torr) | Layer thickness (μm) |
|---|---|---|---|---|---|---|---|
| | | $SiH_4$ | 150 | | | | |
| | | $H_2$ | 20 → 500* | | | | |
| Lower layer | | $AlCl_3$/He | | 250 | 0.5 | 0.6 | 0.02 |
| | | (S-side: 0.01 μm) | | | | | |
| | | | 400 → 80** | | | | |
| | | (UL-side: 0.01 μm) | | | | | |
| | | | 80 → 50** | | | | |
| | 1st | $SiH_4$ | 700 | | | | |
| | layer | $SiF_4$ | 30 | 250 | 0.5 | 0.5 | 20 |
| Upper | region | $H_2$ | 500 | | | | |
| layer | 2nd | $SiH_4$ | 150 | | | | |
| | layer | $CH_4$ | 500 | 250 | 0.5 | 0.3 | 1 |
| | Region | | | | | | |

TABLE 23

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $SiH_4$ | 50 | | | | |
| Lower layer | | $B_2H_6$(against $SiH_4$) | 100 ppm | 250 | 5 | 0.4 | 0.05 |
| | | $H_2$ | 10 → 200* | | | | |
| | | $AlCl_3$/He | 120 → 40** | | | | |
| | 1st | $SiH_4$ | 300 | | | | |
| | layer | $H_2$ | 300 | 250 | 15 | 0.5 | 20 |
| Upper | region | | | | | | |
| layer | 2nd | $SiH_4$ | 50 | | | | |
| | layer | $CH_4$ | 500 | 250 | 10 | 0.4 | 0.5 |
| | region | | | | | | |

TABLE 24

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 5 | 0.4 | 0.05 |
| | | $AlCl_3$/He | 120 → 40** | | | | |
| | 1st | $SiH_4$ | 300 | | | | |
| | layer | $H_2$ | 300 | 250 | 15 | 0.5 | 20 |
| Upper | region | | | | | | |
| layer | 2nd | $SiH_4$ | 50 | | | | |
| | layer | $CH_4$ | 500 | 250 | 10 | 0.4 | 0.5 |

TABLE 24-continued

| Order of lamination (layer name) | Gases and their flow rates (SCCM) | Substrate temperature (°C.) | RF discharging power (mW/cm$^3$) | Inner pressure (Torr) | Layer thickness (μm) |
|---|---|---|---|---|---|
| region | | | | | |

TABLE 25

| Order of lamination (layer name) | Gases and their flow rates (SCCM) | | Substrate temperature (°C.) | RF discharging power (mW/cm$_3$) | Inner pressure (Torr) | Layer thickness (μm) |
|---|---|---|---|---|---|---|
| | $SiH_4$ | 50 | | | | |
| | $B_2H_6$(against $SiH_4$) | 100 ppm | | | | |
| | $H_2$ | 10 → 200* | | | | |
| Lower layer | $AlCl_3$/He | 250 | 5 | 0.4 | 0.03 | |
| | (S-side: 0.01 μm) | | | | | |
| | | 100 → 10** | | | | |
| | (UL-side: 0.02 μm) | 10 | | | | |
| 1st layer region | $SiH_4$ | 300 | | | | |
| | $H_2$ | 300 | 250 | 15 | 0.5 | 20 |
| Upper layer | | | | | | |
| 2nd layer region | $SiH_4$ | 50 | | | | |
| | $CH_4$ | 500 | 250 | 10 | 0.4 | 0.5 |

TABLE 26

| Order of lamination (layer name) | Gases and their flow rates (SCCM) | | Substrate temperature (°C.) | RF discharging power (mW/cm$^3$) | Inner pressure (Torr) | Layer thickness (μm) |
|---|---|---|---|---|---|---|
| | $SiH_4$ | 50 | | | | |
| | $B_2H_6$(against $SiH_4$) | 100 ppm | | | | |
| | $H_2S$(against $SiH_4$) | 10 ppm | 150 | 0.5 | | |
| Lower layer | $H_2$ | 5 → 200* | ↓ | ↓ | 0.3 | 0.02 |
| | $AlCl_3$/He | | 300 | 1.5 | | |
| | (S-side: 0.01 μm) | | | | | |
| | | 200 → 30** | | | | |
| | (UL-side: 0.01 μm) | | | | | |
| | | 30 → 10** | | | | |
| | $SiH_4$ | 300 | | | | |
| Upper layer | $H_2$ | 600 | 250 | 20 | 0.5 | 20 |

TABLE 27

| Order of lamination (layer name) | Gases and their flow rates (SCCM) | | Substrate temperature (°C.) | RF discharging power (mW/cm$^3$) | Inner pressure (Torr) | Layer thickness (μm) |
|---|---|---|---|---|---|---|
| | $SiH_4$ | 50 | | | | |
| | $B_2H_6$(against $SiH_4$) | 100 ppm | | | | |
| | $H_2$ | 5 → 200* | | | | |
| Lower layer | $AlCl_3$/He | | 250 | 1 | 0.3 | 0.02 |
| | (S-side: 0.01 μm) | | | | | |
| | | 200 → 30** | | | | |
| | (UL-side: 0.01 μm) | | | | | |
| | | 30 → 10 ** | | | | |
| 1st layer region | $SiH_4$ | 300 | | | | |
| | He | 600 | 250 | 25 | 0.6 | 25 |
| Upper layer | | | | | | |
| 2nd layer region | $SiH_4$ | 50 | | | | |
| | $CH_4$ | 500 | | | | |
| | NO | 0.1 | 250 | 10 | 0.4 | 1 |
| | $N_2$ | 1 | | | | |
| | $AlCl_3$/He | 0.1 | | | | |
| | $B_2H_6$(against $SiH_4$) | 10 ppm | | | | |

TABLE 28

| Order of lamination (layer name) | Gases and their flow rates (SCCM) | | Substrate temperature (°C.) | RF discharging power (mW/cm$^3$) | Inner pressure (Torr) | Layer thickness (μm) |
|---|---|---|---|---|---|---|
| | $SiH_4$ | 10 → 100* | | | | |
| | $H_2$ | 5 → 200* | | | | |
| | $B_2H_6$(against $SiH_4$) | 100 ppm | | | | |
| Lower layer | $AlCl_3$/He | | 250 | 10 | 0.4 | 0.2 |
| | (S-side: 0.05 μm) | | | | | |
| | | 200 → 40** | | | | |
| | (UL-side: 0.15 μm) | | | | | |

TABLE 28-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | | 40 → 10** | | | | |
| | 1st layer region | $SiH_4$ | 400 | | | | |
| | | Ar | 200 | 250 | 10 | 0.5 | 15 |
| Upper layer | | | | | | | |
| | 2nd layer region | $SiH_4$ | 100 | | | | |
| | | $NH_3$ | 30 | 250 | 5 | 0.4 | 0.3 |

TABLE 29

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $SiH_4$ | 10 → 100* | | | | |
| | | $H_2$ | 5 → 200* | | | | |
| | | $B_2H_6$(against $SiH_4$) | 100 ppm | | | | |
| Lower layer | | $AlCl_3$/He | | 300 | 10 | 0.4 | 0.2 |
| | | (S-side: 0.05 μm) | | | | | |
| | | | 200 → 40** | | | | |
| | | (UL-side: 0.15 μm) | | | | | |
| | | | 40 → 10** | | | | |
| | 1st layer region | $SiH_4$ | 300 | | | | |
| | | $H_2$ | 500 | 300 | 20 | 0.5 | 20 |
| Upper layer | | | | | | | |
| | 2nd layer region | $SiH_4$ | 100 | | | | |
| | | $CH_4$ | 600 | 300 | 15 | 0.4 | 7 |
| | | $PH_3$(against $SiH_4$) | 3000 ppm | | | | |
| | 3rd layer region | $SiH_4$ | 40 | | | | |
| | | $CH_4$ | 600 | 300 | 10 | 0.4 | 0.1 |

TABLE 30

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $SiH_4$ | 50 | | | | |
| Lower layer | | $PH_3$(against $SiH_4$) | 100 ppm | 330 | 5 | 0.4 | 0.05 |
| | | $H_2$ | 5 → 200* | | | | |
| | | $AlCl_3$/He | 200 → 20** | | | | |
| | 1st layer region | $SiH_4$ | 400 | | | | |
| | | $SiF_4$ | 10 | 330 | 25 | 0.5 | 25 |
| | | $H_2$ | 800 | | | | |
| Upper layer | 2nd layer region | $SiH_4$ | 100 | | | | |
| | | $CH_4$ | 400 | 350 | 15 | 0.4 | 5 |
| | | $B_2H_6$ | | | | | |
| | | (against $SiH_4$) | 5000 ppm | | | | |
| | 3rd layer region | $SiH_4$ | 20 | | | | |
| | | $CH_4$ | 400 | 350 | 10 | 0.4 | 1 |
| | | $B_2H_6$ | | | | | |
| | | (against $SiH_4$) | 8000 ppm | | | | |

TABLE 31

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $SiH_4$ | 50 | | | | |
| | | $B_2H_6$(against $SiH_4$) | 100 ppm | | | | |
| | | $H_2S$ (against $SiH_4$) | 10 ppm | | | | |
| Lower layer | | $H_2$ | 5 → 200* | 300 | 1 | 0.3 | 0.02 |
| | | $AlCl_3$/He | | | | | |
| | | (S-side: 0.01 μm) | | | | | |
| | | | 200 → 30** | | | | |
| | | (UL-side: 0.01 μm) | | | | | |
| | | | 30 → 10** | | | | |
| | 1st layer region | $SiH_4$ | 300 | | | | |
| | | $H_2$ | 200 | 300 | 20 | 0.5 | 20 |
| Upper layer | | | | | | | |
| | 2nd layer | $SiH_4$ | 50 | | | | |
| | | $N_2$ | 500 | 300 | 20 | 0.4 | 5 |

TABLE 31-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | region | $PH_3$(against $SiH_4$) | 3000 ppm | | | | |
| | 3rd layer region | $SiH_4$ | 40 | | | | |
| | | $CH_4$ | 600 | 300 | 10 | 0.4 | 0.3 |

TABLE 32

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | | | | |
| | | $B_2H_6$(against $SiH_4$) | 10 ppm | 250 | 5 | 0.4 | 0.05 |
| | | $H_2$ | 5 → 200* | | | | |
| | | $AlCl_3$/He | 200 → 20** | | | | |
| Upper layer | 1st layer region | $SiH_4$ | 300 | | | | |
| | | $H_2$ | 300 | 250 | 15 | 0.5 | 10 |
| | 2nd layer region | $SiH_4$ | 200 | | | | |
| | | $C_2H_2$ | 10 → 20* | 250 | 15 | 0.4 | 20 |
| | | NO | 1 | | | | |

TABLE 33

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | | | | |
| | | $H_2S$(against $SiH_4$) | 10 ppm | | | | |
| | | $PH_3/H_2$ (100 ppm) | 5 → 200* | | | | |
| | | $AlCl_3$/He (S-side: 0.01 μm) | | 250 | 1 | 0.4 | 0.02 |
| | | | 200 → 30** | | | | |
| | | (UL-side: 0.01 μm) | | | | | |
| | | | 30 → 10** | | | | |
| Upper layer | 1st layer region | $SiH_4$ | 300 | | | | |
| | | $H_2$ | 300 | 300 | 20 | 0.5 | 5 |
| | 2nd layer region | $SiH_4$ | 100 | | | | |
| | | $CH_4$ | 100 | 300 | 15 | 0.4 | 20 |
| | 3rd layer region | $SiH_4$ | 50 | | | | |
| | | $CH_4$ | 600 | 300 | 10 | 0.4 | 0.5 |

TABLE 34

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10 → 100* | | | | |
| | | $B_2H_6/H_2$(100 ppm) | 5 → 200* | | | | |
| | | $AlCl_3$/He (S-side: 0.05 μm) | | 300 | 5 | 0.4 | 0.2 |
| | | | 200 → 40** | | | | |
| | | (UL-side: 0.15 μm) | | | | | |
| | | | 40 → 10** | | | | |
| Upper layer | 1st layer region | $SiH_4$ | 100 | | | | |
| | | $H_2$ | 300 | 300 | 5 | 0.2 | 8 |
| | 2nd layer region | $SiH_4$ | 300 | | | | |
| | | $NH_3$ | 50 | 300 | 15 | 0.4 | 25 |
| | 3rd layer region | $SiH_4$ | 100 | | | | |
| | | $NH_3$ | 50 | 300 | 10 | 0.4 | 0.3 |

TABLE 35

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10 → 100* | 250 | 5 | 0.4 | 0.2 |
| | | $B_2H_6$(against $SiH_4$) | 100 ppm | | | | |
| | | $H_2$ | 5 → 200* | | | | |
| | | $AlCl_3$/He (S-side: 0.05 μm) | 200 → 40** | | | | |
| | | (UL-side: 0.15 μm) | 40 → 10** | | | | |
| Upper layer | 1st layer region | $SiH_4$ | 100 | 300 | 3 | 0.5 | 3 |
| | | $SiF_4$ | 5 | | | | |
| | | $H_2$ | 200 | | | | |
| | 2nd layer region | $SiH_4$ | 100 | 300 | 15 | 0.4 | 30 |
| | | $CH_4$ | 100 | | | | |
| | | $PH_3$(against $SiH_4$) | 50 ppm | | | | |
| | 3rd layer region | $SiH_4$ | 50 | 300 | 10 | 0.4 | 0.5 |
| | | $CH_4$ | 600 | | | | |

TABLE 36

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 5 | 0.4 | 0.05 |
| | | $H_2S$(against $SiH_4$) | 3 ppm | | | | |
| | | $PH_3$(against $SiH_4$) | 100 ppm | | | | |
| | | $H_2$ | 5 → 200* | | | | |
| | | $AlCl_3$/He | 200 → 20** | | | | |
| Upper layer | 1st layer region | $Si_2H_6$ | 200 | 300 | 10 | 0.5 | 10 |
| | | $H_2$ | 200 | | | | |
| | 2nd layer region | $SiH_4$ | 300 | 330 | 20 | 0.4 | 30 |
| | | $C_2H_2$ | 50 | | | | |
| | | $B_2H_6$(against $SiH_4$) (S-side: 1 μm) | 0 → 100 ppm** | | | | |
| | | (UL-side: 29 μm) | 100 ppm | | | | |
| | 3rd layer region | $SiH_4$ | 200 | 330 | 10 | 0.4 | 1 |
| | | $C_2H_2$ | 200 | | | | |

TABLE 37

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10 → 100* | 250 | 5 | 0.4 | 0.2 |
| | | $B_2H_6$(against $SiH_4$) | 100 ppm | | | | |
| | | $H_2$ | 5 → 200* | | | | |
| | | $AlCl_3$/He (S-side: 0.05 μm) | 200 → 40** | | | | |
| | | (UL-side: 0.15 μm) | 40 → 10** | | | | |
| Upper layer | 1st layer region | $SiH_4$ | 100 | 300 | 5 | 0.2 | 8 |
| | | $H_2$ | 300 | | | | |
| | 2nd layer region | $SiH_4$ | 300 | 300 | 15 | 0.4 | 25 |
| | | $NH_3$ | 30 → 50* | | | | |
| | | $PH_3$(against $SiH_4$) | 50 ppm | | | | |
| | 3rd layer region | $SiH_4$ | 100 | 300 | 5 | 0.4 | 0.7 |
| | | $NH_3$ | 80 → 100* | | | | |
| | | $PH_3$(against $SiH_4$) | 500 ppm | | | | |

TABLE 38

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| Lower layer | $SiH_4$ | 50 | 250 | 1 | 0.4 | 0.02 |
| | $B_2H_6$(against $SiH_4$) | 100 ppm | | | | |
| | $H_2$ | 5 → 200* | | | | |

TABLE 38-continued

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| | | $AlCl_3$/He (S-side: 0.01 μm) | 200 → 30** | | | | |
| | | (UL-side: 0.01 μm) | 30 → 10** | | | | |
| Upper layer | 1st layer region | $SiH_4$<br>$H_2$ | 300<br>500 | 300 | 20 | 0.5 | 20 |
| | 2nd layer region | $SiH_4$<br>$GeH_4$<br>$H_2$ | 100<br>10 → 50*<br>300 | 300 | 5 | 0.4 | 1 |
| | 3rd layer region | $SiH_4$<br>$CH_4$ | 100 → 40**<br>100 → 600* | 300 | 10 | 0.4 | 1 |

TABLE 39

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$<br>$B_2H_6$(against $SiH_4$)<br>$H_2$<br>$AlCl_3$/He (S-side: 0.01 μm) | 50<br>100 ppm<br>5 → 200* | 300 | 1 | 0.3 | 0.02 |
| | | (UL-side: 0.01 μm) | 200 → 30**<br>30 → 10** | | | | |
| Upper layer | 1st layer region | $SiH_4$<br>$H_2$ | 300<br>400 | 300 | 15 | 0.5 | 20 |
| | 2nd layer region | $SiH_4$<br>$CH_4$ | 50<br>500 | 300 | 10 | 0.4 | 0.5 |

TABLE 40

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$<br>$B_2H_6$(against $SiH_4$)<br>$H_2$<br>$AlCl_3$/He (S-side: 0.01 μm) | 50<br>100 ppm<br>5 → 200* | 300 | 0.7 | 0.3 | 0.02 |
| | | (UL-side: 0.01 μm) | 200 → 30**<br>30 → 10** | | | | |
| Upper layer | 1st layer region | $SiH_4$<br>$H_2$ | 200<br>400 | 300 | 12 | 0.4 | 20 |
| | 2nd layer region | $SiH_4$<br>$CH_4$ | 40<br>400 | 300 | 7 | 0.3 | 0.5 |

TABLE 41

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$<br>$B_2H_6$(against $SiH_4$)<br>$H_2$<br>$AlCl_3$/He (S-side: 0.01 μm) | 25<br>100 ppm<br>5 → 100* | 300 | 0.5 | 0.2 | 0.02 |
| | | (UL-side: 0.01 μm) | 100 → 15**<br>15 → 5** | | | | |
| Upper layer | 1st layer region | $SiH_4$<br>$H_2$ | 150<br>300 | 300 | 10 | 0.4 | 20 |

TABLE 41-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | 2nd layer region | $SiH_4$<br>$CH_4$ | 30<br>300 | 300 | 5 | 0.3 | 0.5 |

TABLE 42

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$<br>$B_2H_6$(against $SiH_4$)<br>$H_2$<br>$AlCl_3$/He<br>(S-side: 0.01 μm)<br>(UL-side: 0.01 μm) | 20<br>100 ppm<br>5 → 100*<br>80 → 15**<br>15 → 5** | 300 | 0.3 | 0.2 | 0.02 |
| Upper layer | 1st layer region | $SiH_4$<br>$H_2$ | 100<br>300 | 300 | 6 | 0.3 | 20 |
| | 2nd layer region | $SiH_4$<br>$CH_4$ | 20<br>200 | 300 | 3 | 0.2 | 0.5 |

TABLE 43

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$<br>$B_2H_6$(against $SiH_4$)<br>$H_2$<br>$AlCl_3$/He | 50<br>10 ppm<br>5 → 200*<br>200 → 20** | 500 | 5 | 0.4 | 0.05 |
| Upper layer | 1st layer region | $SiH_4$<br>$H_2$ | 300<br>1500 | 500 | 30 | 0.5 | 10 |
| | 2nd layer region | $SiH_4$<br>$C_2H_2$<br>NO | 200<br>10 → 20*<br>1 | 500 | 30 | 0.4 | 20 |

TABLE 44

| Order of lamination (layer name) | | Gases and their flow rates (SCCM) | | Substrate temperature (°C.) | μW discharging power (mW/cm³) | Inner pressure (Torr) | Layer thickness (μm) |
|---|---|---|---|---|---|---|---|
| Lower layer | | $SiH_4$<br>$H_2S$(against $SiH_4$)<br>$PH_3$(against $SiH_4$)<br>$H_2$<br>$AlCl_3$/He<br>(S-side: 0.01 μm)<br>(UL-side: 0.01 μm) | 150<br>3 ppm<br>10 ppm<br>20 → 500*<br>400 → 80**<br>80 → 50** | 250 | 0.5 | 0.6 | 0.02 |
| Upper layer | 1st layer region | $SiH_4$<br>$SiF_4$<br>$H_2$ | 700<br>30<br>500 | 250 | 0.5 | 0.5 | 20 |
| | 2nd layer region | $SiH_4$<br>$CH_4$ | 150<br>500 | 250 | 0.5 | 0.3 | 1 |

TABLE 45

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| Lower layer | $SiH_4$<br>NO<br>$H_2$ | 50<br>5<br>10 → 200* | 250 | 5 | 0.4 | 0.05 |

TABLE 45-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $AlCl_3$/He | 120 → 40** | | | | |
| | 1st layer region | $SiH_4$ | 300 | | | | |
| Upper layer | | $H_2$ | 300 | 250 | 15 | 0.5 | 20 |
| | 2nd layer region | $SiH_4$ | 50 | | | | |
| | | $CH_4$ | 500 | 250 | 10 | 0.4 | 0.5 |

TABLE 46

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $SiH_4$ | 50 | | | | |
| Lower layer | | $AlCl_3$/He | 120 → 40** | 250 | 5 | 0.4 | 0.05 |
| | 1st layer region | $SiH_4$ | 300 | | | | |
| Upper layer | | $H_2$ | 300 | 250 | 15 | 0.5 | 20 |
| | 2nd layer region | $SiH_4$ | 50 | | | | |
| | | $CH_4$ | 500 | 250 | 10 | 0.4 | 0.5 |

TABLE 47

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $SiH_4$ | 50 | | | | |
| | | NO | 5 | | | | |
| Lower layer | | $H_2$ | 10 → 200* | 250 | 5 | 0.4 | 0.03 |
| | | $AlCl_3$/He | | | | | |
| | | (S-side: 0.01 μm) | | | | | |
| | | | 100 → 10** | | | | |
| | | (UL-side: 0.01 μm) | 10 | | | | |
| | 1st layer region | $SiH_4$ | 300 | | | | |
| Upper layer | | $H_2$ | 300 | 250 | 15 | 0.5 | 20 |
| | 2nd layer region | $SiH_4$ | 50 | | | | |
| | | $CH_4$ | 500 | 250 | 10 | 0.4 | 0.5 |

TABLE 48

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| | $SiH_4$ | 50 | | | | |
| | NO | 5 | | | | |
| | $B_2H_6$(against $SiH_4$) | 100 ppm | | | | |
| Lower layer | $H_2$ | 5 → 200* | 150 | 0.5 | | |
| | $AlCl_3$/He | | ↓ | ↓ | 0.3 | 0.02 |
| | (S-side: 0.01 μm) | | 300 | 1.5 | | |
| | | 200 → 30** | | | | |
| | (UL-side: 0.01 μm) | | | | | |
| | | 30 → 10** | | | | |
| | $SiH_4$ | 300 | | | | |
| Upper layer | $H_2$ | 500 | 250 | 20 | 0.5 | 20 |

TABLE 49

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| | $SiH_4$ | 50 | | | | |
| | NO | 5 | | | | |
| | $H_2$ | 5 → 200* | | | | |
| Lower layer | $AlCl_3$/He | | 250 | 1 | 0.3 | 0.02 |
| | (S-side: 0.01 μm) | | | | | |
| | | 200 → 30** | | | | |
| | (UL-side: 0.01 μm) | | | | | |

TABLE 49-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | | 30 → 10** | | | | |
| | | $B_2H_6$(against $SiH_4$) | 100 ppm | | | | |
| | 1st | $SiH_4$ | 300 | | | | |
| Upper layer | layer region | He | 600 | 250 | 25 | 0.6 | 25 |
| | | $SiH_4$ | 50 | | | | |
| | 2nd | $CH_4$ | 500 | | | | |
| | layer | NO | 0.1 | 250 | 10 | 0.4 | 1 |
| | region | $N_2$ | 1 | | | | |
| | | $AlCl_3$/He | 0.1 | | | | |
| | | $B_2H_6$(against $SiH_4$) | 0.3 ppm | | | | |

TABLE 50

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $SiH_4$ | 10 → 100* | | | | |
| | | $H_2$ | 5 → 200* | | | | |
| Lower layer | | $CH_4$ | 50 → 200* | 250 | 10 | 0.4 | 0.2 |
| | | $AlCl_3$/He | | | | | |
| | | (S-side: 0.05 μm) | | | | | |
| | | | 200 → 40** | | | | |
| | | (UL-side: 0.15 μm) | | | | | |
| | | | 40 → 10** | | | | |
| | 1st | $SiH_4$ | 400 | | | | |
| | layer | Ar | 200 | 250 | 10 | 0.5 | 15 |
| Upper layer | region | | | | | | |
| | 2nd | $SiH_4$ | 100 | | | | |
| | layer | $NH_3$ | 30 | 250 | 5 | 0.4 | 0.3 |
| | region | | | | | | |

TABLE 51

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $SiH_4$ | 10 → 100* | | | | |
| | | NO | 5 → 20* | | | | |
| Lower layer | | $H_2$ | 5 → 200* | 300 | 10 | 0.4 | 0.2 |
| | | $B_2H_6$(against $SiH_4$) | 100 ppm | | | | |
| | | $AlCl_3$/He | | | | | |
| | | (S-side: 0.05 μm) | | | | | |
| | | | 200 → 0** | | | | |
| | | (UL-side: 0.15 μm) | | | | | |
| | | | 40 → 10** | | | | |
| | 1st | $SiH_4$ | 300 | | | | |
| | layer | $H_2$ | 500 | 300 | 20 | 0.5 | 20 |
| | region | | | | | | |
| Upper | 2nd | $SiH_4$ | 100 | | | | |
| layer | layer | $CH_4$ | 600 | 300 | 15 | 0.4 | 7 |
| | region | $PH_3$(against $SiH_4$) | 3000 ppm | | | | |
| | 3rd | $SiH_4$ | 40 | | | | |
| | layer | $CH_4$ | 600 | 300 | 10 | 0.4 | 0.1 |
| | region | | | | | | |

TABLE 52

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $SiH_4$ | 50 | | | | |
| | | $PH_3$(against $SiH_4$) | 100 ppm | | | | |
| Lower layer | | NO | 5 | 330 | 5 | 0.4 | 0.05 |
| | | $H_2$ | 5 → 200* | | | | |
| | | $AlCl_3$/He | 200 → 20** | | | | |
| | 1st | $SiH_4$ | 400 | | | | |
| | layer | $SiF_4$ | 10 | 330 | 25 | 0.5 | 25 |
| | region | $H_2$ | 800 | | | | |
| Upper | 2nd | $SiH_4$ | 100 | | | | |
| layer | layer | $CH_4$ | 400 | 350 | 15 | 0.4 | 5 |
| | region | $B_2H_6$ | | | | | |

TABLE 52-continued

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| | | (against $SiH_4$) | 5000 ppm | | | | |
| | 3rd layer region | $SiH_4$ | 20 | | | | |
| | | $CH_4$ | 400 | 350 | 10 | 0.4 | 1 |
| | | $B_2H_6$ (against $SiH_4$) | 8000 ppm | | | | |

TABLE 53

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | | | | |
| | | $CH_2$ | 50 | | | | |
| | | $B_2H_6$(against $SiH_4$) | 100 ppm | | | | |
| | | $H_2S$(against $SiH_4$) | 10 ppm | | | | |
| | | $H_2$ | 5 → 200* | 300 | 1 | 0.3 | 0.02 |
| | | $AlCl_3$/He (S-side: 0.01 μm) | 200 → 30** | | | | |
| | | (UL-side: 0.01 μm) | 30 → 10** | | | | |
| Upper layer | 1st layer region | $SiH_4$ | 300 | | | | |
| | | $H_2$ | 200 | 300 | 20 | 0.5 | 20 |
| | 2nd layer region | $SiH_4$ | 50 | | | | |
| | | $N_2$ | 500 | 300 | 20 | 0.4 | 5 |
| | | $PH_3$(against $SiH_4$) | 3000 ppm | | | | |
| | 3rd layer region | $SiH_4$ | 40 | | | | |
| | | $CH_4$ | 600 | 300 | 10 | 0.4 | 0.3 |

TABLE 54

| Order of lamination (layer name) | | Gases and their flow rates (SCCM) | | Substrate temperature (°C.) | RF discharging power (mW/cm$^3$) | Inner pressure (Torr) | Layer thickness (μ m) |
|---|---|---|---|---|---|---|---|
| Lower layer | | $SiH_4$ | 50 | | | | |
| | | $B_2H_6$(against $SiH_4$) | 100 ppm | | | | |
| | | NO | 5 | 250 | 5 | 0.4 | 0.05 |
| | | $C^2H_2$ | 10 | | | | |
| | | $H_2$ | 5 → 200* | | | | |
| | | $AlCl_3$/He | 200 → 20** | | | | |
| Upper layer | 1st layer region | $SiH_4$ | 300 | | | | |
| | | $H_2$ | 300 | 250 | 15 | 0.5 | 10 |
| | 2nd layer region | $SiH_4$ | 200 | | | | |
| | | $C_2H_2$ | 10 → 20* | 250 | 15 | 0.4 | 20 |
| | | NO | 1 | | | | |

TABLE 55

| Order of lamination (layer name) | | Gases and their flow rates (SCCM) | | Substrate temperature (°C.) | RF discharging power (mW/cm$^3$) | Inner pressure (Torr) | Layer thickness (μ m) |
|---|---|---|---|---|---|---|---|
| Lower layer | | $SiH_4$ | 50 | | | | |
| | | NO | 5 | | | | |
| | | $H_2S$(against $SiH_4$) | 10 ppm | | | | |
| | | $H_2$ | 5 → 200* | | | | |
| | | $AlCl_3$/He (S-side: 0.01 μm) | | 250 | 1 | 0.4 | 0.02 |
| | | | 200 → 30** | | | | |
| | | (UL-side: 0.01 μm) | 30 → 10** | | | | |
| Upper layer | 1st layer region | $SiH_4$ | 300 | | | | |
| | | $H_2$ | 300 | 300 | 20 | 0.5 | 5 |
| | 2nd layer region | $SiH_4$ | 100 | | | | |
| | | $CH_4$ | 100 | 300 | 15 | 0.4 | 20 |
| | 3rd layer region | $SiH_4$ | 50 | | | | |
| | | $CH_4$ | 600 | 300 | 10 | 0.4 | 0.5 |

TABLE 56

| Order of lamination (layer name) | | Gases and their flow rates (SCCM) | | Substrate temperature (°C.) | RF discharging power (mW/cm$^3$) | Inner pressure (Torr) | Layer thickness (μ m) |
|---|---|---|---|---|---|---|---|
| Lower layer | | $SiH_4$ | 10 → 100* | | | | |
| | | $H_2$ | 5 → 200* | | | | |
| | | $NH_3$ | 5 → 50* | | | | |
| | | $AlCl_3$/He (S-side: 0.05 μm) | | 300 | 5 | 0.4 | 0.2 |
| | | (UL-side: 0.15 μm) | 200 → 40* | | | | |
| | | | 40 → 10** | | | | |
| Upper layer | 1st layer region | $SiH_4$ | 100 | | | | |
| | | $H_2$ | 300 | 300 | 5 | 0.2 | 8 |
| | 2nd layer region | $SiH_4$ | 300 | | | | |
| | | $NH_3$ | 50 | 300 | 15 | 0.4 | 25 |
| | 3rd layer region | $SiH_4$ | 100 | | | | |
| | | $NH_3$ | 50 | 300 | 10 | 0.4 | 0.3 |

TABLE 57

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 10 → 100* | | | | |
| | | NO | 5 → 20* | | | | |
| | | $H_2$ | 5 → 200* | | | | |
| | | $AlCl_3$/He (S-side: 0.05 μm) | | 250 | 5 | 0.4 | 0.2 |
| | | (UL-side: 0.15 μm) | 200 → 40** | | | | |
| | | | 40 → 10** | | | | |
| Upper layer | 1st layer region | $SiH_4$ | 100 | | | | |
| | | $SiF_4$ | 5 | 300 | 3 | 0.5 | 3 |
| | | $H_2$ | 200 | | | | |
| | 2nd layer region | $SiH_4$ | 100 | | | | |
| | | $CH_4$ | 100 | 300 | 15 | 0.4 | 30 |
| | | $PH_3$(against $SiH_4$) | 50 ppm | | | | |
| | 3rd layer region | $SiH_4$ | 50 | | | | |
| | | $CH_4$ | 600 | 300 | 10 | 0.4 | 0.5 |

TABLE 58

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | | | | |
| | | $N_2$ | 300 | | | | |
| | | $PH_3$(against $SiH_4$) | 100 ppm | 250 | 5 | 0.4 | 0.05 |
| | | $H_2$ | 5 → 200* | | | | |
| | | $AlCl_3$/He | 200 → 20** | | | | |
| Upper layer | 1st layer region | $SiH_2H_6$ | 200 | | | | |
| | | $H_2$ | 200 | 300 | 10 | 0.5 | 10 |
| | 2nd layer region | $SiH_4$ | 300 | | | | |
| | | $CH_2H_2$ | 50 | | | | |
| | | $B_2H_6$(against $SiH_4$) (S-side: 1 μm) | | 330 | 20 | 0.4 | 30 |
| | | | 0 → 100 ppm** | | | | |
| | | (UL-side: 29 μm) | 100 ppm | | | | |
| | 3rd layer region | $SiH_4$ | 200 | | | | |
| | | $C_2H_2$ | 200 | 330 | 10 | 0.4 | 1 |

TABLE 59

| Order of lamination (layer name) | Gases and their flow rates (SCCM) | | Substrate temperature (°C.) | RF discharging power (mW/cm$^3$) | Inner pressure (Torr) | Layer thickness (μm) |
|---|---|---|---|---|---|---|
| Lower layer | $SiH_4$ | 10 → 100* | | | | |
| | NO | 5 → 20* | | | | |
| | $B_2H_6$(against $SiH_4$) | 100 ppm | | | | |
| | $H_2$ | 5 → 200* | 250 | 5 | 0.4 | 0.2 |
| | $AlCl_3$/He | | | | | |

TABLE 59-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | (S-side: 0.05 μm) | 200 → 40** | | | | |
| | | (UL-side: 0.15 μm) | 40 → 10** | | | | |
| | 1st layer region | $SiH_4$ | 100 | | | | |
| | | $H_2$ | 300 | 300 | 5 | 0.2 | 8 |
| Upper layer | 2nd layer region | $SiH_4$ | 300 | | | | |
| | | $NH_3$ | 30 → 50* | 300 | 15 | 0.4 | 25 |
| | | $PH_3$(against $SiH_4$) | 50 ppm | | | | |
| | 3rd layer region | $SiH_4$ | 100 | | | | |
| | | $NH_3$ | 80 → 100* | 300 | 5 | 0.4 | 0.7 |
| | | $PH_3$(against $SiH_4$) | 500 ppm | | | | |

TABLE 60

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $SiH_4$ | 50 | | | | |
| | | NO | 5 | | | | |
| | | $H_2$ | 5 → 200* | | | | |
| Lower layer | | $AlCl_3$/He | | 250 | 1 | 0.4 | 0.02 |
| | | (S-side: 0.01 μm) | 200 → 30** | | | | |
| | | (UL-side: 0.01 μm) | 30 → 10** | | | | |
| | 1st layer region | $SiH_4$ | 300 | | | | |
| | | $H_2$ | 500 | 300 | 20 | 0.5 | 20 |
| Upper layer | 2nd layer region | $SiH_4$ | 100 | | | | |
| | | $GeH_4$ | 10 → 50* | 300 | 5 | 0.4 | 1 |
| | | $H_2$ | 300 | | | | |
| | 3rd layer region | $SiH_4$ | 100 → 40** | | | | |
| | | $CH_4$ | 100 → 600* | 300 | 10 | 0.4 | 1 |

TABLE 61

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $SiH_4$ | 50 | | | | |
| | | NO | 5 | | | | |
| | | $B_2H_6$(against $SiH_4$) | 100 ppm | | | | |
| Lower layer | | $H_2$ | 5 → 200* | 300 | 1 | 0.3 | 0.02 |
| | | $AlCl_3$/He | | | | | |
| | | (S-side: 0.01 μm) | 200 → 30** | | | | |
| | | (UL-side: 0.01 μm) | 30 → 10** | | | | |
| | 1st layer region | $SiH_4$ | 300 | | | | |
| | | $H_2$ | 400 | 300 | 15 | 0.5 | 20 |
| Upper layer | 2nd layer region | $SiH_4$ | 50 | | | | |
| | | $CH_4$ | 500 | 300 | 10 | 0.4 | 0.5 |

TABLE 62

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| | $SiH_4$ | 50 | | | | |
| | NO | 5 | | | | |
| | $B_2H_6$ | | | | | |
| Lower layer | (against $SiH_4$) | 100 ppm | 300 | 0.7 | 0.3 | 0.02 |
| | $H_2$ | 5 → 200* | | | | |
| | $AlCl_3$/He | | | | | |
| | (S-side: 0.01 μm) | 200 → 30** | | | | |
| | (UL-side: 0.01 μm) | 30 → 10** | | | | |

TABLE 62-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Upper layer | 1st layer region | $SiH_4$<br>$H_2$ | 200<br>400 | 300 | 12 | 0.4 | 20 |
| | 2nd layer region | $SiH_4$<br>$CH_4$ | 40<br>400 | 300 | 7 | 0.3 | 0.5 |

TABLE 63

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$<br>NO<br>$B_2H_6$<br>(against $SiH_4$)<br>$H_2$<br>$AlCl_3$/He<br>(S-side: 0.01 μm)<br>(UL-side: 0.01 μm) | 25<br>3<br>100 ppm<br>5 → 100*<br>100 → 15**<br>15 → 5** | 300 | 0.5 | 0.2 | 0.02 |
| Upper layer | 1st layer region | $SiH_4$<br>$H_2$ | 150<br>300 | 300 | 10 | 0.4 | 20 |
| | 2nd layer region | $SiH_4$<br>$CH_4$ | 30<br>300 | 300 | 5 | 0.3 | 0.5 |

TABLE 64

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$<br>NO<br>$B_2H_6$<br>(against $SiH_4$)<br>$H_2$<br>$AlCl_3$/He<br>(S-side: 0.01 μm)<br>(UL-side: 0.01 μm) | 20<br>2<br>100 ppm<br>5 → 100*<br>80 → 15**<br>15 → 5** | 300 | 0.3 | 0.2 | 0.02 |
| Upper layer | 1st layer region | $SiH_4$<br>$H_2$ | 100<br>300 | 300 | 6 | 0.3 | 20 |
| | 2nd layer region | $SiH_4$<br>$CH_4$ | 20<br>200 | 300 | 3 | 0.2 | 0.5 |

TABLE 65

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$<br>NO<br>$B_2H_6$<br>(against $SiH_4$)<br>$H_2$<br>$AlCl_3$/He | 50<br>5<br>100 ppm<br>5 → 200*<br>200 → 20** | 500 | 5 | 0.4 | 0.05 |
| Upper layer | 1st layer region | $SiH_4$<br>$H_2$ | 300<br>1500 | 500 | 30 | 0.5 | 10 |
| | 2nd layer region | $SiH_4$<br>$C_2H_2$<br>NO | 200<br>10 → 20*<br>1 | 500 | 30 | 0.4 | 20 |

TABLE 66

| Order of lamination (layer name) | | Gases and their flow rates (SCCM) | | Substrate temperature (°C.) | μW discharging power (mW/cm³) | Inner pressure (Torr) | Layer thickness (μm) |
|---|---|---|---|---|---|---|---|
| Lower layer | | $SiH_4$ | 150 | | | | |
| | | NO | 10 | | | | |
| | | $PH_3$ (against $SiH_4$) | 10 ppm | 250 | 0.5 | 0.6 | 0.02 |
| | | $H_2$ | 20 → 500* | | | | |
| | | $AlCl_3$/He (S-side: 0.01 μm) | 400 → 80** | | | | |
| | | (UL-side: 0.01 μm) | 80 → 50** | | | | |
| Upper layer | 1st layer region | $SiH_4$ | 700 | | | | |
| | | $SiF_4$ | 30 | 250 | 0.5 | 0.5 | 20 |
| | | $H_2$ | 500 | | | | |
| | 2nd layer region | $SiH_4$ | 150 | | | | |
| | | $CH_4$ | 500 | 250 | 0.5 | 0.3 | 1 |

TABLE 67

| Order of lamination (layer name) | | Gases of their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | | | | |
| | | $SiF_4$ | 5 | | | | |
| | | NO | 5 | 250 | 5 | 0.4 | 0.05 |
| | | $H_2$ | 10 → 200* | | | | |
| | | $AlCl_3$/He | 120 → 40** | | | | |
| Upper layer | 1st layer region | $SiH_4$ | 300 | | | | |
| | | $H_2$ | 300 | 250 | 15 | 0.5 | 20 |
| | 2nd layer region | $SiH_4$ | 50 | | | | |
| | | $CH_4$ | 500 | 250 | 10 | 0.4 | 0.5 |

TABLE 68

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | | | | |
| | | $AlCl_3$/He | 120 → 40** | 250 | 5 | 0.4 | 0.05 |
| Upper layer | 1st layer region | $SiH_4$ | 300 | | | | |
| | | $H_2$ | 300 | 250 | 15 | 0.5 | 20 |
| | 2nd layer region | $SiH_4$ | 50 | | | | |
| | | $CH_4$ | 500 | 250 | 10 | 0.4 | 0.5 |

TABLE 69

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | | | | |
| | | $SiF_4$ | 5 | | | | |
| | | $H_2$ | 10 → 200* | 250 | 5 | 0.4 | 0.02 |
| | | $AlCl_3$/He (S-side: 0.01 μm) | 100 → 10** | | | | |
| | | (UL-side:0.01 μm) | (UL-side: 0.01 | | | | |
| Upper layer | 1st layer region | $SiH_4$ | 300 | | | | |
| | | $H_2$ | 300 | 250 | 15 | 0.5 | 20 |
| | 2nd layer region | $SiH_4$ | 50 | | | | |
| | | $CH_4$ | 500 | 250 | 10 | 0.4 | 0.5 |

TABLE 70

| Order of lamination (layer name) | Gases and their flow rates (SCCM) | | Substrate temperature (°C.) | RF discharging power (mW/cm$^3$) | Inner pressure (Torr) | Layer thickness (μm) |
|---|---|---|---|---|---|---|
| | $SiH_4$ | 50 | | | | |
| | $SiF_4$ | 5 | | | | |
| | NO | 5 | 150 | 0.5 | | |
| Lower layer | $B_2H_6$ | | ↓ | ↓ | 0.3 | 0.02 |
| | (against $SiH_4$) | 100 ppm | 300 | 1.5 | | |
| | $H_2S$ | | | | | |
| | (against $SiH_4$) | 10 ppm | | | | |
| | $H_2$ | 5 → 200* | | | | |
| | $AlCl_3$/He | | | | | |
| | (S-side: 0.01 μm) | | | | | |
| | | 200 → 30** | | | | |
| | (UL-side: 0.01 μm) | | | | | |
| | | 30 → 10** | | | | |
| | $SiH_4$ | 300 | | | | |
| Upper layer | $H_2$ | 500 | 250 | 20 | 0.5 | 20 |

TABLE 71

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| | | $SiH_4$ | 50 | | | | |
| | | $SiF_4$ | 5 | | | | |
| | | NO | 5 | | | | |
| | | $H_2$ | 5 → 200* | | | | |
| Lower layer | | $AlCl_3$/He | | 250 | 1 | 0.3 | 0.02 |
| | | (S-side: 0.01 μm) | | | | | |
| | | | 200 → 30** | | | | |
| | | (UL-side: 0.01 μm) | | | | | |
| | | | 30 → 10** | | | | |
| | | $B_2H_6$(against $SiH_4$) | 100 ppm | | | | |
| | 1st | $SiH_4$ | 300 | | | | |
| Upper layer | layer region | He | 600 | 250 | 25 | 0.6 | 25 |
| | | $SiH_4$ | 50 | | | | |
| | 2nd | $CH_4$ | 500 | | | | |
| | layer | NO | 0.1 | 250 | 10 | 0.4 | 1 |
| | region | $N_2$ | 1 | | | | |
| | | $AlCl_3$/He | 0.1 | | | | |
| | | $B_2H_6$(against $SiH_4$) | 0.3 ppm | | | | |
| | | $SiF_4$ | 0.5 | | | | |

TABLE 72

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| | | $SiH_4$ | 10 → 100* | | | | |
| | | $SiF_4$ | 1 → 10* | | | | |
| | | $H_2$ | 5 → 200* | | | | |
| Lower layer | | $CH_4$ | 50 → 200* | | | | |
| | | $AlCl_3$/He | | 250 | 10 | 0.4 | 0.2 |
| | | (S-side: 0.05 μm) | | | | | |
| | | | 200 → 40** | | | | |
| | | (UL-side: 0.15 μm) | | | | | |
| | | | 40 → 10** | | | | |
| | | $B_2H_2$(against $SiH_4$) | 100 ppm | | | | |
| | 1st | $SiH_4$ | 400 | | | | |
| Upper layer | layer region | Ar | 200 | 250 | 10 | 0.5 | 15 |
| | 2nd | $SiH_4$ | 100 | | | | |
| | layer | $NH_3$ | 30 | 250 | 5 | 0.4 | 0.3 |
| | region | | | | | | |

TABLE 73

| Order of lamination (layer name) | Gases and their flow rates (SCCM) | | Substrate temperature (°C.) | RF discharging power (mW/cm$^3$) | Inner pressure (Torr) | Layer thickness (μm) |
|---|---|---|---|---|---|---|
| | $SiH_4$ | 10 → 100* | | | | |
| | $SiF_4$ | 1 → 10* | | | | |
| | NO | 5 → 20* | | | | |

TABLE 73-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $H_2$ | 5 → 200* | 300 | 10 | 0.4 | 0.2 |
| | | $B_2H_6$ (against $SiH_4$) | 100 ppm | | | | |
| | | $AlCl_3$/He (S-side: 0.05 μm) | 200 → 0** | | | | |
| | | (UL-side: 0.15 μm) | 40 → 10** | | | | |
| Upper layer | 1st layer region | $SiH_4$ | 300 | | | | |
| | | $H_2$ | 500 | 300 | 20 | 0.5 | 20 |
| | 2nd layer region | $SiH_4$ | 100 | | | | |
| | | $CH_4$ | 600 | 300 | 15 | 0.4 | 7 |
| | | $PH_3$ (against $SiH_4$) | 3000 ppm | | | | |
| | 3rd layer region | $SiH_4$ | 40 | | | | |
| | | $CH_4$ | 600 | 300 | 10 | 0.4 | 0.1 |

TABLE 74

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | | | | |
| | | $SiF_4$ | 5 | | | | |
| | | $PH_3$(against $SiH_4$) | 100 ppm | 330 | 5 | 0.4 | 0.05 |
| | | NO | 5 | | | | |
| | | $H_2$ | 5 → 200* | | | | |
| | | $AlCl_3$/He | 200 → 20** | | | | |
| Upper layer | 1st layer region | $SiH_4$ | 400 | | | | |
| | | $SiF_4$ | 10 | 330 | 25 | 0.5 | 25 |
| | | $H_2$ | 800 | | | | |
| | 2nd layer region | $SiH_4$ | 100 | | | | |
| | | $CH_4$ | 400 | 350 | 15 | 0.4 | 5 |
| | | $B_2H_6$ (against $SiH_4$) | 5000 ppm | | | | |
| 3rd | $SiH_4$ layer region | 20 | | | | | |
| | | $CH_4$ | 400 | 350 | 10 | 0.4 | 1 |
| | | $B_2H_6$ (against $SiH_4$) | 8000 ppm | | | | |

TABLE 75

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | | | | |
| | | $SiF_4$ | 5 | | | | |
| | | $CH_4$ | 50 | | | | |
| | | $H_2S$(against $SiH_4$) | 10 ppm | | | | |
| | | $H_2$ | 5 → 200* | 300 | 1 | 0.3 | 0.02 |
| | | $AlCl_3$/He (S-side: 0.01 μm) | 200 → 30** | | | | |
| | | (UL-side: 0.01 μm) | 30 → 10** | | | | |
| Upper layer | 1st layer region | $SiH_4$ | 300 | | | | |
| | | $H_2$ | 200 | 300 | 20 | 0.5 | 20 |
| | 2nd layer region | $SiH_4$ | 50 | | | | |
| | | $N_2$ | 500 | 300 | 20 | 0.4 | 5 |
| | | $PH_3$ (against $SiH_4$) | 3000 ppm | | | | |
| | 3rd layer region | $SiH_4$ | 40 | | | | |
| | | $CH_4$ | 600 | 300 | 10 | 0.4 | 0.3 |

TABLE 76

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| | $SiH_4$ | 50 | | | | |

TABLE 76-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $B_2H_6$(against $SiH_4$) | 10 ppm | | | | |
| | | NO | 5 | 250 | 5 | 0.4 | 0.05 |
| | | $C_2H_2$ | 10 | | | | |
| | | $AlCl_3$/He | 200 → 20** | | | | |
| Upper layer | 1st layer region | $SiH_4$ | 300 | | | | |
| | | $H_2$ | 300 | 250 | 15 | 0.5 | 10 |
| | 2nd layer region | $SiH_4$ | 200 | | | | |
| | | $C_2H_2$ | 10 → 20* | 250 | 15 | 0.4 | 20 |
| | | NO | 1 | | | | |

TABLE 77

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower Layer | | $PF_5$(against $SiH_4$) | 100 ppm | | | | |
| | | $SiH_4$ | 50 | | | | |
| | | $SiF_4$ | 5 | | | | |
| | | NO | 1 | 250 | 1 | 0.4 | 0.02 |
| | | $H_2S$(against $SiH_4$) | 10 ppm | | | | |
| | | $AlCl_3$/He (S-side: 0.01 μm) | 200 → 30** | | | | |
| | | (UL-side: 0.01 μm) | 30 → 10** | | | | |
| Upper layer | 1st layer region | $SiH^4$ | 300 | | | | |
| | | $H_2$ | 300 | 300 | 20 | 0.5 | 5 |
| | 2nd layer region | $SiH_4$ | 100 | | | | |
| | | $CH_4$ | 100 | 300 | 15 | 0.4 | 20 |
| | 3rd layer region | $SiH_4$ | 50 | | | | |
| | | $CH_4$ | 600 | 300 | 10 | 0.4 | 0.5 |

TABLE 78

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10 → 100* | | | | |
| | | $H_2$ | 5 → 200* | | | | |
| | | $SiF_4$ | 1 → 10* | | | | |
| | | $AlCl_3$/He (S-side: 0.05μm) | | 300 | 5 | 0.4 | 0.2 |
| | | (UL-side: 0.15 μm) | 200 → 40** | | | | |
| | | | 40 → 10** | | | | |
| Upper layer | 1st layer region | $SiH_4$ | 100 | | | | |
| | | $H_2$ | 300 | 300 | 5 | 0.2 | 8 |
| | 2nd layer region | $SiH_4$ | 300 | | | | |
| | | $NH_3$ | 50 | 300 | 15 | 0.4 | 25 |
| | 3rd layer Reglon | $SiH_4$ | 100 | | | | |
| | | $NH_3$ | 50 | 300 | 10 | 0.4 | 0.3 |

TABLE 79

| Order of lamination (layer name) | Gases and their flow rates (S C C M) | | Substrate temperature (°C.) | RF discharging power (mW/cm³) | Inner pressure (Torr) | Layer thickness (μm) |
|---|---|---|---|---|---|---|
| | $SiH_4$ | 1 → 10* | | | | |
| | $PF_3$(against $SiH_4$) | 100 ppm | | | | |
| | $SiH_4$ | 10 → 100* | | | | |
| Lower layer | NO | 5 → 20* | 250 | 5 | 0.4 | 0.2 |
| | $H_2$ | 5 → 200* | | | | |
| $AlCl_3$/He | | | | | | |
| | (S-side:0.05 μm) | 200 → 40** | | | | |
| | (UL-side:0.15 μm) | 40 → 10** | | | | |

TABLE 79-continued

| Order of lamination (layer name) | | Gases and their flow rates (S C C M) | | Substrate temperature (°C.) | RF discharging power (mW/cm³) | Inner pressure (Torr) | Layer thickness (μm) |
|---|---|---|---|---|---|---|---|
| | 1st | $SiH_4$ | 100 | | | | |
| | layer | $SiF_4$ | 5 | 300 | 3 | 0.5 | 3 |
| | region | $H_2$ | 200 | | | | |
| Upper | 2nd | $SiH_4$ | 100 | | | | |
| layer | layer | $CH_4$ | 100 | 300 | 15 | 0.4 | 30 |
| | region | $Ph_3$(against $SiH_4$) | 50 ppm | | | | |
| | 3rd | $SiH_4$ | 50 | | | | |
| | layer | $CH_4$ | 600 | 300 | 10 | 0.4 | 0.5 |
| region | | | | | | | |

TABLE 80

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $Si_2f_6$ | 6 | | | | |
| | | $H_2S$(against $SiH_4$) | 3 ppm | | | | |
| Lower layer | | $SiH_4$ | 50 | 250 | 5 | 0.4 | 0.05 |
| | | $N_2$ | 300 | | | | |
| | | $PH_3$(against $SiH_4$) | 100 ppm | | | | |
| | | $H_2$ | 5 → 200* | | | | |
| | | $AlCl_3$/He | 200 → 20** | | | | |
| | 1st | $Si_2H_6$ | 200 | | | | |
| | layer | $H_2$ | 200 | 300 | 10 | 0.5 | 10 |
| | region | | | | | | |
| Upper | | $SiH_4$ | 300 | | | | |
| layer | 2nd | $C_2H_2$ | 50 | | | | |
| | layer | $B_2H_6$(against $SiH_4$) | | 330 | 20 | 0.4 | 30 |
| | region | (S-side: 1 μm) | | | | | |
| | | | 0 → 100 ppm* | | | | |
| | | (UL-side: 29μm) | 100 ppm | | | | |
| | 3rd | $SiH_4$ | 200 | | | | |
| | layer | $C_2H_2$ | 200 | 330 | 10 | 0.4 | 1 |
| | region | | | | | | |

TABLE 81

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $Si_2F_6$ | 1 → 10* | | | | |
| | | $SiH_4$ | 10 → 100* | | | | |
| Lower layer | | NO | 5 → 20 | 250 | 5 | 0.4 | 0.2 |
| | | $B_2H_6$ | | | | | |
| | | (against $SiH_4$) | 100 ppm | | | | |
| $AlCl_3$/He | | | | | | | |
| | | (S-side:0.05μm) | | | | | |
| | | | 200 → 40** | | | | |
| | | (UL-side:0.15μm) | | | | | |
| | | | 40 → 10** | | | | |
| | 1st | $SiH_4$ | 100 | | | | |
| | layer | $H_2$ | 300 | 300 | 5 | 0.2 | 8 |
| | region | | | | | | |
| Upper | 2nd | $SiH_4$ | 300 | | | | |
| layer | layer | $NH_3$ | 30 → 50* | 300 | 15 | 0.4 | 25 |
| | region | $PH_3$(against $SiH_4$) | 50 ppm | | | | |
| | 3rd | $SiH_4$ | 100 | | | | |
| | layer | $NH_3$ | 80 → 100* | 300 | 5 | 0.4 | 0.7 |
| | region | $PH_3$(against $SiH_4$) | 500 ppm | | | | |

TABLE 82

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| | $SiH_4$ | 50 | | | | |
| Lower layer | $SiF_4$ | 5 | | | | |
| | NO | 5 | | | | |
| | $H_2$ | 5 → 200* | 250 | 1 | 0.4 | 0.02 |
| | $AlCl_3$/He | | | | | |
| | (S-side: 0.01 μm) | | | | | |
| | | 200 → 30** | | | | |
| | (UL-side: 0.01 μm) | | | | | |
| | | 30 → 10** | | | | |

TABLE 82-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Upper layer | 1st layer region | $SiH_4$ | 300 | | | | |
| | | $H_2$ | 500 | 300 | 20 | 0.5 | 20 |
| | 2nd layer region | $SiH_4$ | 100 | | | | |
| | | $GeH_4$ | 10 → 50* | 300 | 5 | 0.4 | 1 |
| | | $H_2$ | 300 | | | | |
| | 3rd layer region | $SiH_4$ | 100 → 40** | | | | |
| | | $CH_4$ | 100 → 600* | 300 | 10 | 0.4 | 1 |

TABLE 83

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | | | | |
| | | $SiF_4$ | 5 | | | | |
| | | NO | 5 | | | | |
| | | $B_2H_6$ | | 300 | 1 | 0.3 | 0.02 |
| | | (against $SiH_4$) | 100 ppm | | | | |
| | | $H_2$ | 5 → 200* | | | | |
| | | $AlCl_3$/He | | | | | |
| | | (S-side: 0.01 μm) | | | | | |
| | | | 200 → 30** | | | | |
| | | (UL-side: 0.01 μm) | | | | | |
| | | | 30 → 10** | | | | |
| Upper layer | 1st layer region | $SiH_4$ | 300 | | | | |
| | | $H_2$ | 400 | 300 | 15 | 0.5 | 20 |
| | 2nd layer region | $SiH_4$ | 50 | | | | |
| | | $CH_4$ | 500 | 300 | 10 | 0.4 | 0.5 |

TABLE 84

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | | | | |
| | | $SiF_4$ | 5 | | | | |
| | | NO | 5 | | | | |
| | | $B_2H_6$ | | 300 | 0.7 | 0.3 | 0.02 |
| | | (against $SiH_4$) | 100 ppm | | | | |
| | | $H_2$ | 5 → 200* | | | | |
| | | $AlCl_3$/He | | | | | |
| | | (S-side: 0.01 μm) | | | | | |
| | | | 200 → 30** | | | | |
| | | (UL-side: 0.01 μm) | | | | | |
| | | | 30 → 10** | | | | |
| Upper layer | 1st layer region | $SiH_4$ | 200 | | | | |
| | | $H_2$ | 400 | 300 | 12 | 0.4 | 20 |
| | 2nd layer region | $SiH_4$ | 40 | | | | |
| | | $CH_4$ | 400 | 300 | 7 | 0.3 | 0.5 |

TABLE 85

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 25 | | | | |
| | | $SiF_4$ | 3 | | | | |
| | | NO | 3 | | | | |
| | | $B_2H_6$ | | 300 | 0.5 | 0.2 | 0.02 |
| | | (against $SiH_4$) | 100 ppm | | | | |
| | | $H_2$ | 5 → 100* | | | | |
| | | $AlCl_3$/He | | | | | |
| | | (S-side: 0.01 μm) | | | | | |
| | | | 100 → 15** | | | | |
| | | (UL-side: 0.01 μm) | | | | | |
| | | | 15 → 5** | | | | |
| Upper | 1st layer | $SiH_4$ | 150 | | | | |
| | | $H_2$ | 300 | 300 | 10 | 0.4 | 20 |

TABLE 85-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| layer | region | | | | | | |
| | 2nd | $SiH_4$ | 30 | | | | |
| | layer | $CH_4$ | 300 | 300 | 5 | 0.3 | 0.5 |
| | region | | | | | | |

TABLE 86

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $SiH_4$ | 20 | | | | |
| Lower layer | | $SiF_4$ | 2 | | | | |
| | | NO | 2 | | | | |
| | | $B_2H_6$ | | 300 | 0.3 | 0.2 | 0.02 |
| | | (against $SiH_4$) | 100 ppm | | | | |
| | | $H_2$ | 5 → 100* | | | | |
| | | $AlCl_3$/He | | | | | |
| | | (S-side: 0.01 μm) | | | | | |
| | | | 80 → 15** | | | | |
| | | (UL-side: 0.01 μm) | | | | | |
| | | | 15 → 5** | | | | |
| | 1st | $SiH_4$ | 100 | | | | |
| Upper layer | layer region | $H_2$ | 300 | 300 | 6 | 0.3 | 20 |
| | 2nd | $SiH_4$ | 20 | | | | |
| | layer | $CH_4$ | 200 | 300 | 3 | 0.2 | 0.5 |
| | region | | | | | | |

TABLE 87

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $SiH_4$ | 50 | | | | |
| Lower layer | | $SiF_4$ | 5 | | | | |
| | | NO | 5 | 500 | 5 | 0.4 | 0.5 |
| | | $B_2H_6$ | | | | | |
| | | (against $SiH_4$) | 100 ppm | | | | |
| | | $H_2$ | 5 → 200* | | | | |
| | | $AlCl_3$/He | 200 → 20** | | | | |
| | 1st | $SiH_4$ | 300 | | | | |
| Upper layer | layer region | $H_2$ | 1500 | 500 | 30 | 0.5 | 10 |
| | 2nd | $SiH_4$ | 200 | | | | |
| | layer | $C_2H_2$ | 10 → 20* | 500 | 30 | 0.4 | 20 |
| | region | NO | | | | | |

TABLE 88

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $SiH_4$ | 150 | | | | |
| Lower layer | | $SiF_4$ | 10 | | | | |
| | | NO | 10 | | | | |
| | | $PH_3$(against $SiH_4$) | 10 ppm | 250 | 0.5 | 0.6 | 0.02 |
| | | $H_2$ | 20 → 500* | | | | |
| | | $AlCl_3$/He | | | | | |
| | | (S-side: 0.01 μm) | | | | | |
| | | | 400 → 80** | | | | |
| | | (UL-side: 0.01 μm) | | | | | |
| | | | 80 → 50** | | | | |
| | 1st | $SiH_4$ | 700 | | | | |
| Upper layer | layer region | $SiF_4$ | 30 | 250 | 0.5 | 0.5 | 20 |
| | | $H_2$ | 500 | | | | |
| | 2nd | $SiH_4$ | 150 | | | | |
| | layer | $CH_4$ | 500 | 250 | 0.5 | 0.3 | 1 |
| | region | | | | | | |

TABLE 89

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 5 | 0.4 | 0.05 |
| | | $GeH_4$ | 5 | | | | |
| | | $H_2$ | 10 → 200* | | | | |
| | | $AlCl_3$/He | 120 → 40** | | | | |
| Upper layer | 1st layer region | $SiH_4$ | 300 | 250 | 15 | 0.5 | 20 |
| | | $H_2$ | 300 | | | | |
| | 2nd layer region | $SiH_4$ | 50 | 250 | 10 | 0.4 | 0.5 |
| | | $CH_4$ | 500 | | | | |

TABLE 90

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 5 | 0.4 | 0.05 |
| | | $AlCl_3$/He | 120 → 40** | | | | |
| Upper layer | 1st layer region | $SiH_4$ | 300 | 250 | 15 | 0.5 | 20 |
| | | $H_2$ | 300 | | | | |
| | 2nd layer region | $SiH_4$ | 50 | 250 | 10 | 0.4 | 0.5 |
| | | $CH_4$ | 500 | | | | |

TABLE 91

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 5 | 0.4 | 0.02 |
| | | $GeH_4$ | 5 | | | | |
| | | $H_2$ | 10 → 200* | | | | |
| | | $AlCl_3$/He (S-side: 0.01 μm) | 100 → 10** | | | | |
| | | (UL-side: 0.01 μm) | 10 | | | | |
| Upper layer | 1st layer region | $SiH_4$ | 300 | 250 | 15 | 0.5 | 20 |
| | | $H_2$ | 300 | | | | |
| | 2nd layer region | $SiH_4$ | 50 | 250 | 10 | 0.4 | 0.5 |
| | | $CH_4$ | 500 | | | | |

TABLE 92

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 150 ↓ 300 | 0.5 ↓ 1.5 | 0.3 | 0.02 |
| | | $GeH_4$ | 5 | | | | |
| | | $B_2H_6$ (against $SiH_4$) | 100 ppm | | | | |
| | | $H_2S$ (against $SiH_4$) | 10 ppm | | | | |
| | | $H_2$ | 5 → 200* | | | | |
| | | $AlCl_3$/He (S-side: 0.01 μm) | 200 → 30** | | | | |
| | | (UL-side: 0.01 μm) | 30 → 10** | | | | |
| Upper layer | | $SiH_4$ | 300 | 250 | 20 | 0.5 | 20 |
| | | $H_2$ | 500 | | | | |

TABLE 93

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | | | | |
| | | $GeH_4$ | 5 | | | | |
| | | NO | 5 | | | | |
| | | $SiF_4$ | 1 | | | | |

TABLE 93-continued

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| | | $H_2$ | 5 → 200* | 250 | 1 | 0.3 | 0.02 |
| | | $B_2H_6$(against $SiH_4$) | 100 ppm** | | | | |
| | | $AlCl_3$/He (S-side: 0.01 μm) | 200 → 30** | | | | |
| | | (UL-side: 0.01 μm) | 30 → 10** | | | | |
| Upper layer | 1st layer region | $SiH_4$ | 300 | | | | |
| | | He | 600 | 250 | 25 | 0.6 | 25 |
| | 2nd layer region | $SiH_4$ | 50 | | | | |
| | | $CH_4$ | 500 | | | | |
| | | NO | 0.1 | 250 | 10 | 0.4 | 1 |
| | | $N_2$ | 1 | | | | |
| | | $AlCl_3$/He | 0.1 | | | | |
| | | $B_2H_6$(against $SiH_4$) | 0.3 ppm | | | | |
| | | $SiF_4$ | 0.5 | | | | |
| | | $GeH_4$ | 1 | | | | |

TABLE 94

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 10 → 100* | | | | |
| | | $GeH_4$ | 1 → 10* | | | | |
| | | $CH_4$ | 50 → 200* | | | | |
| | | $H_2$ | 5 → 200* | | | | |
| | | $B_2H_6$ (against $SiH_4$) | 100 ppm | 250 | 10 | 0.4 | 0.2 |
| | | $AlCl_3$/He (S-side: 0.05 μm) | 120 → 40** | | | | |
| | | (UL-side: 0.15 μm) | 200 → 40** | | | | |
| | | | 40 → 10** | | | | |
| Upper layer | 1st layer region | $SiH_4$ | 400 | | | | |
| | | Ar | 200 | 250 | 10 | 0.5 | 15 |
| | 2nd layer region | $SiH_4$ | 100 | | | | |
| | | $NH_3$ | 30 | 250 | 5 | 0.4 | 0.3 |

TABLE 95

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 10 → 100* | | | | |
| | | $GeH_4$ | 1 → 10* | | | | |
| | | $H_2$ | 5 → 200* | 300 | 10 | 0.4 | 0.2 |
| | | $B_2H_6$ (against $SiH_4$) | 100 ppm | | | | |
| | | $AlCl_3$/He (S-side: 0.05 μm) | 200 → 0** | | | | |
| | | (UL-side: 0.15 μm) | 40 → 10** | | | | |
| Upper layer | 1st layer region | $SiH_4$ | 300 | | | | |
| | | $H_2$ | 500 | 300 | 20 | 0.5 | 20 |
| | 2nd layer region | $SiH_4$ | 100 | | | | |
| | | $CH_4$ | 600 | 300 | 15 | 0.4 | 7 |
| | | $PH_3$ (against $SiH_4$) | 3000 ppm | | | | |
| | 3rd layer region | $SiH_4$ | 40 | | | | |
| | | $CH_4$ | 600 | 300 | 10 | 0.4 | 0.1 |

TABLE 96

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 330 | 5 | 0.4 | 0.05 |
| | | $GeH_4$ | 5 | | | | |
| | | $PH_3$(against $SiH_4$) | 100 ppm | | | | |
| | | $H_2$ | 5 → 200* | | | | |
| | | $AlCl_3$/He | 200 → 20** | | | | |
| Upper layer | 1st layer region | $SiH_4$ | 400 | 330 | 25 | 0.5 | 25 |
| | | $SiF_4$ | 10 | | | | |
| | | $H_2$ | 800 | | | | |
| | 2nd layer region | $SiH_4$ | 100 | 350 | 15 | 0.4 | 5 |
| | | $CH_4$ | 400 | | | | |
| | | $B_2H_6$ (against $SiH_4$) | 5000 ppm | | | | |
| | 3rd layer region | $SiH_4$ | 20 | 350 | 10 | 0.4 | 1 |
| | | $CH_4$ | 400 | | | | |
| | | $B_2H_6$ (against $SiH_4$) | 8000 ppm | | | | |

TABLE 97

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 300 | 1 | 0.3 | 0.02 |
| | | $GeH_4$ | 5 | | | | |
| | | $CH_4$ | 50 | | | | |
| | | $H_2S$(against $SiH_4$) | 10 ppm | | | | |
| | | $H_2$ | 5 → 200* | | | | |
| | | $AlCl_3$/He (S-side: 0.01 μm) | 200 → 30** | | | | |
| | | (UL-side: 0.01 μm) | 30 → 10** | | | | |
| Upper layer | 1st layer region | $SiH_4$ | 300 | 300 | 20 | 0.5 | 20 |
| | | $H_2$ | 200 | | | | |
| | 2nd layer region | $SiH_4$ | 50 | 300 | 20 | 0.4 | 5 |
| | | $N_2$ | 500 | | | | |
| | | $PH_3$ (against $SiH_4$) | 3000 ppm | | | | |
| | 3rd layer region | $SiH_4$ | 40 | 300 | 10 | 0.4 | 0.3 |
| | | $CH_4$ | 600 | | | | |

TABLE 98

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 5 | 0.4 | 0.05 |
| | | $GeH_4$ | 5 | | | | |
| | | NO | 5 | | | | |
| | | $C_2H_2$ | 10 | | | | |
| | | $B_2H_6$ (against $SiH_4$) | 10 ppm | | | | |
| | | $H_2$ | 10 → 200* | | | | |
| | | $AlCl_3$He | 200 → 20** | | | | |
| Upper layer | 1st layer region | $SiH_4$ | 300 | 250 | 15 | 0.5 | 10 |
| | | $H_2$ | 300 | | | | |
| | 2nd layer region | $SiH_4$ | 200 | 250 | 15 | 0.4 | 20 |
| | | $C_2H_2$ | 10 → 20* | | | | |
| | | NO | 1 | | | | |

TABLE 99

| Order of lamination (layer name) | Gases and their flow rates (SCCM) | | Substrate temperature (°C.) | RF discharging power (mW/cm$^3$) | Inner pressure (Torr) | Layer thickness (μm) |
|---|---|---|---|---|---|---|
| Lower layer | $SiH_4$ | 50 | 250 | 1 | 0.4 | 0.02 |
| | $GeH_4$ | 5 | | | | |
| | NO | 1 | | | | |
| | $PF_5$(against $SiH_4$) | 100 ppm | | | | |
| | $H_2S$(against $SiH_4$) | 10 ppm | | | | |
| | $H_2$ | 10 → 200* | | | | |

TABLE 99-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $AlCl_3$/He (S-side: 0.01 μm) | 200 → 30** | | | | |
| | | (UL-side: 0.01 μm) | 30 → 10** | | | | |
| | 1st layer region | $SiH_4$ | 300 | | | | |
| | | $H_2$ | 300 | 300 | 20 | 0.5 | 5 |
| Upper layer | 2nd layer region | $SiH_4$ | 100 | | | | |
| | | $CH_4$ | 100 | 300 | 15 | 0.4 | 20 |
| | 3rd layer region | $SiH_4$ | 50 | | | | |
| | | $CH_4$ | 600 | 300 | 10 | 0.4 | 0.5 |

TABLE 100

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $SiH_4$ | 10 → 100* | | | | |
| | | $GeH_4$ | 1 → 10* | | | | |
| Lower layer | | $H_2$ | 5 → 200* | 300 | 5 | 0.4 | 0.2 |
| | | $AlCl_3$/He (S-side: 0.05 μm) | 200 → 40** | | | | |
| | | (UL-side: 0.15 μm) | 40 → 10** | | | | |
| | 1st layer region | $SiH_4$ | 100 | | | | |
| | | $H_2$ | 300 | 300 | 5 | 0.2 | 8 |
| Upper layer | 2nd layer region | $SiH_4$ | 300 | | | | |
| | | $NH_3$ | 50 | 300 | 15 | 0.4 | 25 |
| | 3rd layer region | $SiH_4$ | 100 | | | | |
| | | $NH_3$ | 50 | 300 | 10 | 0.4 | 0.3 |

TABLE 101

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $SiH_4$ | 10 → 100* | | | | |
| Lower layer | | $GeH_4$ | 1 → 10* | | | | |
| | | NO | 5 → 20* | | | | |
| | | $BF_3$(against $SiH_4$) | 100 ppm | 250 | 5 | 0.4 | 0.2 |
| | | $H_2$ | 2 → 200** | | | | |
| | | $AlCl_3$/He (S-side: 0.05 μm) | 200 → 40** | | | | |
| | | (UL-side: 0.15 μm) | 40 → 10** | | | | |
| | 1st layer region | $SiH_4$ | 100 | | | | |
| Upper layer | | $SiF_4$ | 5 | 300 | 3 | 0.5 | 3 |
| | | $H_2$ | 200 | | | | |
| | 2nd layer region | $SiH_4$ | 100 | | | | |
| | | $CH_4$ | 100 | 300 | 15 | 0.4 | 30 |
| | | $PH_3$(against $SiH_4$) | 50 ppm | | | | |
| | 3rd layer region | $SiH_4$ | 50 | | | | |
| | | $CH_4$ | 600 | 300 | 10 | 0.4 | 0.5 |

TABLE 102

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| | $SiH_4$ | 50 | | | | |
| Lower layer | $GeH_4$ | 5 | | | | |
| | $N_2$ | 300 | | | | |
| | $Si_2F_6$ | 3 | 250 | 5 | 0.4 | 0.05 |
| | $H_2S$(against $SiH_4$) | 3 ppm | | | | |
| | $PH_3$(against $SiH_4$) | 100 ppm | | | | |

TABLE 102-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $H_2$ | 5 → 200* | | | | |
| | | $AlCl_3He$ | 200 → 20** | | | | |
| | 1st | $Si_2H_6$ | 200 | | | | |
| Upper layer | layer region | $H_2$ | 200 | 300 | 10 | 0.5 | 10 |
| | 2nd | $SiH_4$ | 300 | | | | |
| | layer | $C_2H_2$ | 50 | | | | |
| | region | $B_2H_6$(against $SiH_4$) (S-side: 1 μm) | | 330 | 20 | 0.4 | 30 |
| | | | 0 → 100 ppm* | | | | |
| | | (UL-side: 29 μm) | 100 ppm | | | | |
| | 3rd | $SiH_4$ | 200 | | | | |
| | layer region | $C_2H_2$ | 200 | 330 | 10 | 0.4 | 1 |

TABLE 103

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $SiH_4$ | 10 → 100* | | | | |
| Lower layer | | $GeH_4$ | 1 → 10* | | | | |
| | | $B_2H_6$(against $SiH_4$) | 100 ppm | | | | |
| | | $H_2$ | 10 → 200* | 250 | 5 | 0.4 | 0.2 |
| | | $AlCl_3$/He (S-side: 0.05 μm) | | | | | |
| | | | 200 → 40** | | | | |
| | | (UL-side: 0.15 μm) | | | | | |
| | | | 40 → 10** | | | | |
| | 1st | $SiH_4$ | 100 | | | | |
| Upper layer | layer region | $H_2$ | 300 | 300 | 5 | 0.2 | 8 |
| | 2nd | $SiH_4$ | 300 | | | | |
| | layer | $NH_3$ | 30 → 50* | 300 | 15 | 0.4 | 25 |
| | region | $PH_3$(against $SiH_4$) | 50 ppm | | | | |
| | 3rd | $SiH_4$ | 100 | | | | |
| | layer | $NH_3$ | 80 → 100** | 300 | 5 | 0.4 | 0.7 |
| | region | $PH_3$(against $SiH_4$) | 500 ppm | | | | |

TABLE 104

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $SiH_4$ | 50 | | | | |
| Lower layer | | $GeH_4$ | 5 | | | | |
| | | NO | 5 | | | | |
| | | $H_2$ | 5 → 200* | 250 | 1 | 0.4 | 0.02 |
| | | $AlCl_3$/He (S-side: 0.01 μm) | | | | | |
| | | | 200 → 30** | | | | |
| | | (UL-side: 0.01 μm) | | | | | |
| | | | 30 → 10** | | | | |
| | 1st | $SiH_4$ | 300 | | | | |
| Upper layer | layer region | $H_2$ | 500 | 300 | 20 | 0.5 | 20 |
| | 2nd | $SiH_4$ | 100 | | | | |
| | layer | $GeH_4$ | 10 → 50* | 300 | 5 | 0.4 | 1 |
| | region | $H_2$ | 300 | | | | |
| | 3rd | $SiH_4$ | 100 → 40** | | | | |
| | layer | $CH_4$ | 100 → 600* | 300 | 10 | 0.4 | 1 |
| | region | | | | | | |

TABLE 105

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $SiH_4$ | 50 | | | | |
| Lower layer | | $GeH_4$ | 5 | | | | |
| | | NO | 5 | | | | |
| | | $B_2H_6$(against $SiH_4$) | 100 ppm | | | | |
| | | $H_2$ | 5 → 200* | 300 | 1 | 0.3 | 0.02 |
| | | $AlCl_3$/He | | | | | |

TABLE 105-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | (S-side: 0.01 μm) | 200 → 30** | | | | |
| | | (UL-side: 0.01 μm) | 30 → 10** | | | | |
| Upper layer | 1st layer region | $SiH_4$ | 300 | | | | |
| | | $H_2$ | 400 | 300 | 15 | 0.5 | 20 |
| | 2nd layer region | $SiH_4$ | 50 | | | | |
| | | $CH_4$ | 500 | 300 | 10 | 0.4 | 0.5 |

TABLE 106

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | | | | |
| | | $GeH_4$ | 5 | | | | |
| | | NO | 5 | | | | |
| | | $B_2H_6$(against $SiH_4$) | 100 ppm | | | | |
| | | $H_2$ | 5 → 200* | 300 | 0.7 | 0.3 | 0.02 |
| | | $AlCl_3$/He | | | | | |
| | | (S-side: 0.01 μm) | 200 → 30** | | | | |
| | | (UL-side: 0.01 μm) | 30 → 10** | | | | |
| Upper layer | 1st layer region | $SiH_4$ | 200 | | | | |
| | | $H_2$ | 400 | 300 | 12 | 0.4 | 20 |
| | 2nd layer region | $SiH_4$ | 40 | | | | |
| | | $CH_4$ | 400 | 300 | 7 | 0.3 | 0.5 |

TABLE 107

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 25 | | | | |
| | | $GeH_4$ | 3 | | | | |
| | | NO | 3 | | | | |
| | | $B_2H_6$(against $SiH_4$) | 100 ppm | | | | |
| | | $H_2$ | 5 → 100* | 300 | 0.5 | 0.2 | 0.02 |
| | | $AlCl_3$/He | | | | | |
| | | (S-side: 0.01 μm) | 100 → 15** | | | | |
| | | (UL-side: 0.01 μm) | 15 → 5** | | | | |
| Upper layer | 1st layer region | $SiH_4$ | 150 | | | | |
| | | $H_2$ | 300 | 300 | 10 | 0.4 | 20 |
| | 2nd layer region | $SiH_4$ | 30 | | | | |
| | | $CH_4$ | 300 | 300 | 5 | 0.3 | 0.5 |

TABLE 108

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 20 | | | | |
| | | $GeH_4$ | 2 | | | | |
| | | NO | 2 | | | | |
| | | $B_2H_6$(against $SiH_4$) | 100 ppm | | | | |
| | | $H_2$ | 5 → 100* | 300 | 0.3 | 0.2 | 0.02 |
| | | $AlCl_3$/He | | | | | |
| | | (S-side: 0.01 μm) | 80 → 15** | | | | |
| | | (UL-side: 0.01 μm) | 15 → 5** | | | | |
| Upper layer | 1st layer region | $SiH_4$ | 100 | | | | |
| | | $H_2$ | 300 | 300 | 6 | 0.3 | 20 |
| | 2nd | $SiH_4$ | 20 | | | | |

TABLE 108-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | layer region | $CH_4$ | 200 | 300 | 3 | 0.2 | 0.5 |

TABLE 109

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | | | | |
| | | $GeH_4$ | 5 | | | | |
| | | NO | 5 | 500 | 5 | 0.4 | 0.05 |
| | | $B_2H_6$(against $SiH_4$) | 10 ppm | | | | |
| | | $H_2$ | 5 → 200* | | | | |
| | | $AlCl_3$/He | | | | | |
| | | | 200 → 20** | | | | |
| Upper layer | 1st layer region | $SiH_4$ | 300 | | | | |
| | | $H_2$ | 1500 | 500 | 30 | 0.5 | 10 |
| | 2nd layer region | $SiH_4$ | 200 | | | | |
| | | $C_2H_2$ | 10 → 20* | 500 | 30 | 0.4 | 20 |
| | | NO | 1 | | | | |

TABLE 110

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 150 | | | | |
| | | $GeH_4$ | 10 | | | | |
| | | NO | 10 | | | | |
| | | $SiF_4$ | 10 | | | | |
| | | $H_2$ | 20 → 500* | 250 | 0.5 | 0.6 | 0.02 |
| | | $AlCl_3$/He | | | | | |
| | | (S-side: 0.01 μm) | | | | | |
| | | | 400 → 80** | | | | |
| | | (UL-side: 0.01 μm) | | | | | |
| | | | 80 → 50** | | | | |
| Upper layer | 1st layer region | $SiH_4$ | 700 | | | | |
| | | $SiF_4$ | 30 | 250 | 0.5 | 0.5 | 20 |
| | | $H_2$ | 500 | | | | |
| | 2nd layer region | $SiH_4$ | 150 | | | | |
| | | $CH_4$ | 500 | 250 | 0.5 | 0.3 | 1 |

TABLE 111

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | | | | |
| | | $Mg(C_5H_5)_2$/He | 10 | 250 | 5 | 0.4 | 0.05 |
| | | $H_2$ | 10 → 200* | | | | |
| | | $AlCl_3$/He | 120 → 40** | | | | |
| Upper layer | 1st layer region | $SiH_4$ | 300 | | | | |
| | | $H_2$ | 300 | 250 | 15 | 0.5 | 20 |
| | 2nd layer region | $SiH_4$ | 50 | | | | |
| | | $CH_4$ | 500 | 250 | 10 | 0.4 | 0.5 |

TABLE 112

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | | | | |
| | | $AlCl_3$/He | 120 → 40** | 250 | 5 | 0.4 | 0.05 |
| Upper layer | 1st layer region | $SiH_4$ | 300 | | | | |
| | | $H_2$ | 300 | 250 | 15 | 0.5 | 20 |
| | 2nd layer | $SiH_4$ | 50 | | | | |
| | | $CH_4$ | 500 | 250 | 10 | 0.4 | 0.5 |

TABLE 112-continued

| Order of lamination (layer name) | Gases and their flow rates (SCCM) | | Substrate temperature (°C.) | RF discharging power (mW/cm$^3$) | Inner pressure (Torr) | Layer thickness (μm) |
|---|---|---|---|---|---|---|
| region | | | | | | |

TABLE 113

| Order of lamination (layer name) | Gases and their flow rates (SCCM) | | Substrate temperature (°C.) | RF discharging power (mW/cm$^3$) | Inner pressure (Torr) | Layer thickness (μm) |
|---|---|---|---|---|---|---|
| | $SiH_4$ | 50 | | | | |
| Lower layer | $Mg(C_5H_5)_2$/He | 5 | | | | |
| | $H_2$ | 10 → 200* | | | | |
| | $AlCl_3$/He | | 250 | 5 | 0.4 | 0.02 |
| | (S-side: 0.01 μm) | | | | | |
| | | 100 → 10** | | | | |
| | (UL-side: 0.01 μm) | 10 | | | | |
| 1st | $SiH_4$ | 300 | | | | |
| Upper layer region | $H_2$ | 300 | 250 | 15 | 0.5 | 20 |
| 2nd | $SiH_4$ | 50 | | | | |
| layer region | $CH_4$ | 500 | 250 | 10 | 0.4 | 0.5 |

TABLE 114

| Order of lamination (layer name) | Gases and their flow rates (SCCM) | | Substrate temperature (°C.) | RF discharging power (mW/cm$^3$) | Inner pressure (Torr) | Layer thickness (μm) |
|---|---|---|---|---|---|---|
| | $SiH_4$ | 50 | | | | |
| Lower layer | $B_2H_6$(against $SiH_4$) | 100 ppm | | | | |
| | $H_2S$(against $SiH_4$) | 10 ppm | | | | |
| | $Mg(C_5H_5)_2$/He | 8 | 150 | 0.5 | | |
| | $H_2$ | 5 → 200* | ↓ | ↓ | 0.3 | 0.02 |
| | $AlCl_3$/He | | 300 | 1.5 | | |
| | (S-side: 0.01 μm) | | | | | |
| | | 200 → 30** | | | | |
| | (UL-side: 0.01 μm) | | | | | |
| | | 30 → 10** | | | | |
| Upper layer | $SiH_4$ | 300 | | | | |
| | $H_2$ | 500 | 250 | 20 | 0.5 | 20 |

TABLE 115

| Order of lamination (layer name) | Gases and their flow rates (SCCM) | | Substrate temperature (°C.) | RF discharging power (mW/cm$^3$) | Inner pressure (Torr) | Layer thickness (μm) |
|---|---|---|---|---|---|---|
| | $SiH_4$ | 50 | | | | |
| Lower layer | $SiF_4$ | 3 | | | | |
| | NO | 5 | | | | |
| | $Mg(C_5H_5)_2$/He | 8 | | | | |
| | $GeH_4$ | 5 | 250 | 1 | 0.3 | 0.02 |
| | $B_2H_6$(against $SiH_4$) | 100 ppm | | | | |
| | $H_2$ | 5 → 200* | | | | |
| | $AlCl_3$/He | | | | | |
| | (S-side: 0.01 μm) | | | | | |
| | | 200 → 30** | | | | |
| | (UL-side: 0.01 μm) | | | | | |
| | | 30 → 10** | | | | |
| 1st | $SiH_4$ | 300 | | | | |
| Upper layer region | He | 600 | 250 | 25 | 0.6 | 25 |
| 2nd | $SiH_4$ | 50 | | | | |
| layer | $CH_4$ | 500 | | | | |
| region | NO | 0.1 | | | | |
| | $N_2$ | 1 | 250 | 10 | 0.4 | 1 |
| | $GeH_4$ | 0.5 | | | | |
| | $B_2H_6$(against $SiH_4$) | 0.3 ppm | | | | |
| | $Al_2Cl_3$/He | 0.1 | | | | |
| | $SiF_4$ | 0.5 | | | | |
| | $Mg(C_5H_5)_2$/He | 0.1 | | | | |

TABLE 116

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 10 → 100* | | | | |
| | | $Mg(C_5H_5)_2$/He | 1 → 10* | | | | |
| | | $CH_4$ | 50 → 200* | | | | |
| | | $H_2$ | 5 → 200* | 250 | 10 | 0.4 | 0.2 |
| | | $B_2H_6$(against $SiH_4$) | 100 ppm | | | | |
| | | $Al(CH_3)_3$/He (S-side: 0.05 μm) | 200 → 40** | | | | |
| | | (UL-side: 0.15 μm) | 40 → 10** | | | | |
| Upper layer | 1st layer region | $SiH_4$ | 400 | | | | |
| | | Ar | 200 | 250 | 10 | 0.5 | 15 |
| | 2nd layer region | $SiH_4$ | 100 | | | | |
| | | $NH_3$ | 30 | 250 | 5 | 0.4 | 0.3 |

TABLE 117

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 10 → 100* | | | | |
| | | NO | 1 → 10* | | | | |
| | | $Mg(C_5H_5)_2$/He | 20 | | | | |
| | | $H_2$ | 5 → 200* | 300 | 10 | 0.4 | 0.2 |
| | | $B_2H_6$(against $SiH_4$) | 100 ppm | | | | |
| | | $AlCl_3$/He (S-side: 0.05 μm) | 200 → 0** | | | | |
| | | (UL-side: 0.15 μm) | 40 → 10** | | | | |
| Upper layer | 1st layer region | $SiH_4$ | 300 | | | | |
| | | $H_2$ | 500 | 300 | 20 | 0.5 | 20 |
| | 2nd layer region | $SiH_4$ | 100 | | | | |
| | | $CH_4$ | 600 | 300 | 15 | 0.4 | 7 |
| | | $PH_3$(against $SiH_4$) | 3000 ppm | | | | |
| | 3rd layer region | $SiH_4$ | 40 | | | | |
| | | $CH_4$ | 600 | 300 | 10 | 0.4 | 0.1 |

TABLE 118

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | | | | |
| | | $GeH_4$ | 5 | | | | |
| | | $PH_3$(against $SiH_4$) | 100 ppm | 330 | 5 | 0.4 | 0.05 |
| | | $Mg(C_5H_5)_2$/He | 8 | | | | |
| | | $H_2$ | 5 → 200* | | | | |
| | | $AlCl_3$/He | 200 → 20** | | | | |
| Upper layer | 1st layer region | $SiH_4$ | 400 | | | | |
| | | $SiF_4$ | 10 | 330 | 25 | 0.5 | 25 |
| | | $H_2$ | 800 | | | | |
| | 2nd layer region | $SiH_4$ | 100 | | | | |
| | | $CH_4$ | 400 | 350 | 15 | 0.4 | 5 |
| | | $B_2H_6$(against $SiH_4$) | 5000 ppm | | | | |
| | 3rd layer region | $SiH_4$ | 20 | | | | |
| | | $CH_4$ | 400 | 350 | 10 | 0.4 | 1 |
| | | $B_2H_6$(against $SiH_4$) | 8000 ppm | | | | |

TABLE 119

| Order of lamination (layer name) | Gases and their flow rates (SCCM) | | Substrate temperature (°C.) | RF discharging power (mW/cm$^3$) | Inner pressure (Torr) | Layer thickness (μm) |
|---|---|---|---|---|---|---|
| Lower layer | $SiH_4$ | 50 | | | | |
| | $Mg(C_5H_5)_2$/He | 5 | | | | |
| | $CH_4$ | 50 | | | | |
| | $H_2S$(against $SiH_4$) | 10 ppm | 300 | 1 | 0.3 | 0.02 |

TABLE 119-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $H_2$ | 5 → 200* | | | | |
| | | $AlCl_3$/He | | | | | |
| | | (S-side: 0.01 μm) | | | | | |
| | | | 200 → 30** | | | | |
| | | (UL-side: 0.01 μm) | | | | | |
| | | | 30 → 10** | | | | |
| | 1st | $SiH_4$ | 300 | | | | |
| Upper layer | layer region | $H_2$ | 200 | 300 | 20 | 0.5 | 20 |
| | 2nd | $SiH_4$ | 50 | | | | |
| | layer | $N_2$ | 500 | 300 | 20 | 0.4 | 5 |
| | region | $PH_3$(against $SiH_4$) | 3000 ppm | | | | |
| | 3rd | $SiH_4$ | 40 | | | | |
| | layer | $CH_4$ | 600 | 300 | 10 | 0.4 | 0.3 |
| | region | | | | | | |

TABLE 120

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $SiH_4$ | 50 | | | | |
| Lower layer | | $B_2H_6$(against $SiH_4$) | 10 ppm | | | | |
| | | $Mg(C_5H_5)_2$/He | 10 | 250 | 5 | 0.4 | 0.05 |
| | | $C_2H_2$ | 10 | | | | |
| | | $H_2$ | 5 → 200* | | | | |
| | | $AlCl_3$/He | 200 → 20** | | | | |
| | 1st | $SiH_4$ | 300 | | | | |
| Upper layer | layer region | $H_2$ | 300 | 250 | 15 | 0.5 | 10 |
| | 2nd | $SiH_4$ | 200 | | | | |
| | layer | $C_2H_2$ | 10 → 20* | 250 | 15 | 0.4 | 20 |
| | region | NO | 1 | | | | |

TABLE 121

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $SiH_4$ | 50 | | | | |
| Lower layer | | $Mg(C_5H_5)_2$/He | 5 | | | | |
| | | $PF_5$(against $SiH_4$) | 100 ppm | | | | |
| | | $H_2S$(against $SiH_4$) | 10 ppm | | | | |
| | | $H_2$ | 10 → 200* | 250 | 1 | 0.4 | 0.02 |
| | | $AlCl_3$/He | | | | | |
| | | (S-side: 0.01 μm) | | | | | |
| | | | 200 → 30** | | | | |
| | | (UL-side: 0.01 μm) | | | | | |
| | | | 30 → 10** | | | | |
| | 1st | $SiH_4$ | 300 | | | | |
| Upper layer | layer region | $H_2$ | 300 | 300 | 20 | 0.5 | 5 |
| | 2nd | $SiH_4$ | 100 | | | | |
| | layer region | $CH_4$ | 100 | 300 | 15 | 0.4 | 20 |
| | 3rd | $SiH_4$ | 50 | | | | |
| | layer region | $CH_4$ | 600 | 300 | 10 | 0.4 | 0.5 |

TABLE 122

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $SiH_4$ | 10 → 100* | | | | |
| Lower layer | | $Mg(C_5H_5)_2$/He | 1 → 10* | | | | |
| | | $H_2$ | 5 → 200* | | | | |
| | | $AlCl_3$/He | | 300 | 5 | 0.4 | 0.2 |
| | | (S-side: 0.05 μm) | | | | | |
| | | | 200 → 40** | | | | |
| | | (UL-side: 0.15 μm) | | | | | |
| | | | 40 → 10** | | | | |
| | 1st | $SiH_4$ | 100 | | | | |
| Upper | layer | $H_2$ | 300 | 300 | 5 | 0.2 | 8 |

TABLE 122-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| layer | region | | | | | | |
| | 2nd | $SiH_4$ | 300 | | | | |
| | layer | $NH_3$ | 50 | 300 | 15 | 0.4 | 25 |
| | region | | | | | | |
| | 3rd | $SiH_4$ | 100 | | | | |
| | layer | $NH_3$ | 50 | 300 | 10 | 0.4 | 0.3 |
| | region | | | | | | |

TABLE 123

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $SiH_4$ | 10 → 100* | | | | |
| Lower layer | | NO | 5 | | | | |
| | | $Mg(C_5H_5)_2$/He | 5 → 0** | | | | |
| | | $BF_3$(against $SiH_4$) | 100 ppm | | | | |
| | | $H_2$ | 5 → 200* | 250 | 5 | 0.4 | 0.2 |
| | | $AlCl_3$/He | | | | | |
| | | (S-side: 0.05 μm) | | | | | |
| | | | 200 → 40** | | | | |
| | | (UL-side: 0.15 μm) | | | | | |
| | | | 40 → 10** | | | | |
| | 1st | $SiH_4$ | 100 | | | | |
| Upper | layer | $SiF_4$ | 5 | 300 | 3 | 0.5 | 3 |
| layer | region | $H_2$ | 200 | | | | |
| | 2nd | $SiH_4$ | 100 | | | | |
| | layer | $CH_4$ | 100 | 300 | 15 | 0.4 | 30 |
| | region | $PH_3$(against $SiH_4$) | 50 ppm | | | | |
| | 3rd | $SiH_4$ | 50 | | | | |
| | layer | $CH_4$ | 600 | 300 | 10 | 0.4 | 0.5 |
| | region | | | | | | |

TABLE 124

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $SiH_4$ | 50 | | | | |
| Lower layer | | $Si_2F_6$ | 5 | | | | |
| | | $N_2$ | 300 | | | | |
| | | $Mg(C_5H_5)_2$/He | 15 | 250 | 5 | 0.4 | 0.05 |
| | | $H_2S$(against $SiH_4$) | 3 ppm | | | | |
| | | $PH_3$(against $SiH_4$) | 100 ppm | | | | |
| | | $H_2$ | 5 → 200* | | | | |
| | | $AlCl_3$/He | 200 → 20** | | | | |
| | 1st | $Si_2H_6$ | 200 | | | | |
| Upper | layer | $H_2$ | 200 | 300 | 10 | 0.5 | 10 |
| layer | region | | | | | | |
| | 2nd | $SiH_4$ | 300 | | | | |
| | layer | $C_2H_2$ | 50 | | | | |
| | region | $B_2H_6$(against $SiH_4$) | | 330 | 20 | 0.4 | 30 |
| | | (S-side: 1 μm) | | | | | |
| | | | 0 → 100 ppm** | | | | |
| | | (UL-side: 29 μm) | 100 ppm | | | | |
| | 3rd | $SiH_4$ | 200 | | | | |
| | layer | $C_2H_2$ | 200 | 330 | 10 | 0.4 | 1 |
| | region | | | | | | |

TABLE 125

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| | $SiH_4$ | 10 → 100* | | | | |
| Lower layer | $Mg(C_5H_5)_2$/He | 10 | | | | |
| | $H_2$ | 10 → 200* | | | | |
| | $B_2H_6$(against $SiH_4$) | 100 ppm | 250 | 5 | 0.4 | 0.2 |
| | $AlCl_3$/He | | | | | |
| | (S-side: 0.05 μm) | | | | | |
| | | 200 → 40** | | | | |
| | (UL-side: 0.15 μm) | | | | | |
| | | 40 → 10** | | | | |

TABLE 125-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Upper layer | 1st layer region | $SiH_4$ | 100 | | | | |
| | | $H_2$ | 300 | 300 | 5 | 0.2 | 8 |
| | 2nd layer region | $SiH_4$ | 300 | | | | |
| | | $NH_3$ | 30 → 50* | 300 | 15 | 0.4 | 25 |
| | | $PH_3$(against $SiH_4$) | 50 ppm | | | | |
| | 3rd layer region | $SiH_4$ | 100 | | | | |
| | | $NH_3$ | 80 → 100* | 300 | 5 | 0.4 | 0.7 |
| | | $PH_3$(against $SiH_4$) | 500 ppm | | | | |

TABLE 126

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | | | | |
| | | $GeH_4$ | 10 | | | | |
| | | $Mg(C_5H_5)_2$/He | 8 | | | | |
| | | $H_2$ | 5 → 200* | 250 | 1 | 0.4 | 0.02 |
| | | $AlCl_3$/He | | | | | |
| | | (S-side: 0.01 μm) | | | | | |
| | | | 200 → 30** | | | | |
| | | (UL-side: 0.01 μm) | | | | | |
| | | | 30 → 10** | | | | |
| Upper layer | 1st layer region | $SiH_4$ | 300 | | | | |
| | | $H_2$ | 500 | 300 | 20 | 0.5 | 20 |
| | 2nd layer region | $SiH_4$ | 100 | | | | |
| | | $GeH_4$ | 10 → 50* | 300 | 5 | 0.4 | 1 |
| | | $H_2$ | 300 | | | | |
| | 3rd layer region | $SiH_4$ | 100 → 40** | | | | |
| | | $CH_4$ | 100 → 600* | 300 | 10 | 0.4 | 1 |

TABLE 127

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | | | | |
| | | $SiF_4$ | 5 | | | | |
| | | NO | 5 | | | | |
| | | $Mg(C_5H_5)_2$/He | 10 | 300 | 1 | 0.3 | 0.02 |
| | | $B_2H_6$(against $SiH_4$) | 100 ppm | | | | |
| | | $H_2$ | 5 → 200* | | | | |
| | | $AlCl_3$/He | | | | | |
| | | (S-side: 0.01 μm) | | | | | |
| | | | 200 → 30** | | | | |
| | | (UL-side: 0.01 μm) | | | | | |
| | | | 30 → 10** | | | | |
| Upper layer | 1st layer region | $SiH_4$ | 300 | | | | |
| | | $H_2$ | 400 | 300 | 15 | 0.5 | 20 |
| | 2nd layer region | $SiH_4$ | 50 | | | | |
| | | $CH_4$ | 500 | 300 | 10 | 0.4 | 0.5 |

TABLE 128

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | | | | |
| | | $Mg(C_5H_5)_2$/He | 5 | | | | |
| | | $B_2H_6$(against $SiH_4$) | 100 ppm | | | | |
| | | $H_2$ | 5 → 200* | 300 | 0.7 | 0.3 | 0.02 |
| | | $AlCl_3$/He | | | | | |
| | | (S-side: 0.01 μm) | | | | | |
| | | | 200 → 30** | | | | |
| | | (UL-side: 0.01 μm) | | | | | |
| | | | 30 → 10** | | | | |
| Upper layer | 1st layer region | $SiH_4$ | 200 | | | | |
| | | $H_2$ | 400 | 300 | 12 | 0.4 | 20 |

TABLE 128-continued

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| | 2nd layer region | $SiH_4$ | 40 | | | | |
| | | $CH_4$ | 400 | 300 | 7 | 0.3 | 0.5 |

TABLE 129

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 25 | | | | |
| | | NO | 3 | | | | |
| | | $Mg(C_5H_5)_2$/He | 8 | | | | |
| | | $B_2H_6$(against $SiH_4$) | 100 ppm | 300 | 0.5 | 0.2 | 0.02 |
| | | $H_2$ | 5 → 200* | | | | |
| | | $AlCl_3$/He (S-side: 0.01 μm) | 100 → 15** | | | | |
| | | (UL-side: 0.01 μm) | 15 → 5** | | | | |
| Upper layer | 1st layer region | $SiH_4$ | 150 | | | | |
| | | $H_2$ | 300 | 300 | 10 | 0.4 | 20 |
| | 2nd layer region | $SiH_4$ | 30 | | | | |
| | | $CH_4$ | 300 | 300 | 5 | 0.3 | 0.5 |

TABLE 130

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 20 | | | | |
| | | NO | 2 | | | | |
| | | $Mg(C_5H_5)_2$/He | 5 | | | | |
| | | $B_2H_6$(against $SiH_4$) | 100 ppm | | | | |
| | | $H_2$ | 5 → 100* | 300 | 0.3 | 0.2 | 0.02 |
| | | $AlCl_3$/He (S-side: 0.01 μm) | 80 → 15** | | | | |
| | | (UL-side: 0.01 μm) | 15 → 5** | | | | |
| Upper layer | 1st layer region | $SiH_4$ | 100 | | | | |
| | | $H_2$ | 300 | 300 | 6 | 0.3 | 20 |
| | 2nd layer region | $SiH_4$ | 20 | | | | |
| | | $CH_4$ | 200 | 300 | 3 | 0.2 | 0.5 |

TABLE 131

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | | | | |
| | | $C_2H_2$ | 10 | | | | |
| | | $Mg(C_5H_5)_2$/He | 10 | 500 | 5 | 0.4 | 0.05 |
| | | $B_2H_6$(against $SiH_4$) | 10 ppm | | | | |
| | | $H_2$ | 5 → 200* | | | | |
| | | $AlCl_3$/He | 200 → 20** | | | | |
| Upper layer | 1st layer region | $SiH_4$ | 300 | | | | |
| | | $H_2$ | 1500 | 500 | 30 | 0.5 | 10 |
| | 2nd layer region | $SiH_4$ | 200 | | | | |
| | | $C_2H_2$ | 10 → 20* | 500 | 30 | 0.4 | 20 |
| | | NO | 1 | | | | |

TABLE 132

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 150 | | | | |
| | | $SiF_4$ | 10 | | | | |

TABLE 132-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | NO | 10 | | | | |
| | | $Mg(C_5H_5)_2$/He | 8 | | | | |
| | | $B_2H_6$(against $SiH_4$) | 10 ppm | | | | |
| | | $H_2$ | 20 → 500* | 250 | 0.5 | 0.6 | 0.02 |
| | | $AlCl_3$/He (S-side: 0.01 μm) | 400 → 80** | | | | |
| | | (UL-side: 0.01 μm) | 80 → 50** | | | | |
| Upper layer | 1st layer region | $SiH_4$ | 700 | | | | |
| | | $SiF_4$ | 30 | 250 | 0.5 | 0.5 | 20 |
| | | $H_2$ | 500 | | | | |
| | 2nd layer region | $SiH_4$ | 150 | | | | |
| | | $CH_4$ | 500 | 250 | 0.5 | 0.3 | 1 |

TABLE 133

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10 → 50* | | | | |
| | | $H_2$ | 5 → 100* | 300 | 1 | 0.01 | 0.2 |
| | | Ar | 200 | | | | |
| Upper layer | 1st layer region | $SiH_4$ | 300 | | | | |
| | | $H_2$ | 300 | 300 | 15 | 0.5 | 20 |
| | 2nd layer region | $SiH_4$ | 50 | | | | |
| | | $CH_4$ | 500 | 300 | 10 | 0.4 | 0.5 |

TABLE 134

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | | | | |
| | | $Cu(C_4H_7N_2O_2)_2$/He | 5 | 250 | 5 | 0.4 | 0.05 |
| | | $H_2$ | 10 → 200* | | | | |
| | | $AlCl_3$/He | 120 → 40** | | | | |
| Upper layer | 1st layer region | $SiH_4$ | 300 | | | | |
| | | $H_2$ | 300 | 250 | 15 | 0.5 | 20 |
| | 2nd layer region | $SiH_4$ | 50 | | | | |
| | | $CH_4$ | 500 | 250 | 10 | 0.4 | 0.5 |

TABLE 135

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | | | | |
| | | $AlCl_3$/He | 120 → 40** | 250 | 5 | 0.4 | 0.05 |
| Upper layer | 1st layer region | $SiH_4$ | 300 | | | | |
| | | $H_2$ | 300 | 250 | 15 | 0.5 | 20 |
| | 2nd layer region | $SiH_4$ | 50 | | | | |
| | | $CH_4$ | 500 | 250 | 10 | 0.4 | 0.5 |

TABLE 136

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| Lower layer | $SiH_4$ | 50 | | | | |
| | $Cu(C_4H_7N_2O_2)_2$/He | 10 | | | | |
| | $H_2$ | 10 → 200* | | | | |
| | $AlCl_3$/He (S-side: 0.01 μm) | 100 → 10** | 250 | 5 | 0.4 | 0.03 |
| | (UL-side: 0.02 μm) | | | | | |

TABLE 136-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | | 10 | | | | |
| | 1st | $SiH_4$ | 300 | | | | |
| Upper layer | layer region | $H_2$ | 300 | 250 | 15 | 0.5 | 20 |
| | 2nd | $SiH_4$ | 50 | | | | |
| | layer region | $CH_4$ | 500 | 250 | 10 | 0.4 | 0.5 |

TABLE 137

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| | $SiH_4$ | 50 | | | | |
| Lower layer | $Cu(C_4H_7N_2O_2)_2$/He | | | | | |
| | | 5 → 3** | | | | |
| | $GeH_4$ | 10 → 0** | 150 | 0.5 | | |
| | $Mg(C_5H_5)_2$/He | 2 | ↓ | ↓ | 0.3 | 0.02 |
| | $H_2$ | 5 → 200* | 300 | 1.5 | | |
| | $AlCl_3$/He | | | | | |
| | (S-side: 0.01 μm) | | | | | |
| | | 200 → 30** | | | | |
| | (UL-side: 0.01 μm) | | | | | |
| | | 30 → 10** | | | | |
| | $SiH_4$ | 300 | | | | |
| Upper layer | He | 500 | 250 | 20 | 0.5 | 20 |

TABLE 138

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $SiH_4$ | 50 | | | | |
| Lower layer | | $SiF_4$ | 0.5 | | | | |
| | | NO | 8 | | | | |
| | | $Cu(C_4H_7N_2O_2)_2$/He | 6 | | | | |
| | | $Mg(C_5H_5)_2$/He | 2 | 250 | 1 | 0.3 | 0.02 |
| | | $CH_4$ | 1 | | | | |
| | | $B_2H_6$(against $SiH_4$) | 100 ppm | | | | |
| | | $H_2$ | 5 → 200* | | | | |
| | | $AlCl_3$/He | | | | | |
| | | (S-side: 0.01 μm) | | | | | |
| | | | 200 → 30** | | | | |
| | | (UL-side: 0.01 μm) | | | | | |
| | | | 30 → 10** | | | | |
| | 1st | $SiH_4$ | 300 | | | | |
| | layer | $H_2$ | 600 | | | | |
| Upper layer | region | $Cu(C_4H_7N_2O_2)_2$/He | 0.1 | 250 | 25 | 0.6 | 25 |
| | | $SiF_4$ | 0.5 | | | | |
| | | $AlCl_3$/He | 0.1 | | | | |
| | | $Mg(C_5H_5)_2$/He | 0.2 | | | | |
| | 2nd | $SiH_4$ | 50 | | | | |
| | layer | $CH_4$ | 500 | | | | |
| | region | $Cu(C_4H_7N_2O_2)_2$/He | 1 | | | | |
| | | $N_2$ | 1 | | | | |
| | | NO | 1 | 250 | 10 | 0.4 | 1 |
| | | $B_2H_6$(against $SiH_4$) | 1 ppm | | | | |
| | | $Al_2Cl_3$/He | 1 | | | | |
| | | $SiF_4$ | 2 | | | | |
| | | $Mg(C_5H_5)_2$/He | 1 | | | | |

TABLE 139

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| | $SiH_4$ | 10 → 100* | | | | |
| Lower layer | $GeH_4$ | 1 → 5* | | | | |
| | $H_2$ | 50 → 200* | | | | |
| | $Cu(C_4H_7N_2O_2)_2$/He | 20 | | | | |
| | $SiF_4$ | 10 | 250 | 10 | 0.4 | 0.2 |
| | $B_2H_6$(against $SiH_4$) | 100 ppm | | | | |
| | $Al(CH_3)_3$/He | | | | | |
| | (S-side: 0.05 μm) | | | | | |

TABLE 139-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | | 200 → 40** | | | | |
| | | (UL-side: 0.15 μm) | | | | | |
| | | | 40 → 10** | | | | |
| | 1st | $SiH_4$ | 400 | | | | |
| Upper | layer | $SiF_4$ | 40 | 250 | 10 | 0.5 | 15 |
| layer | region | Ar | 200 | | | | |
| | 2nd | $SiF_4$ | 10 | | | | |
| | layer | $SiH_4$ | 100 | 250 | 5 | 0.4 | 0.3 |
| | region | $NH_3$ | 30 | | | | |

TABLE 140

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $SiH_4$ | 10 → 100* | | | | |
| Lower layer | | $CH_4$ | 5 → 25* | | | | |
| | | $Cu(C_4H_7N_2O_2)_2$/He | | | | | |
| | | | 1 → 10* | | | | |
| | | $H_2$ | 5 → 200* | 300 | 10 | 0.4 | 0.2 |
| | | $AlCl_3$/He | | | | | |
| | | (S-side: 0.05 μm) | | | | | |
| | | | 200 → 40** | | | | |
| | | (UL-side: 0.15 μm) | | | | | |
| | | | 40 → 10** | | | | |
| | 1st | $SiH_4$ | 300 | | | | |
| Upper | layer | $H_2$ | 500 | 300 | 20 | 0.5 | 20 |
| layer | region | | | | | | |
| | 2nd | $SiH_4$ | 100 | | | | |
| | layer | $CH_4$ | 600 | 300 | 15 | 0.4 | 7 |
| | region | $PH_3$(against $SiH_4$) | 3000 ppm | | | | |
| | 3rd | $SiH_4$ | 40 | | | | |
| | layer | $CH_4$ | 600 | 300 | 10 | 0.4 | 0.1 |
| | region | | | | | | |

TABLE 141

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $SiH_4$ | 50 | | | | |
| Lower layer | | $Cu(C_4H_7N_2O_2)_2$/He | 10 | | | | |
| | | $Mg(C_5H_5)_2$/He | 3 | 330 | 5 | 0.4 | 0.05 |
| | | $H_2$ | 5 → 200* | | | | |
| | | $AlCl_3$/He | | | | | |
| | | | 200 → 20** | | | | |
| | 1st | $SiH_4$ | 400 | | | | |
| Upper | layer | $SiF_4$ | 10 | 330 | 25 | 0.5 | 25 |
| layer | region | $H_2$ | 800 | | | | |
| | 2nd | $SiH_4$ | 100 | | | | |
| | layer | $CH_4$ | 400 | 350 | 15 | 0.4 | 5 |
| | region | $B_2H_6$(against $SiH_4$) | | | | | |
| | | | 5000 ppm | | | | |
| | 3rd | $SiH_4$ | 20 | | | | |
| | layer | $CH_4$ | 400 | 350 | 10 | 0.4 | 1 |
| | region | $B_2H_6$(against $SiH_4$) | | | | | |
| | | | 8000 ppm | | | | |

TABLE 142

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $SiH_4$ | 50 | | | | |
| Lower layer | | $Mg(C_5H_5)_2$/He | 2 | | | | |
| | | $Cu(C_4H_7N_2O_2)_2$/He | 30 | | | | |
| | | $H_2S$(against $SiH_4$) | 10 ppm | | | | |
| | | $H_2$ | 5 → 200* | 300 | 1 | 0.3 | 0.02 |
| | | $AlCl_3$/He | | | | | |
| | | (S-side: 0.01 μm) | | | | | |
| | | | 200 → 30** | | | | |
| | | (UL-side: 0.01 μm) | | | | | |
| | | | 30 → 10** | | | | |
| | 1st | $SiH_4$ | 300 | | | | |

TABLE 142-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Upper layer | layer region | $H_2$ | 200 | 300 | 20 | 0.5 | 20 |
| | 2nd layer region | $SiH_4$ | 50 | | | | |
| | | $N_2$ | 500 | 300 | 20 | 0.4 | 5 |
| | | $PH_3$(against $SiH_4$) | 3000 ppm | | | | |
| | 3rd layer region | $SiH_4$ | 40 | | | | |
| | | $CH_4$ | 600 | 300 | 10 | 0.4 | 0.3 |

TABLE 143

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | | | | |
| | | $B_2H_6$(against $SiH_4$) | 100 ppm | | | | |
| | | $C_2H_2$ | 10 | 250 | 5 | 0.4 | 0.05 |
| | | $GeF_4$ | 5 | | | | |
| | | $Cu(C_4H_7N_2O_2)_2$/He | 5 | | | | |
| | | $H_2$ | 5 → 200* | | | | |
| | | $AlCl_3$/He | 200 → 20** | | | | |
| Upper layer | 1st layer region | $SiH_4$ | 300 | | | | |
| | | $H_2$ | 300 | 250 | 15 | 0.5 | 10 |
| | 2nd layer region | $SiH_4$ | 200 | | | | |
| | | $C_2H_2$ | 10 → 20* | 250 | 15 | 0.4 | 20 |
| | | NO | 1 | | | | |

TABLE 144

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | | | | |
| | | $Mg(C_5H_5)_2$/He | 10 | | | | |
| | | $PH_3$(against $SiH_4$) | 100 ppm | | | | |
| | | $Cu(C_4H_7N_2O_2)_2$/He | 5 | | | | |
| | | $H_2$ | 5 → 200* | 250 | 1 | 0.4 | 0.02 |
| | | $AlCl_3$/He (S-side: 0.01 μm) | 200 → 30** | | | | |
| | | (UL-side: 0.01 μm) | 30 → 10** | | | | |
| Upper layer | 1st layer region | $SiH_4$ | 300 | | | | |
| | | $H_2$ | 300 | 300 | 20 | 0.5 | 5 |
| | | $SiF_4$ | 20 | | | | |
| | 2nd layer region | $SiH_4$ | 100 | | | | |
| | | $CH_4$ | 100 | 300 | 15 | 0.4 | 20 |
| | | $SiF_4$ | 5 | | | | |
| | 3rd layer region | $SiH_4$ | 50 | | | | |
| | | $CH_4$ | 600 | 300 | 10 | 0.4 | 0.5 |
| | | $SiF_4$ | 5 | | | | |

TABLE 145

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10 → 100* | | | | |
| | | $Cu(C_4H_7N_2O_2)_2$/He | 1 → 10* | | | | |
| | | $H_2$ | 5 → 200* | | | | |
| | | $AlCl_3$/He (S-side: 0.05 μm) | | 300 | 5 | 0.4 | 0.2 |
| | | | 200 → 40** | | | | |
| | | (UL-side: 0.15 μm) | 40 → 10** | | | | |
| Upper layer | 1st layer region | $GeH_4$ | 5 | | | | |
| | | $SiH_4$ | 100 | | | | |
| | | $H_2$ | 300 | 300 | 5 | 0.2 | 8 |
| | 2nd layer region | $SiH_4$ | 300 | | | | |
| | | $NH_3$ | 50 | 300 | 15 | 0.4 | 25 |

TABLE 145-continued

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| | 3rd layer region | $SiH_4$<br>$NH_3$ | 100<br>50 | 300 | 10 | 0.4 | 0.3 |

TABLE 146

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$<br>$CH_4$<br>$H_2$<br>$AlCl_3$/He<br>(S-side: 0.05 μm) | 10 → 100*<br>2 → 20*<br>5 → 200*<br>200 → 40** | 250 | 5 | 0.4 | 0.02 |
| | | (UL-side: 0.15 μm) | 40 → 10** | | | | |
| | | $Cu(C_4H_7N_2O_2)_2$/He<br>$BF_3$(against $SiH_4$) | 5<br>10 → 100 ppm** | | | | |
| Upper layer | 1st layer region | $SiH_4$<br>$SiF_4$<br>$H_2$ | 100<br>5<br>200 | 300 | 3 | 0.5 | 3 |
| | 2nd layer region | $SiH_4$<br>$CH_4$<br>$PH_3$(against $SiH_4$)<br>$SiF_4$ | 100<br>100<br>50 ppm<br>5 | 300 | 15 | 0.4 | 30 |
| | 3rd layer region | $SiH_4$<br>$CH_4$<br>$SiF_4$ | 50<br>600<br>5 | 300 | 10 | 0.4 | 0.5 |

TABLE 147

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $Cu(C_4H_7N_2O_2)_2$/He<br>$SiH_4$<br>$C_2H_2$<br>$H_2$<br>$AlCl_3$/He<br>$PH_3$(against $SiH_4$) | 3 → 1**<br>50<br>5<br>5 → 200*<br>200 → 20**<br>10 ppm | 250 | 5 | 0.4 | 0.05 |
| Upper layer | 1st layer region | $Si_2H_6$<br>$H_2$<br>$Si_2F_6$ | 200<br>200<br>10 | 300 | 10 | 0.5 | 10 |
| | 2nd layer region | $SiH_4$<br>$C_2H_2$<br>$B_2H_6$(against $SiH_4$)<br>(S-side: 1 μm) | 300<br>50<br>0 → 100 ppm** | 330 | 20 | 0.4 | 30 |
| | | (UL-side: 29 μm) | 100 ppm | | | | |
| | 3rd layer region | $SiH_4$<br>$C_2H_2$ | 200<br>200 | 330 | 10 | 0.4 | 1 |

TABLE 148

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$<br>NO<br>$Cu(C_4H_7N_2O_2)_2$/He<br>$H_2$<br>$AlCl_3$/He<br>(S-side: 0.05 μm) | 10 → 100*<br>1 → 10*<br>1 → 5*<br>5 → 200*<br>200 → 40** | 250 | 5 | 0.4 | 0.2 |
| | | (UL-side: 0.15 μm)<br>$Mg(C_5H_5)_2$/He<br>$Si_2F_6$ | 40 → 10**<br>5 → 1**<br>1 | | | | |
| Upper layer | 1st layer region | $SiH_4$<br>$H_2$<br>$Si_2F_6$ | 100<br>300<br>10 | 300 | 5 | 0.2 | 8 |
| | 2nd | $SiH_4$ | 300 | | | | |

TABLE 148-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | layer region | $NH_3$ | 30 → 50* | 300 | 15 | 0.4 | 25 |
| | | $PH_3$ (against $SiH_4$) | 50 ppm | | | | |
| | | $Si_2F_6$ | 30 | | | | |
| | 3rd layer region | $SiH_4$ | 100 | | | | |
| | | $NH_3$ | 80 → 100* | 300 | 5 | 0.4 | 0.7 |
| | | $PH_3$ (against $SiH_4$) | 500 ppm | | | | |
| | | $Si_2F_6$ | 10 | | | | |

TABLE 149

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | | | | |
| | | $H_2$ | 5 → 200* | | | | |
| | | $AlCl_3$/He (S-side: 0.01 μm) | | 250 | 1 | 0.4 | 0.02 |
| | | | 200 → 30** | | | | |
| | | (UL-side: 0.01 μm) | | | | | |
| | | | 30 → 10** | | | | |
| | | $Cu(C_4H_7N_2O_2)_2$/He | 20 | | | | |
| | | $B_2H_6$ (against $SiH_4$) | 100 ppm | | | | |
| Upper layer | 1st layer region | $SiH_4$ | 300 | | | | |
| | | $H_2$ | 500 | 300 | 20 | 0.5 | 20 |
| | 2nd layer region | $SiH_4$ | 100 | | | | |
| | | $GeH_4$ | 10 → 50* | 300 | 5 | 0.4 | 1 |
| | | $H_2$ | 300 | | | | |
| | 3rd layer region | $SiH_4$ | 100 → 40** | | | | |
| | | $CH_4$ | 100 → 600* | 300 | 10 | 0.4 | 1 |

TABLE 150

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $Cu(C_4H_7N_2O_2)_2$/He | 25 | | | | |
| | | $SiH_4$ | 50 | | | | |
| | | $H_2$ | 5 → 200* | | | | |
| | | $GeH_4$ | 6 | | | | |
| | | $AlCl_3$/He (S-side: 0.01 μm) | | 300 | 1 | 0.3 | 0.02 |
| | | | 200 → 30** | | | | |
| | | (UL-side: 0.01 μm) | | | | | |
| | | | 30 → 10** | | | | |
| | | NO | 5 | | | | |
| | | $B_2H_6$ (against $SiH_4$) | 50 ppm | | | | |
| Upper layer | 1st layer region | $SiH_4$ | 300 | | | | |
| | | $H_2$ | 400 | 300 | 15 | 0.5 | 20 |
| | 2nd layer region | $SiH_4$ | 50 | | | | |
| | | $CH_4$ | 500 | 300 | 10 | 0.4 | 0.5 |

TABLE 151

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | | | | |
| | | $Cu(C_4H_7N_2O_2)_2$/He | 20 | | | | |
| | | $GeH_4$ | 5 | | | | |
| | | $H_2$ | 5 → 200* | | | | |
| | | $AlCl_3$/He (S-side: 0.01 μm) | | 300 | 0.7 | 0.3 | 0.02 |
| | | | 200 → 30** | | | | |
| | | (UL-side: 0.01 μm) | | | | | |
| | | | 30 → 10** | | | | |
| | | NO | 4 | | | | |
| | | $B_2H_6$ (against $SiH_4$) | 50 ppm | | | | |
| Upper layer | 1st layer region | $SiH_4$ | 200 | | | | |
| | | $H_2$ | 400 | 300 | 12 | 0.4 | 20 |

TABLE 151-continued

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| | 2nd layer region | $SiH_4$ | 40 | | | | |
| | | $CH_4$ | 400 | 300 | 7 | 0.3 | 0.5 |

TABLE 152

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 25 | | | | |
| | | $Cu(C_4H_7N_2O_2)_2$/He | 15 | | | | |
| | | $H_2$ | 5 → 100* | | | | |
| | | $AlCl_3$/He (S-side: 0.01 μm) | | 300 | 0.5 | 0.2 | 0.02 |
| | | | 100 → 15** | | | | |
| | | (UL-side: 0.01 μm) | | | | | |
| | | | 15 → 5** | | | | |
| | | $GeH_4$ | 4 | | | | |
| | | NO | 3 | | | | |
| | | $B_2H_6$ (against $SiH_4$) | 50 ppm | | | | |
| Upper layer | 1st layer region | $SiH_4$ | 150 | | | | |
| | | $H_2$ | 300 | 300 | 10 | 0.4 | 20 |
| | 2nd layer region | $SiH_4$ | 30 | | | | |
| | | $CH_4$ | 300 | 300 | 5 | 0.3 | 0.5 |

TABLE 153

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 20 | | | | |
| | | $H_2$ | 5 → 100* | | | | |
| | | $AlCl_3$/He (S-side: 0.01 μm) | | | | | |
| | | | 80 → 15** | 300 | 0.3 | 0.2 | 0.02 |
| | | (UL-side: 0.01 μm) | | | | | |
| | | | 15 → 5** | | | | |
| | | $Cu(C_4H_7N_2O_2)_2$/He | 10 | | | | |
| | | $GeH_4$ | 3 | | | | |
| | | NO | 2 | | | | |
| | | $B_2H_6$ (against $SiH_4$) | 50 ppm | | | | |
| Upper layer | 1st layer region | $SiH_4$ | 100 | | | | |
| | | $H_2$ | 300 | 300 | 6 | 0.3 | 20 |
| | 2nd layer region | $SiH_4$ | 20 | | | | |
| | | $CH_4$ | 200 | 300 | 3 | 0.2 | 0.5 |

TABLE 154

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $GeH_4$ | 5 | | | | |
| | | $SiH_4$ | 50 | | | | |
| | | $C_2H_2$ | 5 | | | | |
| | | $H_2$ | 5 → 200* | 500 | 5 | 0.4 | 0.05 |
| | | $AlCl_3$/He | 200 → 20** | | | | |
| | | $Cu(C_4H_7N_2O_2)_2$/He | 20 | | | | |
| | | $B_2H_6$ (against $SiH_4$) | 10 ppm | | | | |
| Upper layer | 1st layer region | $SiH_4$ | 300 | | | | |
| | | $H_2$ | 1500 | 500 | 30 | 0.5 | 10 |
| | 2nd layer region | $SiH_4$ | 200 | | | | |
| | | $C_2H_2$ | 10 → 20* | 500 | 30 | 0.4 | 20 |
| | | NO | 1 | | | | |

TABLE 155

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 150 | | | | |
| | | $Cu(C_4H_7N_2O_2)_2/He$ | 10 | | | | |
| | | $SiF_4$ | 10 | | | | |
| | | $H_2$ | 20 → 500* | | | | |
| | | $AlCl_3/He$ (S-side: 0.01 μm) | | 250 | 0.5 | 0.6 | 0.02 |
| | | (UL-side: 0.01 μm) | 400 → 80** | | | | |
| | | | 80 → 50** | | | | |
| | | NO | 10 | | | | |
| | | $B_2H_6$ (against $SiH_4$) | 100 ppm | | | | |
| Upper layer | 1st layer region | $SiH_4$ | 700 | | | | |
| | | $SiF_4$ | 30 | 250 | 0.5 | 0.5 | 20 |
| | | $H_2$ | 500 | | | | |
| | 2nd layer region | $SiH_4$ | 150 | | | | |
| | | $CH_4$ | 500 | 250 | 0.5 | 0.3 | 1 |

TABLE 156

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10 → 50* | | | | |
| | | $H_2$ | 5 → 100* | 300 | 1 | 0.01 | 0.2 |
| | | Ar | 200 | | | | |
| Upper layer | 1st layer region | $SiH_4$ | 300 | | | | |
| | | $H_2$ | 300 | 300 | 15 | 0.5 | 20 |
| | 2nd layer region | $SiH_4$ | 50 | | | | |
| | | $CH_4$ | 500 | 300 | 10 | 0.4 | 0.5 |

TABLE 157

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 5 → 50* | | | | |
| | | $H_2$ | 10 → 200* | 250 | 5 | 0.4 | 0.05 |
| | | $Al(CH_3)_3/He$ | 120 → 40* | | | | |
| | | $NaNH_2/He$ | 10 | | | | |
| Upper layer | 1st layer region | $SiH_4$ | 300 | | | | |
| | | $H_2$ | 300 | 250 | 0.5 | 0.5 | 20 |
| | 2nd layer region | $SiH_4$ | 50 | | | | |
| | | $CH_4$ | 500 | 250 | 10 | 0.4 | 0.5 |

TABLE 158

| | Comparative Example 9 | | Example 164 | Example 165 | |
|---|---|---|---|---|---|
| $Al(CH_3)_3/He$ Flow rates (sccm) | 120 → 10** | 120 → 20** | 120 → 40** | 120 → 60** | 120 → 80** |
| Content of AL (atomic %) | 9 | 13 | 20 | 28 | 35 |
| Ratio of film peeling-off (Example 1 = 1) | 23 | 11 | 1 | 0.95 | 0.93 |

TABLE 159

| Order of lamination (layer name) | | Gases and their flow rates (sccm) | |
|---|---|---|---|
| Lower layer | | $SiF_4$ | 3 |
| | | NO | 3 |
| | | $CH_4$ | 2 |
| | | $B_2H_6$ (against $SiH_4$) | 100 ppm |
| Upper layer | 1st layer region | $SiF_4$ | 0.2 |
| | | $Zn(C_2H_5)_2/He$ | 0.3 |

TABLE 159-continued

| Order of lamination (layer name) | | Gases and their flow rates (sccm) | |
|---|---|---|---|
| | 2nd layer region | $SiF_4$ | 1 |
| | | $B_2H_6$ (against $SiH_4$) | 2 ppm |
| | | NO | 0.5 |
| | | $Al(CH_3)_3/He$ | 0.5 |
| | | $Zn(C_2H_5)_2/He$ | 1 |

TABLE 160

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 5 → 50* | | | | |
| | | $H_2$ | 10 → 200* | | | | |
| | | $Al(CH_3)_3$/He | 120 → 40** | 300 | 5 | 0.4 | 0.05 |
| | | $Y(oi\text{-}C_3H_7)_3$/He | 10 | | | | |
| Upper layer | 1st layer region | $SiH_4$ | 300 | | | | |
| | | $H_2$ | 300 | 300 | 15 | 0.5 | 5 |
| | 2nd layer region | $SiH_4$ | 200 | | | | |
| | | $C_2H_2$ | 20 | 300 | 30 | 0.5 | 20 |
| | | $B_2H_6$ (against $SiH_4$) | 5 ppm | | | | |
| | | $H_2$ | 500 | | | | |
| | 3rd layer region | $SiH_4$ | 50 | | | | |
| | | $CH_4$ | 500 | 300 | 10 | 0.4 | 0.5 |

TABLE 161

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 15 → 150* | | | | |
| | | $SiF_4$ | 10 → 20* | | | | |
| | | $H_2$ | 20 → 300* | 250 | 0.5 | 0.6 | 0.07 |
| | | $Al(CH_3)_3$/He | 400 → 50** | | | | |
| | | $NaNH_2$/He | 20 | | | | |
| Upper layer | 1st layer region | $SiH_4$ | 700 | | | | |
| | | $SiF_4$ | 30 | 250 | 0.5 | 0.5 | 20 |
| | | $H_2$ | 500 | | | | |
| | 2nd layer region | $SiH_4$ | 150 | | | | |
| | | $CH_4$ | 500 | 250 | 0.5 | 0.3 | 1 |

TABLE 162

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| Lower layer | $SiH_4$ | 10 → 50* | 250 | 1 | 0.01 | 0.05 |
| | $H_2$ | 5 → 100* | | | | |
| | Ar | 200 | | | | |

What is claimed is:

1. A light receiving member having an aluminum support and a multilayered light receiving layer exhibiting photoconductivity formed on said aluminum support, characterized in that said multilayered light receiving layer comprises: (a) a lower layer in contact with said support and (b) an upper layer having a free surface disposed on said lower layer (a); said lower layer (a) comprising an inorganic material composed of aluminum atoms, silicon atoms, hydrogen atoms and atoms of an element capable of contributing to the control of image quality selected from the group consisting of boron, gallium, indium, thallium, phosphorus, arsenic, antimony, bismuth, sulfur, selenium, tellurium and polonium; said lower layer (a) having a portion in which said aluminum, silicon and hydrogen atoms are unevenly distributed across the layer thickness; said aluminum atoms being contained in said lower layer (a) such that their content decreases across the layer thickness in a direction upward from the interface between said lower layer (a) and said aluminum support and wherein said content of aluminum atoms is lower than 95 atomic % in the vicinity of the interface between said lower layer (a) and said aluminum support and higher than 5 atomic % in the vicinity of the interface between said lower layer (a) and said upper layer (b); said upper layer (b) comprising a plurality of layers regions, each said region comprising a non-single-crystal material composed of silicon atoms as the matrix, and wherein the layer region adjacent said lower layer (a) comprises a non-single-crystal material composed of silicon atoms as the matrix and at least one kind of atoms selected from the group consisting of hydrogen atoms and halogen atoms.

2. A light receiving member according to claim 1, wherein the amount of said silicon atoms contained in the lower layer is from 5 to 95 atomic %.

3. A light receiving member according to claim 1, wherein the amount of said hydrogen atoms contained in the lower layer is from 0.01 to 70 atomic %.

4. A light receiving member according to claim 1, wherein the amount of said element atoms capable of contributing to the control of image quality contained in the lower layer is from $1\times10^{-3}$ to $5\times10^{4}$ atomic ppm.

5. A light receiving member according to claim 1, wherein the lower layer further contains one kind of atoms selected from the group consisting of carbon atoms (c), nitrogen atoms (N) and oxygen atoms (O).

6. A light receiving member according to claim 5, wherein the amount of said atoms (C,N,O) contained in the lower layer is from $1\times10^{3}$ to $5\times10^{5}$ atomic ppm.

7. A light receiving member according to claim 1, wherein the lower layer further contains one kind of halogen atoms (X) selected from the group consisting of fluorine atoms, chlorine atoms, bromine atoms and iodine atoms.

8. A light receiving member according to claim 7, wherein the amount of said halogen atoms (X) contained in the lower layer is from 1 to $4\times10^5$ atomic ppm.

9. A light receiving member according to claim 5, wherein the lower layer further contains one kind of halogen atoms (X) selected from the group consisting of fluorine atoms, chlorine atoms, bromine atoms and iodine atoms.

10. A light receiving member according to claim 9, wherein the amount of said halogen atoms (X) contained in the lower layer is from 1 to $4\times10^5$ atomic ppm.

11. A light receiving member according to claim 1, wherein the lower layer further contains one kind of atoms selected from the group consisting of germanium atoms (Ge) and tin atoms (Sn).

12. A light receiving member according to claim 11, wherein the amount of said atoms (Ge, Sn) contained in the lower layer is from 1 to $9\times10^5$ atomic ppm.

13. A light receiving member according to claim 5, wherein the lower layer further contains one kind of atoms selected from the group consisting of germanium atoms (Ge) and tin atoms (Sn).

14. A light receiving member according to claim 13, wherein the amount of said atoms (Ge, Sn) contained in the lower layer is from 1 to $9\times10^5$ atomic ppm.

15. A light receiving member according to claim 7, wherein the lower layer further contains one kind of atoms selected from the group consisting of germanium atoms (Ge) and tin atoms (Sn).

16. A light receiving member according to claim 15, wherein the amount of said atoms (Ge, Sn) contained in the lower layer is from 1 to $9\times10^5$ atomic ppm.

17. A light receiving member according to claim 1, wherein the lower layer further contains atoms of a metal selected from the group consisting of magnesium, copper, sodium, yttrium, manganese and zinc.

18. A light receiving member according to claim 17 wherein the amount of said metal atoms contained in the lower layer is from 1 to $2\times10^5$ atomic ppm.

19. A light receiving member according to claim 5, wherein the lower layer further contains atoms of a metal selected from the group consisting of magnesium, copper, sodium, yttrium, manganese and zinc.

20. A light receiving member according to claim 19, wherein the amount of said metal atoms contained in the lower layer is from 1 to $2\times10^5$ atomic ppm.

21. A light receiving member according to claim 7, wherein the lower layer further contains atoms of a metal selected from the group consisting of magnesium, copper, sodium, yttrium, manganese and zinc.

22. A light receiving member according to claim 21, wherein the amount of said metal atoms contained in the lower layer is from 1 to $2\times10^5$ atomic ppm.

23. A light receiving member according to claim 11, wherein the lower layer further contains atoms of a metal selected from the group consisting of magnesium, copper, sodium, yttrium, manganese and zinc.

24. A light receiving member according to claim 23, wherein the amount of said metal atoms contained in the lower layer is from 1 to $2\times10^5$ atomic ppm.

25. A light receiving member according to claim 1, wherein the lower layer is 0.03 to 5 microns thick and the upper layer is 1 to 130 microns thick.

26. An electrophotographic process comprising:

(a) applying an electric field to the light receiving member of claim 1; and (b) applying an electromagnetic wave to said light receiving member thereby forming an electrostatic image.

* * * * *

UNITED STATES PATENT AND TRADEMARK OFFICE

CERTIFICATE OF CORRECTION

PATENT NO. : 4,886,723

DATED : December 12, 1989

INVENTOR(S) : TATSUYUKI AOIKE, ET AL.

It is certified that error appears in the above-identified patent and that said Letters Patent is hereby corrected as shown below: Title page:

IN [30] FOREIGN APPLICATION PRIORITY DATA

"112162" should read --62-112162--.

IN [57] ABSTRACT

Line 13, "non-single material" should read --non-single-crystal material--.

COLUMN 5

Line 5, "(c)," should read --(C),--.
Line 19, "on" should be deleted.
Line 50, "made up the" should read --made up of the--.
Line 65, "Al-Si ally" should read --Al-Si alloy--.

COLUMN 8

Line 11, "cases" should read --case--.

COLUMN 9

Line 41, "$T_B$ and position $T_B$" should read --$T_B$ and position $T_T$--.

COLUMN 14

Line 33, "II atoms" should read --III atoms--.
Line 44, "include" should read --includes--.
Line 53, "$S(C_2H_2)_2S$." should read --$S(C_2H_5)_2S$.--.
Line 55, "$(C_2H_3Se$," should read --$(C_2H_5)_2Se$,--.

--

UNITED STATES PATENT AND TRADEMARK OFFICE

CERTIFICATE OF CORRECTION

PATENT NO. : 4,886,723

DATED : December 12, 1989

INVENTOR(S) : TATSUYUKI AOIKE, ET AL.

It is certified that error appears in the above-identified patent and that said Letters Patent is hereby corrected as shown below:

COLUMN 14

Line 59, "as H2," should read --as $H_2$,--.
Line 62, "nitrogen atom (N)," should read --nitrogen atoms (N),--.

COLUMN 15

Line 1, "oxygen atoms 0)" should read --oxygen atoms (O)--.
Line 29, "($HN_3$," should read --($HN_3$),--.
Line 38, "($N_2O_5$," should read --($N_2O_5$),--.
Line 57, "($SiH_4$)." should read --($SiH_4$)--.

COLUMN 16

Line 14, "$SIHCl_3$," should read --$SiHCl_3$,--.
Line 38, "supply!tin" should read --supply tin--.
Line 43, "include" should read --includes--.
Line 58, "include" should read --includes--.

COLUMN 17

Line 12, "include" should read --includes--.
Line 30, "include" should read --includes--.
Line 64, "(Mn." should read --(Mn).--.

COLUMN 18

Line 40, "50-00°C.," should read --50-600°C.,--.

--

UNITED STATES PATENT AND TRADEMARK OFFICE

CERTIFICATE OF CORRECTION

PATENT NO. : 4,886,723

DATED : December 12, 1989

INVENTOR(S) : TATSUYUKI AOIKE, ET AL.

It is certified that error appears in the above-identified patent and that said Letters Patent is hereby corrected as shown below:

COLUMN 19

Line 13, "cases," should read --case,--.
Line 22, "cases," should read --case,--.

COLUMN 21

Line 13, "sown" should read --shown--.
Line 64, "1 X $10^{-3}$ atom-ppm" should read --1 X $10^{3}$ atom-ppm--.

COLUMN 22

Line 64, "$10^{3}$-2 X $10^{5}$ atom-ppm." should read --1 X $10^{3}$-2 X $10^{5}$ atom-ppm.--.
Line 68, "of" (first occurrence) should be deleted.

COLUMN 25

Line 41, "include," should read --includes,--.
Line 47, "include," should read --includes,--.
Line 64, "nitrogen atom" should read --nitrogen atoms--.

COLUMN 26

Line 16, "($C_4H_8$," should read --($C_4H_8$),--.
Line 29, "($NH_3N)_3$)" should read --($NH_4N_3$)--.
Line 40, "diiloxane" should read --disiloxane--.
Line 55, "include" should read --includes--.

--

UNITED STATES PATENT AND TRADEMARK OFFICE

CERTIFICATE OF CORRECTION

PATENT NO. : 4,886,723

DATED : December 12, 1989

INVENTOR(S) : TATSUYUKI AOIKE, ET AL.

It is certified that error appears in the above-identified patent and that said Letters Patent is hereby corrected as shown below:

COLUMN 27

Line 2, "include" should read --includes--.
Line 12, "$SnBr_2$," should read --$SnCl_2$, $SnBr_2$,--.
Line 22, "include" should read --includes--.
Line 26, "($Mg(C_5H_5)_2$" should read --$Mg(C_5H_5)_2$--.
Line 40, "include" should read --includes--.

COLUMN 29

Line 45, "produced..by" should read --produced by--.

COLUMN 30

Line 31, "with $H_2$gas ("$B_2H_6/H_2$"" should read --diluted with $H_2$ gas ("$B_2H_6/H_2$"--.
Line 39, "valves 1031-1037," should read --valves 1051-1057--.
Line 49, "valves 1061-1057," should read --valves 1051-1057--.

COLUMN 31

Line 13, "1071" should read --1017--.

COLUMN 34

Line 37, "EXAMPLE b 11" should read --EXAMPLE 11--.

--

UNITED STATES PATENT AND TRADEMARK OFFICE

CERTIFICATE OF CORRECTION

PATENT NO. : 4,886,723

DATED : December 12, 1989

INVENTOR(S) : TATSUYUKI AOIKE, ET AL.

It is certified that error appears in the above-identified patent and that said Letters Patent is hereby corrected as shown below:

COLUMN 35

Line 5, "$PH_3/H_4$ gas" should read --$PH_3/H_2$ gas--.

COLUMN 36

Line 21, "bearing balls," should read --ball bearings,--.
Line 59, "II07" should read --1107--.

COLUMN 38

Line 50, "Example 4" should read --Example 24--.

COLUMN 39

Line 65, "Table 1." should read --Table 31.--.

COLUMN 41

Line 32, "Example 41" should read --EXAMPLE 41--.

COLUMN 42

Line 7, "bearing balls," should read --ball bearings,--.
Line 32, "ple 24," should read --ple 23,--.
Line 33, "Example 24." should read --Example 23.--.

--

UNITED STATES PATENT AND TRADEMARK OFFICE

CERTIFICATE OF CORRECTION

PATENT NO. : 4,886,723

DATED : December 12, 1989

INVENTOR(S) : TATSUYUKI AOIKE, ET AL.

It is certified that error appears in the above-identified patent and that said Letters Patent is hereby corrected as shown below:

COLUMN 46

Line 31, "bearing balls," should read --ball bearings,--.

COLUMN 47

Line 46, "not used" should read --was not used--.

COLUMN 49

Line 20, "was" should read --, which was--.

COLUMN 50

Line 55, "bearing balls," should read --ball bearings,--.

COLUMN 55

Line 15, "bearing balls," should read --ball bearings,--.

COLUMN 57

Line 5, "$Al(CH_2)_3$" should read --$Al(CH_3)_3$--.
Line 52, "99.9999% pure)" should read --(99.9999% pure)--.

UNITED STATES PATENT AND TRADEMARK OFFICE

CERTIFICATE OF CORRECTION

PATENT NO. : 4,886,723

DATED : December 12, 1989

INVENTOR(S) : TATSUYUKI AOIKE, ET AL.

It is certified that error appears in the above-identified patent and that said Letters Patent is hereby corrected as shown below:

COLUMN 58

Line 51, "replace" should read --replaced--.

COLUMN 59

Line 55, "bearing balls," should read --ball bearings,--.

COLUMN 60

Line 36, "1401" should read --1410--.

COLUMN 62

Line 53, "99.9999% pure)" should read --(99.9999% pure)--.

COLUMN 63

Line 23, "$PH_3/_2$ gas" should read --$PH_3/H_2$ gas--.

COLUMN 65

Line 45, "bearing balls," should read --ball bearings,--.

UNITED STATES PATENT AND TRADEMARK OFFICE

CERTIFICATE OF CORRECTION

PATENT NO. : 4,886,723

DATED : December 12, 1989

INVENTOR(S) : TATSUYUKI AOIKE, ET AL.

It is certified that error appears in the above-identified patent and that said Letters Patent is hereby corrected as shown below:

COLUMN 67

Line 25, "occurrence" should read --occurrences--.
Line 27, "occurrence" should read --occurrences--.
Line 30, "was" should read --were--.
Line 51, "occurrence" should read --occurrences--.

COLUMN 77

TABLE 18, "$SiH^4$" should read --$SiH_4$--.

COLUMN 80

TABLE 21, "RF discharging power ($mW/cm_3$)" should read --RF discharging power ($mW/cm^3$)--.

--

UNITED STATES PATENT AND TRADEMARK OFFICE

CERTIFICATE OF CORRECTION

PATENT NO. : 4,886,723

DATED : December 12, 1989

INVENTOR(S) : TATSUYUKI AOIKE, ET AL.

It is certified that error appears in the above-identified patent and that said Letters Patent is hereby corrected as shown below:

COLUMNS 79-80

TABLE 22,

```
"     150
      20→500*
                250     0.5     0.6     0.02
      400→80**

      80→50**
700
30          250     0.5     0.5     20
500
150
500         250     0.5     0.3     1  "
```

should read

```
--    150
      20→500*
                250     0.5     0.6     0.02
      400→80**

      80→50**

      700
      30        250     0.5     0.5     20
      500
      150
      500       250     0.5     0.3     1  --.
```

UNITED STATES PATENT AND TRADEMARK OFFICE

CERTIFICATE OF CORRECTION

PATENT NO. : 4,886,723

DATED : December 12, 1989

INVENTOR(S) : TATSUYUKI AOIKE, ET AL.

It is certified that error appears in the above-identified patent and that said Letters Patent is hereby corrected as shown below:

COLUMN 81

TABLE 25, " 50
100 ppm
10→200*
250 5 0.4 0.03 "

should read

-- 50
100 ppm
10→200*
250 5 0.4 0.03 "

TABLE 25, "(UL-side: 0.02 μm)" should read --(UL-side: 0.01 μm)--.

COLUMN 82

TABLE 25, "RF discharging power (mW/cm$_3$)" should read --RF discharging power (mW/cm$^3$)--.

COLUMN 99

TABLE 56, "200→40*" should read --200→40**--.

TABLE 58, "$SiH_2H_6$" should read --$Si_2H_6$-- and "$CH_2H_2$" should read --$C_2H_2$--.

--

UNITED STATES PATENT AND TRADEMARK OFFICE

CERTIFICATE OF CORRECTION

PATENT NO. : 4,886,723

DATED : December 12, 1989

INVENTOR(S) : TATSUYUKI AOIKE, ET AL.

It is certified that error appears in the above-identified patent and that said Letters Patent is hereby corrected as shown below:

COLUMN 105

TABLE 67, " 50 should -- 50
5 read 5
5 5
10→200* 10→200*
120→40 120→40
300 300
300 300

50 50
500 " 500 --.

TABLE 69, "(UL-side: should
0.01" read --10--.

COLUMN 109

TABLE 74, " 3rd $SiH_4$ 20
layer $CH_4$ 400
region $B_2H_6$
(against $SiH_4$ 8000 ppm "

should read

-- 3rd $SiH_4$ 20
layer $CH_4$ 400
region $B_2H_6$
(against $SiH_4$) 8000 ppm --.

UNITED STATES PATENT AND TRADEMARK OFFICE

CERTIFICATE OF CORRECTION

PATENT NO. : 4,886,723

DATED : December 12, 1989

INVENTOR(S) : TATSUYUKI AOIKE, ET AL.

It is certified that error appears in the above-identified patent and that said Letters Patent is hereby corrected as shown below:

COLUMN 111

TABLE 78, "Reglon" should read --region--.
TABLE 79, "$SiH_4$" should read --$SiF_4$--.

TABLE 79, "Lower layer NO
$H_2$
$AlCl_3$/He
(S-side:0.05 μm)
(UL-side:0.15 μm)"

should read

-- Lower layer NO
$H_2$
$AlCl_3$/He
(S-side: 0.05 μm)
(UL-side: 0.15 μm) --.

COLUMN 112

TABLE 78, " 0.4 should read -- 0.4
0.2 0.2
0.4 0.4
0.4 " 0.4 --.

--

UNITED STATES PATENT AND TRADEMARK OFFICE

CERTIFICATE OF CORRECTION

PATENT NO. : 4,886,723

DATED : December 12, 1989

INVENTOR(S) : TATSUYUKI AOIKE, ET AL.

It is certified that error appears in the above-identified patent and that said Letters Patent is hereby corrected as shown below:

COLUMN 113

TABLE 79-continued, " 3rd layer region " $SiH_4$ $CH_4$ should read -- 3rd layer region $SiH_4$ $CH_4$ --.

TABLE 80, "$Si_2f_6$" should read --$Si_2F_6$-- and

" 5 0.4 should read -- 5 0.4 10 0.5 " 10 0.5 --.

TABLE 81, "5→20" should read --5→20*--. and

" $B_2H_6$ (against $SiH_4$) $AlCl_3$/He (S-side:0.05 μm) "

should read

-- $B_2H_6$ (against $SiH_4$) $AlCl_3$/He (S-side: 0.05 μm) --.

UNITED STATES PATENT AND TRADEMARK OFFICE

CERTIFICATE OF CORRECTION

PATENT NO. : 4,886,723

DATED : December 12, 1989

INVENTOR(S) : TATSUYUKI AOIKE, ET AL.

It is certified that error appears in the above-identified patent and that said Letters Patent is hereby corrected as shown below:

COLUMN 117

TABLE 87, " $SiH_4$ 200
$C_2H_2$ 10→20*
NO "

should read --$SiH_4$ 200
$C_2H_2$ 10→20*
NO 1--.

COLUMN 123

TABLE 98, "$AlCl_3He$" should read --$AlCl_3/He$--.

COLUMN 125

TABLE 101, "$H_2$ 2→200**" should read
--$H_2$ 2→200*--.

COLUMN 127

TABLE 102-continued, "$AlCl_3He$" should read --$AlCl_3/He$--.

--

UNITED STATES PATENT AND TRADEMARK OFFICE

CERTIFICATE OF CORRECTION

PATENT NO. : 4,886,723

DATED : December 12, 1989

INVENTOR(S) : TATSUYUKI AOIKE, ET AL.

It is certified that error appears in the above-identified patent and that said Letters Patent is hereby corrected as shown below:

COLUMN 140

TABLE 124, " 250 5 0.4 0.05

300 10 0.5 10 "

should read

-- 250 5 0.4 0.05

300 10 0.5 10 --.

COLUMN 156

TABLE 150, " 0.3 should read -- 0.3

0.5 0.5

0.4 " 0.4 --.

COLUMN 159

TABLE 158, "Content of AL" should read --Content of Al--.

COLUMN 161

TABLE 160, "2nd layer region region" should read --2nd layer region--.

Line 67, "layers" should read --layer--.

UNITED STATES PATENT AND TRADEMARK OFFICE

CERTIFICATE OF CORRECTION

PATENT NO. : 4,886,723

DATED : December 12, 1989

INVENTOR(S) : TATSUYUKI AOIKE, ET AL.

It is certified that error appears in the above-identified patent and that said Letters Patent is hereby corrected as shown below:

COLUMN 162

Line 62, "atoms (c)," should read --atoms (C),--.

Signed and Sealed this

Fourth Day of February, 1992

*Attest:*

HARRY F. MANBECK, JR.

*Attesting Officer*

*Commissioner of Patents and Trademarks*